US011536128B2

(12) United States Patent
Bailey et al.

(10) Patent No.: US 11,536,128 B2
(45) Date of Patent: Dec. 27, 2022

(54) METHOD FOR DRILLING WELLBORES UTILIZING DRILLING PARAMETERS OPTIMIZED FOR STICK-SLIP VIBRATION CONDITIONS

(71) Applicant: ExxonMobil Upstream Research Company, Spring, TX (US)

(72) Inventors: Jeffrey R. Bailey, Houston, TX (US); Gregory S. Payette, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 17/074,018

(22) Filed: Oct. 19, 2020

(65) Prior Publication Data

US 2021/0047909 A1 Feb. 18, 2021

Related U.S. Application Data

(63) Continuation-in-part of application No. 15/938,821, filed on Mar. 28, 2018, now Pat. No. 10,851,639.

(60) Provisional application No. 62/479,909, filed on Mar. 31, 2017.

(51) Int. Cl.

| | |
|---|---|
| ***E21B 44/04*** | (2006.01) |
| ***E21B 47/00*** | (2012.01) |
| ***E21B 47/04*** | (2012.01) |

(52) U.S. Cl.

CPC ..... *E21B 44/04* (2013.01); *E21B 47/00* (2013.01); *E21B 47/04* (2013.01); *E21B 2200/20* (2020.05)

(58) Field of Classification Search

CPC ..... E21B 44/04; E21B 47/00; E21B 47/04; E21B 2200/20

See application file for complete search history.

(56) References Cited

U.S. PATENT DOCUMENTS

| | | | |
|---|---|---|---|
| 5,852,235 | A | 12/1998 | Pavone et al. |
| 6,363,780 | B1 | 4/2002 | Rey-Fabret et al. |
| 7,896,105 | B2 | 3/2011 | Dupriest |
| 8,214,188 | B2 | 7/2012 | Baily et al. |
| 8,504,342 | B2 | 8/2013 | Bailey et al. |
| 8,589,136 | B2 | 11/2013 | Ertas et al. |
| 8,798,978 | B2 | 8/2014 | Ertas et al. |

(Continued)

FOREIGN PATENT DOCUMENTS

| | | |
|---|---|---|
| WO | 2010064031 | 6/2010 |
| WO | 2013/036357 A1 | 3/2013 |

OTHER PUBLICATIONS

Vandiver, J.K., et al. (1986) "Coupled Axial, Bending, and Torsional Vibration of Rotating Drill Strings", DEA Project 29, Phase III Report, Massachusetts Institute of Technology; pp. 1-38.

(Continued)

*Primary Examiner* — Manuel A Rivera Vargas

(74) *Attorney, Agent, or Firm* — ExxonMobil Upstream Research Company—Law Department

(57) ABSTRACT

The present disclosure relates generally to the field of drilling operations. More particularly, the present disclosure relates to methods for drilling wells utilizing drilling equipment, more particularly drill string assemblies, and making adjustments to drilling parameters during the drilling operation based on analysis of the drilling data. Included are methods for the selection of modified drilling parameters to mitigate torsional vibration dysfunction.

21 Claims, 25 Drawing Sheets

(56) References Cited

U.S. PATENT DOCUMENTS

| | | | | |
|---|---|---|---|---|
| 8,977,523 | B2 * | 3/2015 | Ertas | E21B 45/00 703/2 |
| 9,285,794 | B2 | 3/2016 | Wang et al. | |
| 9,436,173 | B2 | 9/2016 | Wang et al. | |
| 9,482,084 | B2 | 11/2016 | Chang et al. | |
| 9,483,586 | B2 * | 11/2016 | Bailey | G06F 30/00 |
| 9,598,947 | B2 | 3/2017 | Wang et al. | |
| 10,337,295 | B2 | 7/2019 | Bailey et al. | |
| 10,352,099 | B2 | 7/2019 | Spivey et al. | |
| 10,662,751 | B2 | 5/2020 | Payette et al. | |
| 10,921,471 | B2 | 2/2021 | Lolla et al. | |
| 10,968,730 | B2 | 4/2021 | Wang et al. | |
| 11,320,552 | B2 | 5/2022 | Lolla et al. | |
| 2009/0055135 | A1 | 2/2009 | Tang et al. | |
| 2009/0090555 | A1 * | 4/2009 | Boone | E21B 44/02 175/45 |
| 2012/0118637 | A1 | 5/2012 | Wang et al. | |
| 2015/0275648 | A1 | 10/2015 | Wang et al. | |
| 2016/0138382 | A1 * | 5/2016 | Badkoubeh | E21B 3/035 175/24 |
| 2019/0111661 | A1 | 4/2019 | Wang et al. | |

OTHER PUBLICATIONS

Halsey, G.W., et al. (1988) "Torque Feedback Used to Cure Slip-Stick Motion", SPE-18049-MS,SPE Annual Technical Conference and Exhibition, Oct. 2-5, Houston, Texas, pp. 277-282.

Clayer, F. et al. (1990) "The Effect of Surface and Downhole Boundary Conditions on the Vibration of Drillstrings", SPE 20447-MS, SPE Annual Technical Conference and Exhibition, Sep. 23-26, New Orleans, Louisiana, pp. 431-442.

Chang, D., et al. (2014) "Field Trial Results of A Drilling Advisory System", IPTC 17216. International Petroleum Technology Conference, Jan. 19-22, Doha, Qatar, pp. 1-13.

Ertas, D., et al. (2014), "Drillstring Mechanics Model for Surveillance, Root Cause Analysis, and Mitigation of Torsional and Axial Vibrations", SPE-163420-PA, 2013 SPE/IADC Drilling Conference and Exhibition in Amsterdam, The Netherlands, Mar. 5-7, 2013, pp. 405-417.

Payette et al. (2015) "Mitigating Drilling Dysfunction Using a Drilling Advisory System: Results from Recent Field Applications", IPTC 18333-MS, International Petroleum Technology Conference, Dec. 6-9, Doha, Qatar pp. 1-23.

Bailey, J.R., "Improved Methods to Understand and Mitigate Stick-Slip Torsional Vibrations", Society of Petroleum Engineers, Mar. 6-8, 2018, pp. 1-21.

* cited by examiner

METHOD FOR DRILLING WELLBORES UTILIZING DRILLING PARAMETERS OPTIMIZED FOR STICK-SLIP VIBRATION CONDITIONS

CROSS REFERENCE TO RELATED APPLICATION

The present application is a continuation-in-part of U.S. patent application Ser. No. 15/938,821, filed Mar. 28, 2018, entitled "METHOD FOR DRILLING WELLBORES UTILIZING A DRILL STRING ASSEMBLY OPTIMIZED FOR STICK-SLIP VIBRATION CONDITIONS" and claims the benefit of U.S. Provisional Application Ser. No. 62/479,909 filed Mar. 31, 2017, entitled "METHOD FOR DRILLING WELLBORES UTILIZING A DRILL STRING ASSEMBLY OPTIMIZED FOR STICK-SLIP VIBRATION CONDITIONS", the disclosures of which are incorporated herein by reference in their entireties.

FIELD

The present disclosure relates generally to the field of drilling operations. More particularly, the present disclosure relates to methods for drilling wells utilizing drilling equipment, more particularly drill string assemblies and drilling parameters, that are modified based on measured and predicted stick-slip vibration conditions based on drilling operations data obtained from a well being drilled or a separate well.

BACKGROUND

This section introduces various aspects of art that may be associated with some embodiments of the present invention to facilitate a better framework for understanding some of the various techniques and applications of the claimed subject matter. Accordingly, it should be understood that these Background section statements are to be read in this light and not necessarily as admissions of prior art.

Vibrations incurred in drill string assemblies during the drilling process are known to potentially have a significant effect on Rate of Penetration (ROP) and represent a significant challenge to interpret and mitigate in pursuit of reducing the time and cost of drilling subterranean wells. Drill string assemblies (or "drill strings") vibrate during drilling for various reasons related to one or more drilling parameters. For example, the rotary speed (RPM), weight on bit (WOB), bit design, mud viscosity, etc. each may affect the vibrational tendency of a given drill tool assembly during a drilling operation. Measured depth (MD), rock properties, hole conditions, and configuration of the drill tool assembly may also influence drilling vibrations. As used herein, drilling parameters include characteristics and/or features of both the drilling hardware (e.g., drill string assembly) and the drilling operations.

As used herein, drill string assembly (or "drill string" or "drill assembly") refers to assemblies of components used in drilling operations. Exemplary components that may collectively or individually be considered a part of the drill string include rock cutting devices, bits, mills, reamers, bottom hole assemblies, drill collars, drill strings, couplings, subs, stabilizers, Measurement While Drilling (MWD) tools, etc. Exemplary rig systems may include the top drive, rig control systems, etc., and may form certain boundary conditions. Deployment of vibrationally poor drill tool assembly designs and conducting drilling operations at conditions of high downhole vibrations can result in loss of rate of penetration, shortened drill tool assembly life, increased number of trips, increased failure rate of downhole tools, and increased non-productive time.

A fixed cutter bit often requires more torque than a corresponding roller cone bit drilling similar formations at comparable conditions, although both bits can experience torsional vibration issues. The "bit friction factor" describes how much torque is required for a bit to drill as a function of bit weight, wherein more aggressive bits have higher friction factors. Increased bit torque and fluctuations in bit torque can lead to an increase in the phenomenon known as "stick-slip," an unsteady rotary speed at the bit, even when surface RPM remains substantially constant. Excessive stick-slip can be severely damaging to drill string assemblies and associated equipment. Bits with higher friction factors typically encounter more torsional stick-slip vibrations than bits with lower friction factors, but they can also drill at faster rates. Roller cone bits may sometimes be more prone to axial vibration issues than corresponding fixed cutter bits. Although axial vibrations may be reduced by substituting fixed cutter bits for roller cone bits, some drilling operations with either type of bit may continue to experience axial vibration problems. Fixed cutter bits can be severely damaged by axial vibrations as the PDC (Polycrystalline Diamond Compact) wafer of the bit can be knocked off its substrate if the axial vibrations are too severe. Axial vibrations are known to be problematic for rotary tricone bits, as the classic trilobed bottomhole pattern generates axial motion at the bit. There are known complex mathematical and operational methods for measuring and analyzing downhole vibrations. However, these typically require a substantial amount of data, strong computational power, and special skill to use and interpret.

Typically, severe axial vibration dysfunction can be manifested as "bit bounce," which can result in a momentary lessening or even a momentary complete loss of contact between the rock formation and the drill bit cutting surface through part of the vibration cycle. Such axial vibrations can cause dislocation of PDC cutters and tricone bits may be damaged by high shock impact with the formation. Dysfunctional axial vibration can occur at other locations in the drill string assembly. Other cutting elements in the drill string assembly could also experience a similar effect. Small oscillations in weight on bit (WOB) can result in drilling inefficiencies, leading to decreased ROP. For example, the depth of cut (DOC) of the bit typically varies with varying WOB, giving rise to fluctuations in the bit torque, thereby inducing torsional vibrations. The resulting coupled torsional-axial vibrations may be among the most damaging vibration patterns as this extreme motion may then lead to the generation of lateral vibrations.

Some patent applications and technical articles have addressed mathematical methods and processes for real-time measurements of stick-slip conditions in an operating drilling system and propose methods to alert the drilling operator when stick-slip conditions are likely to occur. Other data analysis and/or control systems are knowledge-based systems which by analyzing drilling data can "learn" under which conditions stick-slip is likely to occur. These systems provide many alerts to the drilling operator when such conditions are likely to occur or are occurring, suggesting to the operator drilling parameters to minimize stick-slip conditions, or control operations to minimize stick-slip conditions while maximizing operational parameters such as Rate of Penetration (ROP).

Recently developed practices around optimizing the Bottom-Hole Assembly (BHA) design (U.S. Pat. No. 9,483,586) and drilling parameters for robust vibrational performance, and using real-time Mechanical Specific Energy (MSE) monitoring for surveillance of drilling efficiency (U.S. Pat. No. 7,896,105) have significantly improved drilling performance. MSE is particularly useful in identifying drilling inefficiencies arising from, for example, dull bits, poor weight transfer to the bit, and whirl. These dysfunctions tend to reduce ROP and increase expended mechanical power due to the parasitic torques generated, thereby increasing MSE. The availability of real-time MSE monitoring for surveillance allows the driller to take corrective action. One of the big advantages of MSE analysis is that it does not require real-time downhole tools that directly measure vibration severity, which are expensive and prone to malfunction in challenging drilling environments.

Multiple efforts have been made to study and/or model these more complex torsional and axial vibrations, some of which are discussed here to help illustrate the advances made by the technologies of the present disclosure. DEA Project 29 was a multi-partner joint industry program initiated to develop modeling tools for analyzing drill tool assembly vibrations. The program focused on the development of an impedance-based, frequency-dependent, mass-spring-dashpot model using a transfer function methodology for modeling axial and torsional vibrations. These transfer functions describe the ratio of the surface state to the input condition at the bit. The boundary conditions for axial vibrations consisted of a spring, a damper at the top of the drill tool assembly (to represent the rig) and a "simple" axial excitation at the bit (either a force or displacement). For torsional vibrations, the bit was modeled as a free end (no stiffness between the bit and the rock) with damping. This work also indicated that downhole phenomena such as bit bounce and stick-slip are observable from the surface. While the DEA Project 29 recognized that the downhole phenomena were observable from the surface, they did not specifically attempt to quantify this. Results of this effort were published as "Coupled Axial, Bending and Torsional Vibration of Rotating Drill Strings", DEA Project 29, Phase III Report, J. K. Vandiver, Mass. Institute of Technology and "The Effect of Surface and Downhole Boundary Conditions on the Vibration of Drill strings," F. Clayer et al, SPE 20447, 1990.

Additionally, U.S. Pat. No. 5,852,235 (235 patent) and U.S. Pat. No. 6,363,780 (780 patent) describe methods and systems for computing the behavior of a drill bit fastened to the end of a drill string. In the '235 patent, a method was proposed for estimating the instantaneous rotational speed of the bit at the well bottom in real-time, taking into account the measurements performed at the top of the drill string and a reduced model. In the '780 patent, a method was proposed for computing "Rf, a function of a principal oscillation frequency of a weight on hook WOH divided by an average instantaneous rotating speed at the surface of the drill string, Rwob being a function of a standard deviation of a signal representing a weight on bit WOB estimated by the reduced physical model of the drill string from the measurement of the signal representing the weight on hook WOH, divided by an average weight on bit $WOB_0$ defined from a weight of the drill string and an average of the weight on hook $WOH_0$, and any dangerous longitudinal behavior of the drill bit determined from the values of Rf and Rwob" in real-time.

These methods require the capability to run in real-time and a "reduced" model that can accept a subset of measurements as input and generate outputs that closely match the remaining measurements. For example, in the '235 patent, the reduced model may accept the surface RPM signal as an input and compute the downhole RPM and surface torque as outputs. However, the estimates for quantities of interest, such as downhole RPM, cannot be trusted except for those occurrences that obtain a close match between the computed and measured surface torque. This typically requires continuously tuning model parameters, since the torque measured at the surface may change not only due to torsional vibrations but also due to changes in rock formations, bit characteristics, borehole patterns, etc., which are not captured by the reduced model. Since the reduced model attempts to match the dynamics associated with relevant vibrational modes as well as the overall trend of the measured signal due to such additional effects, the tuned parameters of the model may drift away from values actually representing the vibrational state of the drilling assembly. This drift can result in inaccurate estimates of desired parameters.

Another disadvantage of such methods is the requirement for specialized software, trained personnel, and computational capabilities available at each drilling operation to usefully utilize and understand such systems.

Patent application publication entitled "Method and Apparatus for Estimating the Instantaneous Rotational Speed of a Bottom Hole Assembly," (Intl Patent Application Publication No. WO 2010/064031 ('031 reference)) continues prior work in this area as an extension of IADC/SPE Publication 18049, "Torque Feedback Used to Cure Slip-Stick Motion," and previous related work. One primary motivation for these efforts is to provide a control signal to the drilling apparatus to adjust the power to the rotary drive system to reduce torsional drill string vibrations. A simple drill string compliance function is disclosed providing a stiffness element between the rotary drive system at the surface and the bottom hole assembly. Inertia, friction, damping, and several wellbore parameters are excluded from the drill string model. Also, the '031 reference fails to propose means to evaluate the quality of the torsional vibration estimate by comparison with downhole data, offers only simple means to calculate the downhole torsional vibrations using a basic torsional spring model, provides few means to evaluate the surface measurements, does not discuss monitoring surface measurements for bit axial vibration detection, and does not use the monitoring results to make a comprehensive assessment of the amount or severity of stick-slip observed for a selected drilling interval. This reference merely teaches a basic estimate of the downhole instantaneous rotational speed of the bit for the purpose of providing an input to a surface drive control system. Such methods fail to enable real-time diagnostic evaluation and indication of downhole dysfunction.

Other patents are related to improved methods to estimate the effective vibration amplitudes of the bottom of the drill tool assembly, such as at or near a drill bit, based on evaluation of selected surface drilling parameters and use the information to enhance drilling operations (U.S. Pat. No. 8,977,523). In this method, data can be taken from the well drilling operations to determine a Torsional Severity Estimate ("TSE") which is then utilized to assist the system to determine drilling operational parameters to minimize stick-slip (especially severe stick-slip) vibrations while drilling a well. A paper entitled "Drillstring Mechanics Model for Surveillance, Root Cause Analysis, and Mitigation of Torsional and Axial Vibrations" was presented at the 2013 SPE/IADC Drilling Conference and Exhibition in Amsterdam, The Netherlands, 5-7 Mar. 2013 (SPE/IADC Presentation No. 163420). It describes similar methods as in the U.S. Pat. No. 8,977,523 patent for a surveillance system utilizing real time well operating data, calculating a current value of the TSE, and generating an envelope for Max/Min RPM of the drill string assembly which is displayed to a drilling operator for drilling monitoring purposes. This reference identifies a linear relationship between stick-slip resistance and rotary speed (RPM). It is further known that, to first order, bit torque is linear in friction factor μ and also in Weight-on-Bit (WOB). The operator may make changes in the actual drilling operation, such as adjusting the RPMs, the WOB, the ROP or other parameters to maintain the drilling operation within a window to minimize stick-slip conditions and actual stick-slip vibrations.

In practice, one limitation of the methods that rely on TSE is that the operational monitoring software must have a reasonably detailed description of the drill string and BHA design. Although it initially did not seem to be much of a limitation, this has indeed been found to be a practical issue, particularly in lower cost operations such as the development of unconventional resources.

Practical methods have been disclosed herein which seeks to provide operational guidance to a surveillance effort without the need for a detailed drill string design to be provided in the analysis. This method leverages the concepts of ratios disclosed in U.S. Patent Application Publication No. 2018-0283161A1 to enhance the drilling surveillance process.

While the methods in the art provide for the MSE surveillance of a drilling operation with an existing drill string, and new methods provide for adapting string design based on torsional vibrations, they do not provide for a method to adjust drilling parameters of a drilling operation in progress to minimize stick-slip vibrations without requiring entry of drill string design data into drilling surveillance software. The art remains in need of a simple drilling surveillance methodology to adjust drilling parameters quantitatively to achieve specified improvements in stick-slip vibration conditions.

SUMMARY

In one embodiment, the present techniques relate to a method for drilling a wellbore in a subterranean formation. The method includes: identifying a first interval having torsional vibration within a wellbore; calculating representative values for drilling parameters for the first interval; determining Torque Swing Ratio values for the drilling parameters for the first interval, wherein the Torque Swing Ratio is one of specific torque swing, normalized specific torque swing, and a combination thereof; determining a reference value for the Torque Swing Ratio at full stick-slip for a drill string; determining a Stick-Slip Design Factor (SSDF) and a drilling parameter threshold for a second interval, wherein the SSDF is based on the Torque Swing Ratio values and the reference value; monitoring drilling parameters for the second interval; determining Torque Swing Ratio values from the drilling parameters for the second interval; and managing a drilling operation for the second interval based on the drilling parameter threshold and a comparison of the determined Torque Swing Ratio values for the second interval with the Torque Swing Ratio reference value.

In another embodiment, the present techniques relate to a drilling rig system for drilling a wellbore in a subterranean formation. The drilling rig system including: a drilling rig; a drill string attached to the drilling rig and partially disposed within a wellbore; a drill bit attached to the drill string and configured to penetrate a subsurface formation to form a wellbore; and a drilling control system for managing drilling operations. The drilling control system is configured to: monitor drilling parameters associated with the drill string and the drill bit, wherein the drilling parameters comprise rotary speed (RPM), weight on bit (WOB), and torque (TQ); identify a first interval having torsional vibration within the wellbore; calculate representative values for the drilling parameters for the first interval; determine Torque Swing Ratio values for the drilling parameters for the first interval, wherein the Torque Swing Ratio is one of specific torque swing, normalized specific torque swing, and a combination thereof determine a reference value for the Torque Swing Ratio at full stick-slip for the drill string; determine a Stick-Slip Design Factor (SSDF) and a drilling parameter threshold for a second interval, wherein the SSDF is based on the Torque Swing Ratio values and the reference value; monitor drilling parameters for the second interval; determine Torque Swing Ratio from the drilling parameters for the second interval; and provide notifications for the second interval based on one of the drilling parameter threshold, the comparison of the Torque Swing Ratio reference value with the determined Torque Swing Ratio values, and any combination thereof. Further, in one or more embodiments, the method or system may include further enhancements. For example, the drilling parameters may include rotary speed (RPM), weight on bit (WOB), and drill string torque (TQ); further include: selecting an averaging function to represent RPM and WOB, and calculating averaged rotary speed for the first interval values ($\overline{RPM}_1$) and averaged weight on bit ($\overline{WOB}_1$) values for the first drilling interval; and further include calculating torque swing and specific torque swing for the first interval based on the following: calculating the torque swing $\Delta TQ_i$ for each torsional vibration cycle (i) based on the following: for torque swing $\Delta TQ_i$ for each i:

$$\Delta TQ_i = \max(TQ_i, TQ_{i-1}, \ldots, TQ_{i-P}) = \min(TQ_i, TQ_{i-1}, \ldots, TQ_{i-P})$$

where i is index for torsional vibration cycle; P is a time window length at least as long as the torsional vibration period; $\max(TQ_i, TQ_{i-1}, TQ_{i-P})$ is the maximum torque value over the torsional vibration cycle; and $\min(TQ_i, TQ_{i-1}, TQ_{i-P})$ is the minimum torque value over the torsional vibration cycle; calculating an average RPM for each i ($RPM_i$); and determining specific torque swing ΔTQSi values for each i based on the following: $\Delta TQS_i = \Delta TQ_i / RPM_i$. In addition, the present techniques may include identifying the Torque Swing Ratio based on the specific torque swing; calculating a normalized specific torque swing $x_i$ for each i of the first interval based on the equation:

$$\tau_i = \Delta TQS_{,i} \cdot \frac{RPM_i}{\overline{RPM}_1} \cdot \frac{\overline{WOB}_1}{WOB_i},$$

where $\tau_i$ is the normalized specific torque swing per RPM; and $WOB_i$ is a representative WOB for each i; identifying the Torque Swing Ratio based on the normalized specific torque swing; further include determining a critical value $\tau_{crit}$ from a distribution of $x_i$ for the first interval such that 10% of the distribution has higher normalized specific torque swing values for data in the first interval; wherein the Torque Swing Ratio reference value for the first interval is $\Delta TQS_{ref}$; and wherein the determining the SSDF for the second interval further comprises calculating the SSDF for the second interval based on the following: $SSDF=\Delta TQS_{ref}/\tau_{crit}$; and further includes: i) configuring a drilling control system to calculate WOB in the second interval; ii) configuring the drilling control system to operate by not exceeding a WOB limit, wherein the WOB limit is determined based on the following:

$$WOB = SSDF \cdot \frac{\overline{WOB_1}}{\overline{RPM_1}} \cdot RPM;$$

and ii) drilling the second interval of the wellbore by applying the WOB limit and adjusting drilling parameters to maintain the WOB to be less than or equal to the WOB limit. Moreover, the present techniques may include providing a visual notification of the monitored drilling parameters that exceed the drilling parameter threshold and specific torque swing values that exceed the Torque Swing Ratio reference value; providing an audio notification of the monitored drilling parameters that exceed the drilling parameter threshold and specific torque swing values that exceed the Torque Swing Ratio reference value; modeling a drill string representing drilling equipment drilling the wellbore in the subterranean formation to create a drill string model; and calculating a reference value of specific torque swing at full stick-slip with results from the drill string model; and setting the Torque Swing Ratio reference value to the calculated reference value; receiving downhole torsional vibration data from drilling tools comprising stick-slip values $TSE_{BRPM}$ at a drill bit for the first interval; calculating a first distribution of the stick-slip values $TSE_{BRPM}$ from the downhole torsional vibration data; calculating a second distribution of Torque Swing Ratio values from the drilling parameters for the first interval; comparing the second distribution of Torque Swing Ratio values with the first distribution of stick-slip values $TSE_{BRPM}$ to determine distribution cutoff values; and determining the Torque Swing Ratio reference value based on the determined distribution cutoff values; wherein the stick-slip values at the drill bit for the first interval are calculated using the relation for $TSE_{BRPM}$;

$$TSE_{BRPMi} = \frac{\max(BRPM_i, BRPM_{i-1}, \ldots, BRPM_{i-p}) - \text{Average}(BRPM_i, BRPM_{i-1}, \ldots, BRPM_{i-p})}{\text{Average}(BRPM_i, BRPM_{i-1}, \ldots, BRPM_{i-p})}$$

where i is index for torsional vibration cycle; P is a time window length at least as long as the torsional vibration period;

max ($BRPM_i$, $BRPM_{i-1}$, . . . $BRPM_{i-p}$) is the maximum bit RPM observed in the time window; Average ($BRPM_i$, $BRPM_{i-1}$, . . . $BRPM_{i-p}$) is the average bit RPM observed in the time window; and $TSE_{BRPMi}$ is the calculated stick-slip TSE ratio for each torsional vibration cycle (i); further including: monitoring downhole stick-slip values at a drill bit for the second interval; determining whether the torsional vibration is being managed based on the monitored downhole stick-slip values; if the torsional vibration is being managed, continuing to operate with the drilling parameter threshold; and if the torsional vibration is not being managed, recalculating the drilling parameter threshold based on the second interval; further including: obtaining drilling data; obtaining torsional vibration data from downhole drilling measurements; calculating the Torque Swing Ratio for each torsional vibration cycle; and identifying the Torque Swing Ratio reference value based on statistical analysis of the Torque Swing Ratio values and the torsional vibration data from downhole measurements; wherein the WOB is a parameter measured downhole by drilling tools; and further including dividing the subsurface formation into at least the first interval and the second interval based on one or more of a depth interval determined by geological formation properties and a depth-based calculation for intervals in which the drilling parameters are relatively stationary.

DETAILED DESCRIPTION

Figure 1:
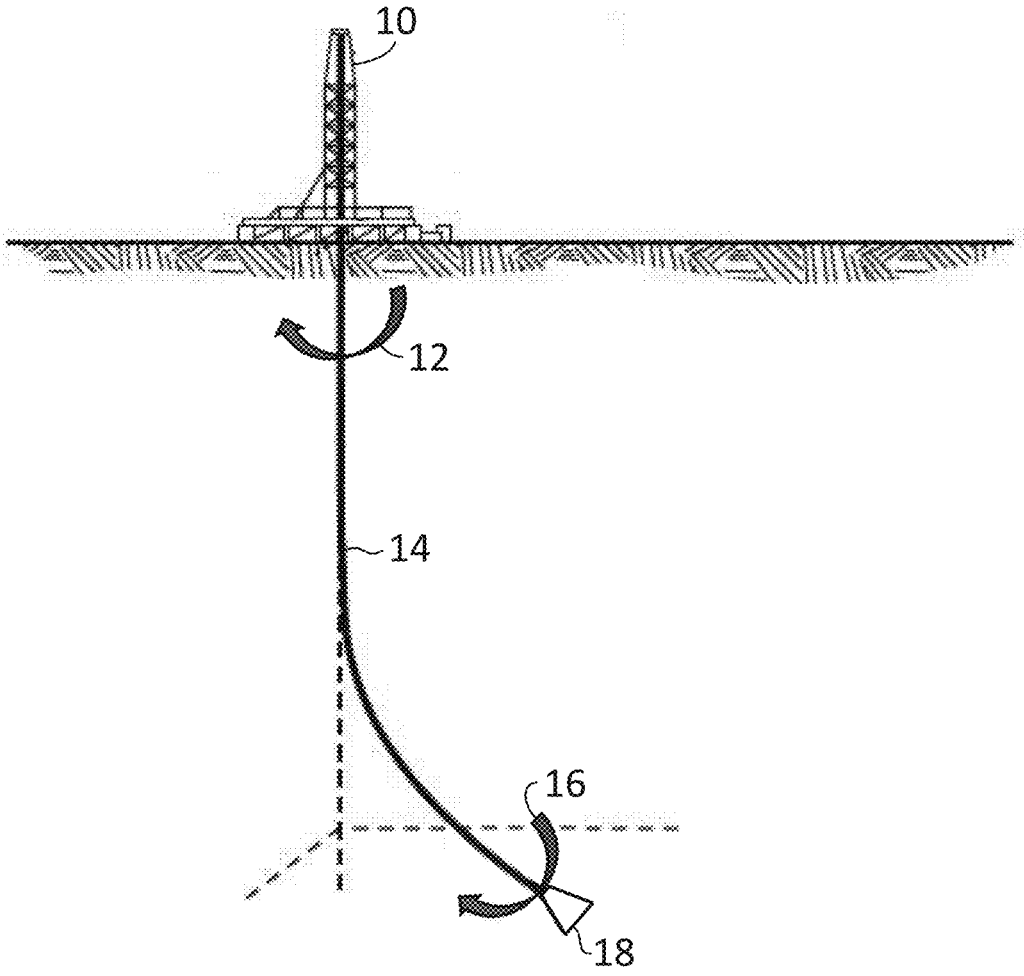
FIG. 1 illustrates a drilling rig at the surface with a drill string, showing torque applied at the surface and at the bit, with rotation of pipe and bit.

In the following Detailed Description, specific aspects and features of the claimed subject matter are described in connection with several exemplary methods and embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspect or feature may be found and/or implemented with other embodiments of the present invention where appropriate. Accordingly, the claimed invention is not limited to the specific embodiments described below, but rather, the invention includes all alternatives, modifications, and equivalents falling within the scope of the appended numbered paragraphs and claimed subject matter.

Definitions of some of the terms utilized herein are as follows:

The term "drill string assembly" (or "drill string" or "drilling assembly") refers to a collection of connected tubular components that are used in drilling operations to drill a hole through a subterranean formation. Exemplary components that may collectively or individually be considered a part of the drill string include rock cutting devices such as drill bits, mills and reamers; bottom hole assemblies; drill collars; drill pipe; cross overs; subs, stabilizers; roller reamers; MWD (Measurement-While-Drilling) tools; LWD (Logging-While-Drilling) tools; etc.

The term "subterranean formation" refers to a body or section of geologic strata, structure, formation, or other subsurface solids or collected material that is sufficiently distinctive and continuous with respect to other geologic strata or other characteristics that it can be mapped, for example, by seismic techniques. A formation can be a body of geologic strata of predominantly one type of rock or a combination of types of rock, or a fraction of strata having a substantially common set of characteristics. A formation can contain one or more hydrocarbon-bearing subterranean formations. Note that the terms formation, hydrocarbon-bearing subterranean formation, reservoir, and interval may be used interchangeably, but may generally be used to denote progressively smaller subsurface regions, zones, or volumes. More specifically, a geologic formation may generally be the largest subsurface region; a hydrocarbon reservoir or subterranean formation may generally be a region within the geologic formation and may generally be a hydrocarbon-bearing zone, a formation, reservoir, or interval having oil, gas, heavy oil, and any combination thereof. An interval or production interval may generally refer to a sub-region or portion of a reservoir. A hydrocarbon-bearing zone, or production formation, may be separated from other hydrocarbon-bearing zones by zones of lower permeability such as mudstones, shales, or shale-like (highly compacted) sands. In one or more embodiments, a hydrocarbon-bearing zone may include heavy oil in addition to sand, clay, or other porous solids.

The term "drilling operation" refers to the process of creating a subterranean wellbore passing through various subterranean formations for the purpose of subsurface mineral extraction. A drilling operation is conducted using a drilling rig, which raises and lowers a drill string composed of joints of tubular components of various sizes. A drill bit is located at the end of the drill string which is used to penetrate the subterranean formations by mechanisms of crushing and/or slicing the rock. The power required to advance the drill bit is provided by motors which rotate the drill pipe and lower the drilling assembly and mud pumps which allow the drilling fluid to be conveyed through the drilling assembly and back up the annulus. A drilling operation typically proceeds on a section by section basis with each section designated as a "hole section". A drilled well typically possesses a number of hole sections which may include a conductor hole section, a surface hole section, various intermediate hole sections and a production hole section. A drilled well will sometimes include one or more "side tracks" where a side track is a secondary wellbore drilled away from an original wellbore typically to bypass an unusable original wellbore section. An "offset well" refers to a well that is within some proximity of a well of interest, however herein there is no distinction between a section of an offset well and a previously drilled section of the same well as both provide historical drilling parameters that may be analyzed to determine a drilling parameter set for a future drilling interval.

The term "drilling parameters" refers to measurable physical or operational parameters of the drilling operations and/or the drilling equipment, as well as parameters that can be calculated therefrom and are useful information in monitoring, operating, or predicting aspects of drilling operations. Drilling parameters include, but are not limited to, TSR, TSE, $TSE_{TQ}$, $TSE_{BRPM}$, TQ, ΔTQ, $\Delta TQ_{SS}$, ΔTQS, $\Delta TQS_{ref}$, T, SRPM, BRPM, MD, WOB, DTOR, D, μ, and i all of which are further defined and described herein.

The term Torsional Severity Estimate or "TSE" refers to an estimate of the magnitude of angular (or rotational) vibrations of a drilling assembly near the drill bit or above the downhole mud motor (in the event that a mud motor is one of the components of the drilling assembly). By definition, a TSE value of zero is indicative of no rotational (angular) vibrations. A TSE value of 1 denotes a full stick-slip state of the drilling assembly, a harmonic condition of the drilling assembly characterized by the bit periodically coming to a stop instantaneously and then accelerating to an angular velocity that is twice the rotary speed applied at the surface. TSE values above 1 are associated with severe stick-slip conditions which may be associated with bit "stuck-time" or even backwards rotation of the bit. TSE may be estimated from measurements taken by downhole sensors or measurements taken from sensors instrumented on surface equipment used in conjunction with a mechanics model of the drilling assembly. It is important to note that TSE may be normalized in other equivalent ways, for example as a percentage of the full stick-slip condition.

The term "$TSE_{TQ}$" refers to a Torsional Severity Estimate (TSE) that has been obtained using data from sensors instrumented on surface equipment and a mechanics model of the drilling assembly. The mechanics model of the drilling assembly is a physics based mathematical model that provides a relationship between fluctuations in the downhole rotary speed of the drilling assembly and fluctuations in the surface torque. In at least one such model, the RPM of the drilling assembly that is obtained at the surface for the drilling operations (i.e., at or near the rotary drive system) is an input parameter.

The term "$TSE_{BRPM}$" refers to a Torsional Severity Estimate (TSE) that has been obtained from measurements taken by sensors located on downhole equipment. The sensors and downhole equipment may directly record downhole rotary speed and/or minimum and maximum downhole rotary speed. These quantities along with either the surface rotary speed or average rotary speed as measured by the downhole sensors may be used to evaluate $TSE_{BRPM}$ without the need for a mechanics model of the drilling assembly.

FIG. 1 illustrates a drilling rig (10) at the surface with a drill string (14), showing torque applied at the drilling rig or surface (10) and at the bit (18), with rotation at the surface of the drill string (12) and rotation at the bit (16). In an embodiment, a well or a portion of an existing well is drilled at the location of the well bore site, or an offset well is drilled in the vicinity of the proposed well bore site. Offset wells are often utilized to provide information of the subsurface geology and conditions for the planning and design of a well bore. Offset wells may be wells that are drilled specifically for the planning of a well bore design or may be existing operating, or prior operating wells in the vicinity of the proposed well bore site from which the subsurface geology and conditions for proposed well bore site can be obtained. Similarly, data may be used as obtained from prior drilling of the proposed well bore site or previously obtained from existing offset well(s).

Drilling RPM speeds, bit weight, bit type, torque data, and drill string configuration may be obtained from the drilling of the offset wells. These offset wells may provide valuable data if similar in design and configuration to a proposed new drill well. In particular, the data may be analyzed to understand the stick-slip vibrations and quantitatively evaluate means to mitigate these vibrations as disclosed herein.

In the present method, the following information may be taken at various times (and optionally depths) during the offset well drilling operation. Some of the terms as utilized herein are:

TSE=Torsional Severity Estimate.

$TSE_{TQ}$=Torsional Severity Estimate based on torque swing data or modeling.

$TSE_{BRPM}$=Torsional Severity Estimate based on drill bit RPM (BRPM) data or modeling.

TQ=the measured drill string surface torque.

ΔTQ=the surface torque-swing over one periodic torsional vibration cycle.

$\Delta TQ_{SS}$=the theoretical surface torque-swing at full stick-slip, which is a function of RPM.

ΔTQS=the specific surface torque-swing per RPM (ΔTQ/SRPM).

$\Delta TQS_{ref}$=the theoretical specific surface torque-swing at full stick-slip per RPM for a drill string at a measured bit depth. This value may also be determined empirically.

τ=the normalized specific torque swing per rpm, ΔTQS, where the normalization adjusts for different RPM and WOB values used in an interval to a common or average set of parameters. May also be referred to as "TAU".

$\tau_{crit}$=the critical value of torque swing demand, τ, observed during the first interval for which the stick-slip dysfunction is to be mitigated.

TSR=the Torque Swing Ratio is defined herein to refer to either or both of the specific torque swing per RPM (ΔTQS) and the normalized specific torque swing per RPM (τ), depending on the context, which may also be a combination of the specific torque swing per RPM (ΔTQS) and the normalized specific torque swing per RPM (τ).

SSDF=the "Stick-Slip Design Factor" indicates the amount of desired compression (or expansion) of the distribution of specific torque swing, determined as the ratio of $\Delta TQS_{ref}$ to $\tau_{crit}$ for a first depth interval. When expressed in relation to RPM and WOB values, SSDF is equal to the product of (RPM average for interval 1 divided by design value for interval 2) and (WOB design value for interval 2 divided by average for interval 1).

T=the theoretical stick-slip period for a drill string at a measured bit depth.

RPM=rotary speed, generically, the rate of rotation of pipe about its axis.

SRPM="Surface RPM"—the rotary speed of the drill string as measured at the surface in revolutions per minute.

BRPM="Bit RPM"—the rotary speed of the drill bit as measured at the drill bit in revolutions per minute.

MD=the measured bit depth.

WOB="Weight on Bit"—the applied load along the axis of the bit.

DTOR="Downhole Torque"—the applied torque, which may include components of bit torque, downhole motor torque, and/or pipe friction from rubbing against the borehole wall, as appropriate.

Diameter of the wellbore being drilled.

μ="Bit Friction Factor"—dimensionless friction factor for the bit (defined as "bit torque/3*WOB*D").

A non-dimensional stick-slip estimate (or Torsional Severity Estimate—TSE) may be determined from the surface torque swing data, the reference specific torque swing value, and surface RPM as follows in equation Eq. 1:

$$TSE_{TQi} = \frac{\text{Torque Swing } \Delta TQ_i}{\Delta TQS_{ref} \cdot \text{Average}(SRPM_i)} \quad \text{(Eq. 1)}$$

where i is a sampling index associated with time-based data measurements and calculated quantities which depend on time-based data measurements. The quantities "Torque Swing $\Delta TQ_i$" and "Average($SRPM_i$)" represent estimates of the surface torque swing (i.e., maximum surface torque minus surface minimum torque) and the average Surface RPM (SRPM) over a time window $\Delta t_i = t_i - t_{i-P}$ (for some integer P>1), where $t_i$ is the time associated with sample index i and the window extends backward in time by P samples. The time window is taken to be some value greater than or equal to the theoretical stick-slip period T of the drilling assembly and is a function of the measured bit depth MD. Note that a stick-slip cycle is equivalent to a torsional vibration cycle in common usage, and even though the bit may not be considered to be in full stick-slip the terms are for practical purposes considered to be equivalent. "Torque Swing$_i$" or $\Delta TQ_i$ may be evaluated in a number of different ways including the equation Eq. 2:

$$\Delta TQ_i = \max(TQ_i, TQ_{i-1}, \ldots, TQ_{i-P}) - \min(TQ_i, TQ_{i-1}, \ldots, TQ_{i-P}) \quad \text{(Eq. 2)}$$

In an alternative embodiment, the specific torque swing ($\Delta TQS_i$) may also be calculated, which is in the following equation Eq. 2a:

$$\Delta TQS_i = \Delta TQ_i / RPM_i \quad \text{(Eq. 2a)}$$

$$TSE_{TQi} = \frac{\Delta TQS_i}{\Delta TQS_{ref}} \quad \text{(Eq. 2b)}$$

where equations Eq. 2, Eq. 2a and Eq. 2b may be referred to collectively as Eq. 2. Note that Eq. 1 for TSE may be rewritten using the specific torque swing as provided in equation Eq. 2b. Furthermore, the index i may refer to a time index or a torsional vibration cycle. In either case, the terms are elements in a sequence of values derived from drilling parameters.

Other methods for evaluating "Torque Swing $\Delta TQ_i$" are also possible. For example there are methods reported in the literature for evaluating "Torque Swing $\Delta TQ_i$" in a manner that removes trends in the mean value of the surface torque signal to handle cases where the mean value is increasing or decreasing (see, e.g., U.S. Pat. No. 8,977,523). The term "Average($SRPM_i$)" may also be evaluated in a number of different ways including:

$$\text{Average}(SRPM_i) = \text{median}(SRPM_i, SPRM_{i-1}, \ldots, SRPM_{i-P}) \quad \text{(Eq. 3)}$$

$$\text{Average}(SRPM_i) = \text{avg}(SRPM_i, SRPM_{i-1}, \ldots, SRPM_{i-P}) \quad \text{(Eq. 4)}$$

$$\text{Average}(SRPM_i) = SRPM_j \quad \text{(Eq. 5)}$$

where $i-P=\leq j \leq i$. In this disclosure, references to Average (SRPM) may refer to any of the above forms for an interval average (e.g., Eq. 3, Eq. 4, or Eq. 5). The above formulas constitute windowed calculations involving the measured surface torque TQ and Surface RPM (SRPM). Other methods for evaluating "Torque Swing$_i$" and "Average ($SRPM_i$)" are also possible and are known to one skilled in the art and are described in more detail in U.S. Pat. No. 8,977,523 which is incorporated herein by reference.

The quantity $\Delta TQS_{ref}$ is the theoretical specific surface torque swing (e.g., maximum surface torque minus minimum surface torque over a torsional vibration cycle) at full stick-slip per Surface RPM. The period T and $\Delta TQS_{ref}$ are quantities that may be evaluated by a drilling mechanics model and depend on drill string component geometry, drilling fluid rheology and measured bit depth (MD). One drilling mechanics model to determine $\Delta TQS_{ref}$ is described in detail in U.S. Pat. No. 8,977,523 which is incorporated herein by reference. Another related reference is SPE Paper 163420, published as a Drilling & Completions journal article: Ertas, D., Bailey, J. R., Wang, L., & Pastusek, P. E. (2014, Dec. 1). *Drillstring Mechanics Model for Surveillance, Root Cause Analysis, and Mitigation of Torsional Vibrations. Society of Petroleum Engineers. doi:* 10.2118/163420-PA.

Although the model disclosed above is an exemplary dynamic drill string model, comprising a frequency-domain wave equation solution to the equations of motion, there are other models that could fall within the scope of a dynamic model for these purposes. For example, the use of a simple single-element spring model might be adequate, or alternatively, a model that includes spring, mass, and/or damping elements. Time domain modeling might also be used to calculate the torque swing at full stick-slip, yielding values for $\Delta TQS_{ref}$ when normalized by SRPM.

Alternatively, $\Delta TQS_{ref}$ may be estimated if both surface and downhole data are available for the offset well. An analysis of the TSE data from the downhole data and the calculated specific surface torque swing data may be used to estimate the reference value $\Delta TQS_{ref}$ at the full stick-slip condition. Furthermore, this estimate may be performed at multiple bit depths to approximate $\Delta TQS_{ref}$ as the drill string assembly length changes.

The quantity TSE is an estimate of the excitation of the primary torsional mode of the drilling assembly and provides a measure of torsional dysfunction for a drilling operation. This parameter is normalized such that a value of 0 indicates no torsional vibrations and a value of 1 denotes full stick-slip (a condition characterized by the drill bit periodically coming to an instantaneous stop). For severe stick-slip it is possible for TSE to become much greater than a value of 1. TSE can be used to further estimate the minimum and maximum bit RPM (BRPM) as follows:

$$BRPM_i^{min} = \max[(1-TSE_i) \cdot \text{Average}(SRPM_i), 0] \quad \text{(Eq. 6)}$$

$$BRPM_i^{max} = (1+TSE_i) \cdot \text{Average}(SRPM_i) \quad \text{(Eq. 7)}$$

In equation Eq. 6 it is assumed that the drill bit does not rotate backwards; however, this assumption can be relaxed. Field data obtained from sensors instrumented on surface equipment of a drilling assembly for an offset well may be processed to determine torsional dysfunction. Torsional dysfunction may be characterized using TSE and/or the calculated "actual surface torque-swing" $\Delta TQ$, where actual surface torque swing may be defined as:

$$\Delta TQ_i = \max(TQ_i, TQ_{i-1}, \ldots, TQ_{i-P}) - \min(TQ_i, TQ_{i-1}, \ldots, TQ_{i-P}) \quad \text{(Eq. 8)}$$

The "theoretical surface torque-swing at full stick-slip" $\Delta TQ_{ss}$ is defined as follows for an interval of length P with rotary speed SRPM:

$$\Delta TQ_{SSi} = \Delta TQS_{ref} \cdot \text{Average}(SRPM_i, SRPM_{i-1}, \ldots, SRPM_{i-P}) \quad \text{(Eq. 9)}$$

This quantity estimates the theoretical torque-swing at the surface when the drill bit is experiencing a state of full stick-slip. In other words (under the assumptions of the drilling mechanics modeling techniques referenced in the Background section) the value of $\Delta TQ_{SS}$ should equal the value for $\Delta TQ$ whenever the drilling assembly is in a state of full stick-slip at surface rotary speed SRPM. When the surface RPM is relatively constant and $\Delta TQ_{ref}$ may be a weakly-varying function of measured depth MD, the value for the theoretical surface torque-swing at full stick-slip $\Delta TQ_{SS}$ is essentially constant. As discussed above, a $TSE_{TQ}$ value of 1 denotes that the drill string is at "full stick-slip" (a condition characterized by the drill bit periodically coming to an instantaneous stop). For $TSE_{TQ}$ values above 1, the drill string is in "severe stick-slip". Extended operations (or high percentage of operating time) of $TSE_{TQ}$ values above 1 may result in reduced bit and drill string life, mechanical damage, or mechanical failure. Therefore, it may be beneficial to the art if one could make a calculated estimate of the changes in the $TSE_{TQ}$ that a modified drill string may experience based on data from an existing well, and furthermore, enhancements to identify and apply preferred drilling parameters with the current drilling system may beneficially lead to enhanced drilling performance.

Drill bit RPM (BRPM) data may be available as a time series in an offset well drilling operation using an initial drill string. These BRPM measurements are typically obtained from down-hole instrumentation located in the drill string, preferably at or near the drill bit and received and recorded using data transmission devices and methods known in the art. Alternatively, this data may be recorded in "memory mode" for later retrieval at the surface. The TSE distribution obtained from the BRPM data using the initial drill string can be calculated using equation Eq. 10. We herein denote the calculation method for determining the TSE in this embodiment as $TSE_{BRPM}$ (Torsional Severity Estimate based on BRPM data or modeling) to differentiate from the method above for determining $TSE_{TQ}$ (Torsional Severity Estimate based on torque swing and rotary speed data and a physical model). The average BRPM must equal the average SRPM over suitably long time intervals for there to be no net angular distortion of the drill string.

$$TSE_{BRPMi} = \frac{\max(BRPM_i, BRPM_{i-1}, \ldots, BRPM_{i-p}) - \text{Average}(BRPM_i, BRPM_{i-1}, \ldots, BRPM_{i-p})}{\text{Average}(BRPM_i, BRPM_{i-1}, \ldots, BRPM_{i-p})} \quad \text{(Eq. 10)}$$

where i is a sampling index associated with time-based RPM data measurements. The above formula amounts to performing windowed calculations involving the measured RPM, where the time window $\Delta t_i = t_i - t_{i-P}$ (for some integer P>1) is taken to be some value greater than the theoretical stick-slip period T of the drilling assembly. In some instances, a calculation similar to this may be performed by downhole electronics and the resulting $TSE_{BRPM}$ value calculated directly by the vendor, perhaps without even storing the bit RPM data.

Using the $TSE_{BRPM}$ distribution from the Well 1 data, the $\Delta TQS_{ref,init}$ of the initial drill string, and the $\Delta TQS_{ref,mod}$ of a proposed (i.e. "modified") drill string, a new $TSE_{BPM}$ distribution can be estimated for the modified drill string using equation Eq. 11.

$$TSE_{BRPM\ mod\ i} = TSE_{BRPM\ init\ i} \cdot \frac{\Delta TQS_{ref,init}}{\Delta TQS_{ref,mod}} \quad \text{(Eq. 11A)}$$

where $TSE_{BRPM\ init\ i}$=Torsional Severity Estimate based on BRPM of the initial drill string for sampling index i.

$TSE_{BRPM\ mod\ i}$=Torsional Severity Estimate based on BRPM of the modified drill string for sampling index i.

$\Delta TQS_{ref,\ init}$=the theoretical surface torque-swing at full stick-slip per BRPM for the initial drill string at a measured bit depth.

$\Delta TQS_{ref,\ mod}$=the theoretical surface torque-swing at full stick-slip per BRPM for a modified drill string at a measured bit depth.

Although equation Eq. 11A is specific to the case where TSE is evaluated based on downhole RPM data ($TSE_{BRPM}$), a similar equation may also be constructed based on the surface torque data ($TSE_{TQ}$) as shown in equation Eq. 11B.

$$TSE_{TQ\ mod\ i} = TSE_{TQ\ init\ i} \cdot \frac{\Delta TQS_{ref,init}}{\Delta TQS_{ref,mod}} \quad \text{(Eq. 11B)}$$

where $TSE_{TQ\ init\ i}$=Torsional Severity Estimate based on torque swing of the initial drill string for sampling index i.

$TSE_{TQ\ mod\ i}$=Torsional Severity Estimate based on torque swing of the modified drill string for sampling index i.

ΔTQ Sref, init=the theoretical surface torque-swing at full stick-slip per BRPM or SRPM for the initial drill string at a measured bit depth.

$\Delta TQS_{ref,\ mod}$=the theoretical surface torque-swing at full stick-slip per BRPM or SRPM for a modified drill string at a measured bit depth.

In addition to designing or selecting alternate drill string designs based on TSE data from an initial drill string, the methods herein can also be utilized to select and modify additional drilling parameters based on the TSE and/or the Torque Swing information obtained from the initial drill string operation.

These additional drilling parameters may include modifying the SRPM of the drill string, the bit coefficient of friction (μ), the Weight-On-Bit (WOB), the wellbore diameter (D) and/or other sources of downhole torque. The relationships are shown here and it is clear to one of skill in the art that these can be used individually or in any combination to modify the operational parameters for either the initial drill string or a modified drill string using the following equations. If the revised drilling parameters are to be selected for a modified drill string design, then the TSE for the initial drill string and the modified drill string can be calculated by the various methods previously described herein and inserted into the formulas to determine one or more desired drilling parameters. A revised set of drilling parameters may be selected for the initial drill string design, with no modifications to the drill string design, then the information obtained from drilling a well with the initial drill string may be used to determine one or more modified drilling parameters for subsequent use of the initial drill string.

From equation Eq. 1, the following equation Eq. 12 can be developed.

$$TSE_{mod} = TSE_{init} \cdot \frac{\Delta TQS_{ref\ init}}{\Delta TQS_{ref\ mod}} \cdot \frac{SRPM_{init}}{SRPM_{mod}} \cdot \frac{\mu_{mod} \cdot WOB_{mod} \cdot D_{mod}}{\mu_{init} \cdot WOB_{init} \cdot D_{init}} \quad \text{(Eq. 12)}$$

There are some downhole drilling tools that measure torque very near the bit. When using downhole torque data, there may not be a need to reference the "μ*WOB*D" term used above. In deviated and horizontal wells, there are additional sources of downhole torque such as friction between the pipe and borehole wall and the use of downhole motors. These values may be measured, modeled, or a combination of measured and modeled values. Those skilled in the art have knowledge of torque and drag friction models and their application to extended-reach wells. Wherein the term DTOR may include components of bit torque, motor torque, and/or pipe friction sources of downhole torque, this equation becomes:

$$TSE_{mod} = TSE_{init} \cdot \frac{\Delta TQS_{ref\ init}}{\Delta TQS_{ref\ mod}} \cdot \frac{SRPM_{init}}{SRPM_{mod}} \cdot \frac{DTOR_{mod}}{DTOR_{init}} \quad \text{(Eq. 13)}$$

Having the drilling data for the initial drill string (designated with "init" subscript), this relationship can be used to project a TSEmod by modifying any combination or all of the variables (i.e., $\Delta TQS_{ref\ mod}$, $SRPM_{mod}$, $\mu_{mod}$, $WOB_{mod}$, $D_{mod}$, and/or $DTOR_{mod}$). Similarly, this equation may be used by substituting the downhole data where applicable in equations Eq. 10 and Eq. 11 herein. Additionally, if no change in the drill string configuration is made, the $\Delta TQS_{ref}$, and the "modified" values can be used to predict changes required in rotary speed and downhole torque sources utilizing the same drill string.

In one of these embodiments, an optimized modified SRPM can be determined for either the initial drill string or a modified drill string. Equation Eq. 9 for the initial drill string can be utilized as follows (designated with the subscript "init"):

$$\Delta TQ_{ss\ init} = \Delta TQS_{retinit} \cdot \text{Average}(SRPM_{init}) \quad \text{(Eq. 14)}$$

Dividing equation Eq. 14 with the $\Delta TQ_{SS\ mod}$ equation for the modified drill string, this formula becomes:

$$\Delta TQ_{SS\ mod} = \Delta TQ_{SS\ init} \cdot \frac{\Delta TQS_{ref,mod} \cdot \text{Average}(SRPM_{mod})}{\Delta TQS_{ref,init} \cdot \text{Average}(SRPM_{init})} \quad \text{(Eq. 15)}$$

From this equation, it is clear that one can calculate a revised SPRM operating parameter Average ($SRPM_{mod}$) based on the drilling information from the initial drill string, the $\Delta TQS_{ref}$ of the initial and modified drill strings, and a desired $\Delta TQ_{SS}$ of the modified drill string. It should be noted that this equation is further simplified to allow for the calculation of a revised SPRM drilling parameter of the initial drill string based on the drilling information from the initial drill string, and a desired $\Delta TQ_{SS}$ of the initial drill string under modified SRPM conditions. Here, since the $\Delta TQS_{ref}$ values in equation Eq. 1 are both for the initial drill string, this value drops out of both the numerator and denominator to simplify as follows (where subscript "init 1" refers to the initial drill string parameters, as measured or based on actual drilling measurements and subscript "init 2" refers to the initial drill string with proposed modified drilling parameters):

$$\Delta TQ_{SS\ init\ 2} = \Delta TQ_{SS\ init\ 1} \cdot \frac{\text{Average}(SRPM_{init\ 2})}{\text{Average}(SRPM_{init\ 1})} \quad \text{(Eq. 16)}$$

From this equation, it is clear that one can calculate a revised SPRM operating parameter Average ($SRPM_{init\ 2}$) for the initial drill string based on a desired value for $\Delta TQ_{SS}$ for the revised drilling operations. One may also use the "Average (BRPM)" in place of the "Average (SRPM)" data in equation Eq. 16 if so desired.

Additionally, the change in the bit torque is a linear function of the product of the drill bit coefficient of friction ($\mu$), the Weight-On-Bit (WOB) and the wellbore diameter (D). As such for a given drill string, equation Eq. 1 at constant SRPM becomes:

$$TSE_{TQi} = \frac{\text{Torque Swing } \Delta TQ_i}{\Delta TQS_{ref} \cdot \text{Average}(SRPM_i)} \quad \text{(Eq. 17)}$$

$$TSE_{TQ\ init\ 2} = TSE_{TQ\ init\ 1} \cdot \frac{\mu_{init\ 2} \cdot WOB_{init\ 2} \cdot D_{init\ 2}}{\mu_{init\ 1} \cdot WOB_{init\ 1} \cdot D_{init\ 1}} \quad \text{(Eq. 18)}$$

From these equations Eq. 17 and Eq. 18, it is clear that one can calculate a revised drill bit coefficient of friction operating parameter ($\mu_{init2}$), a revised Weight-On-Bit ($WOB_{init2}$), and/or a revised wellbore diameter ($D_{init2}$) for the initial drill string based on a desired value for $TSE_{TQ}$ for the revised drilling operations. More torque at the bit increases $TSE_{TQ}$, and less torque reduces $TSE_{TQ}$.

Example

Figure 2A:
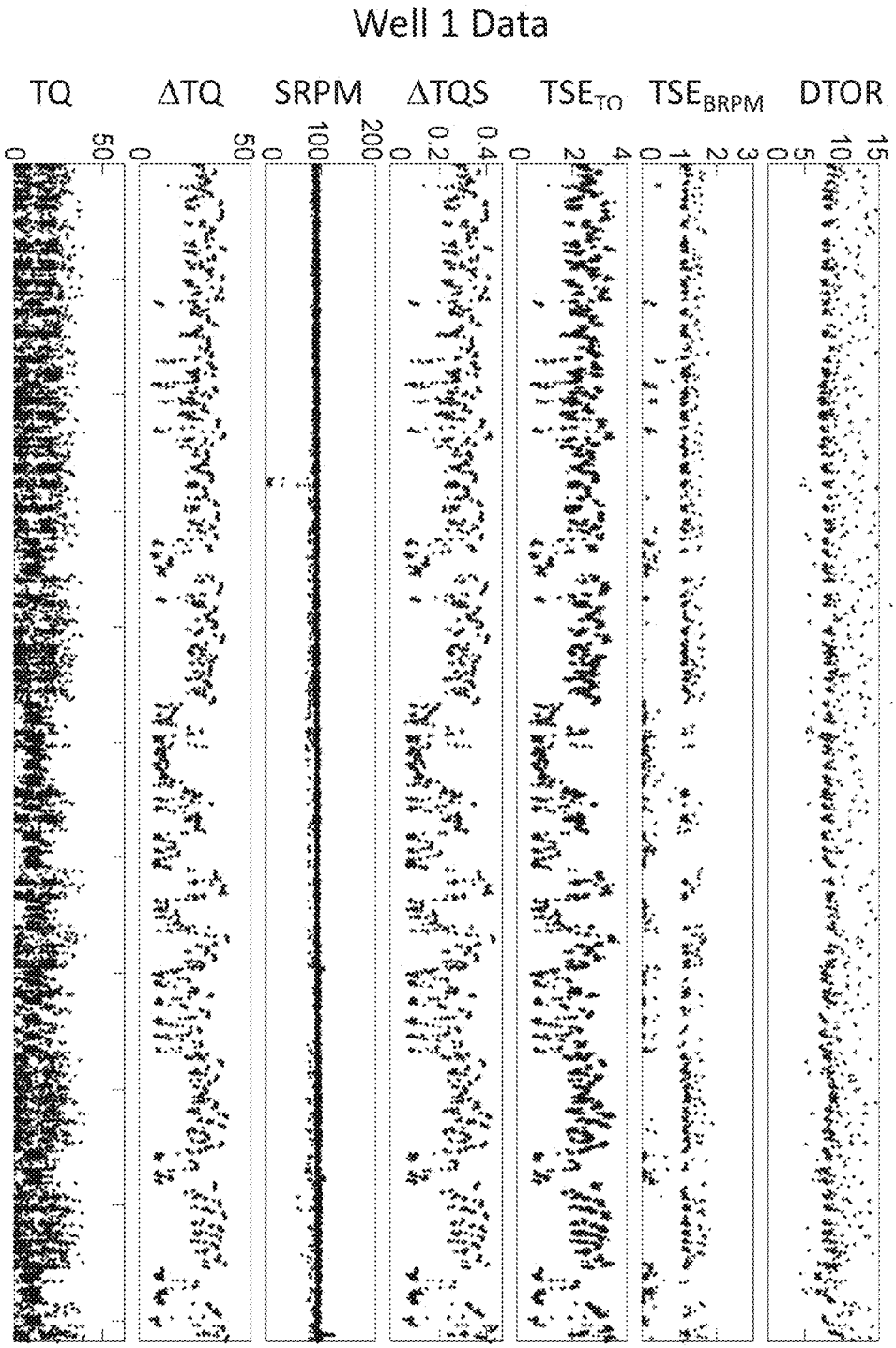
FIG. 2A provides recorded drilling data and calculated values as described herein for a drilling interval in Well 1.
Figure 2B:
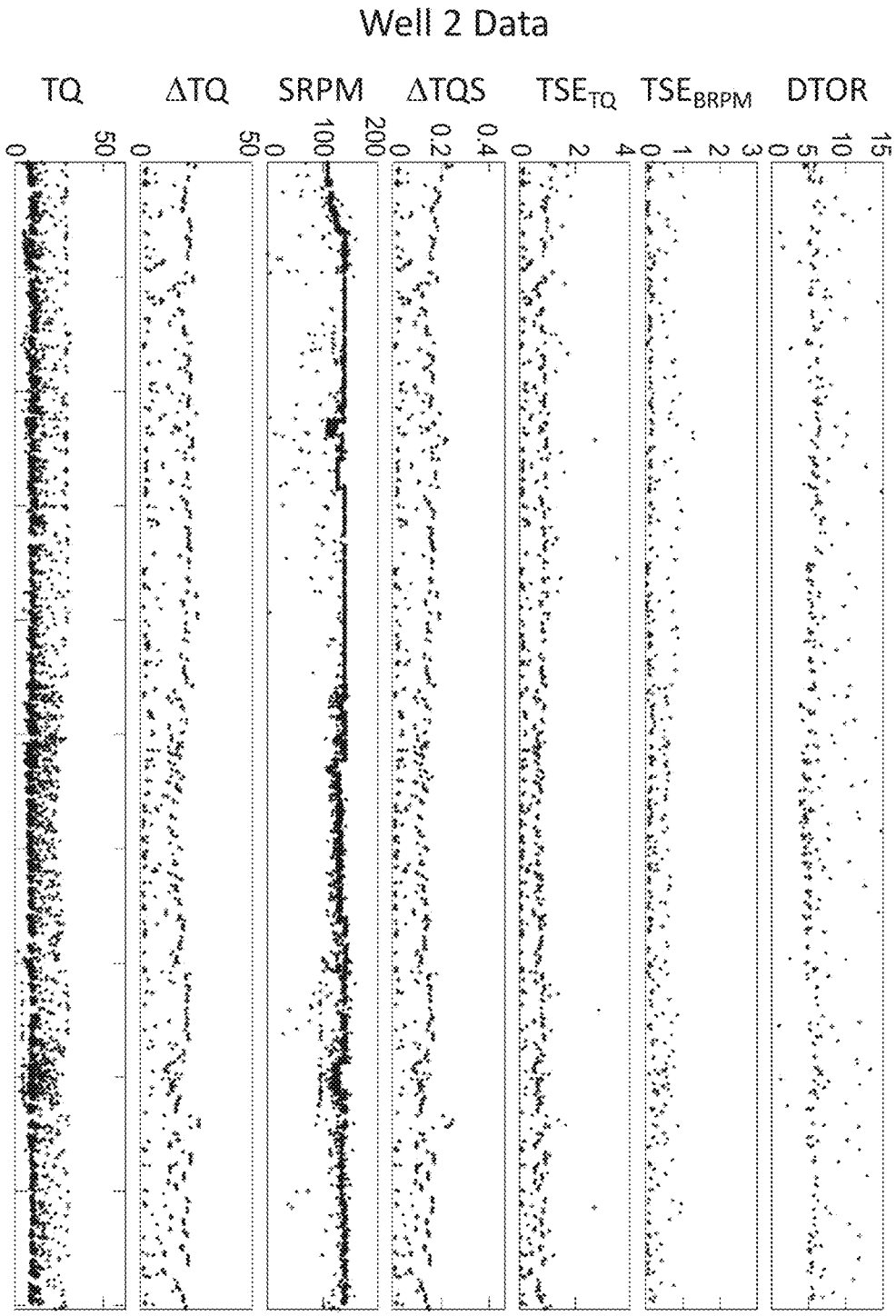
FIG. 2B provides recorded drilling data and calculated values as described herein for a drilling interval in Well 2.

The methodologies described herein may be illustrated using data from two wells. FIGS. 2A and 2B provide raw drilling data and calculated values related to torsional vibrations seen in two drill wells, henceforth referred to as Well 1 and Well 2. The parameter nomenclature for the data as shown in FIGS. 2A and 2B is the same as for the drilling parameters with similar designations as described herein. The torsional vibrations were severe in Well 1 and significantly mitigated in Well 2, as seen in subsequent charts and discussed further herein.

Figure 3:
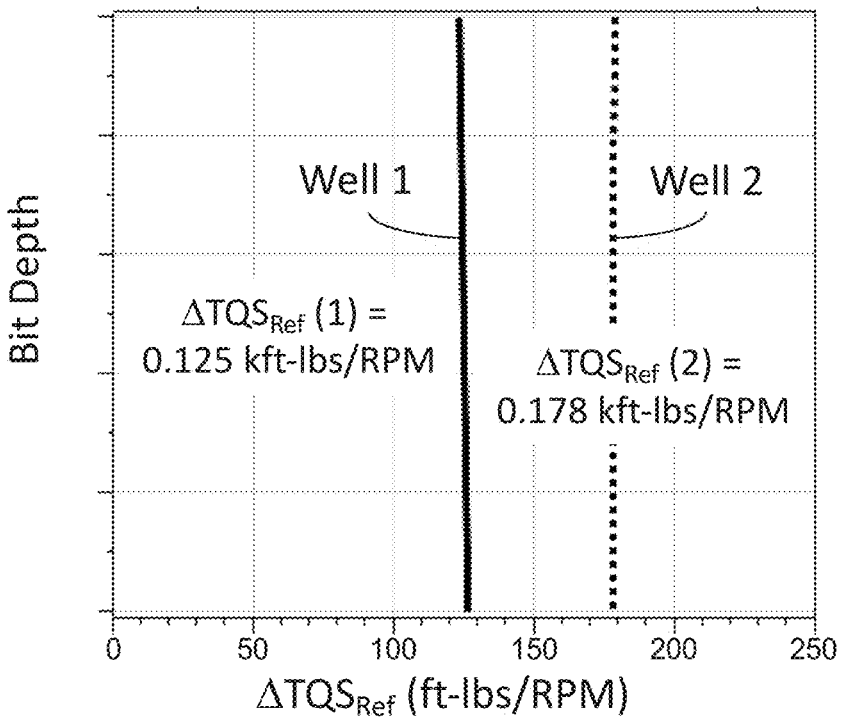
FIG. 3 provides calculated model results for the $\Delta TQS_{ref}$ values for the drill strings for Wells 1 and 2 in the Examples section.

The drill strings for the data provided in FIGS. 2A and 2B are shown in Tables 1A and 1B. From this data, the referenced drilling mechanics model, disclosed in U.S. Pat. No. 8,977,523 and further discussed in SPE 163420 as described above, may be applied to these two drill strings. FIG. 3 illustrates the results of this drill string dynamic model for the two drill strings. The $\Delta TQS_{ref}$ values are 0.125 kft-lbs/RPM for Well 1 and 0.178 kft-lbs/RPM for Well 2, representing a 42% increase in effective drill string torsional stiffness in Well 2.

TABLE 1A

Drill String 1 Design Information

| Item/Component | OD (inches) | ID (inches) | Length (feet) |
|---|---|---|---|
| 6-5/8 DP | 6.625 | 5 | 6000 |
| 5-7/8 DP | 5.875 | 5.05 | 5553 |
| 5-7/8 HWDP | 5.875 | 3.875 | 552 |
| 6-5/8 HWDP | 6.625 | 4.5 | 125 |
| Collars | 8.25 | 3.0 | 68 |
| Collars | 9.5 | 3.0 | 375 |

TABLE 1B

Drill String 2 Design Information

| Item/Component | OD (inches) | ID (inches) | Length (feet) |
|---|---|---|---|
| 6-5/8 DP | 6.625 | 5.375 | 11500 |
| 6-5/8 HWDP | 6.625 | 4.5 | 627 |
| Collars | 8.25 | 3.0 | 68 |
| Collars | 9.0 | 3.0 | 175 |

Figure 4A:
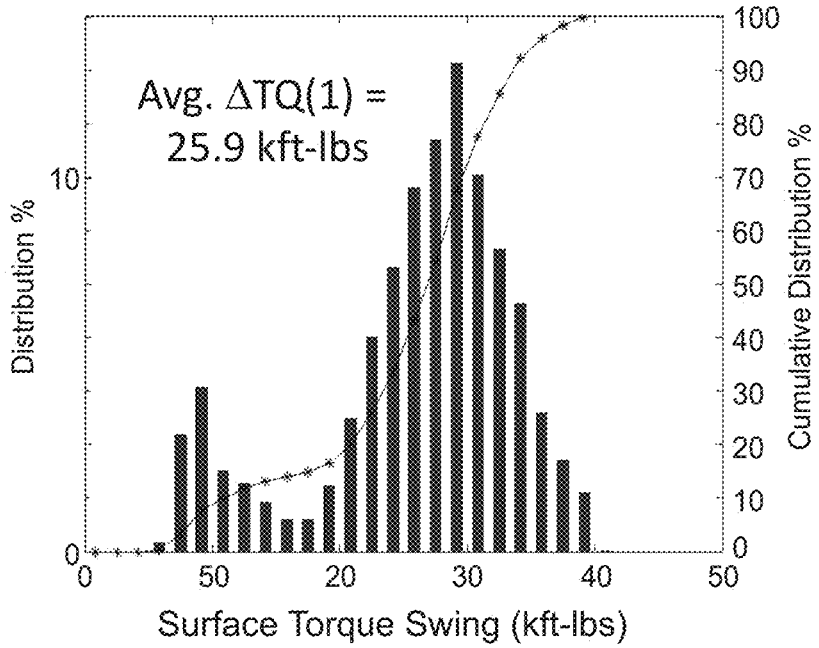
FIG. 4A illustrates the surface torque swing distribution for Well 1.
Figure 6A:
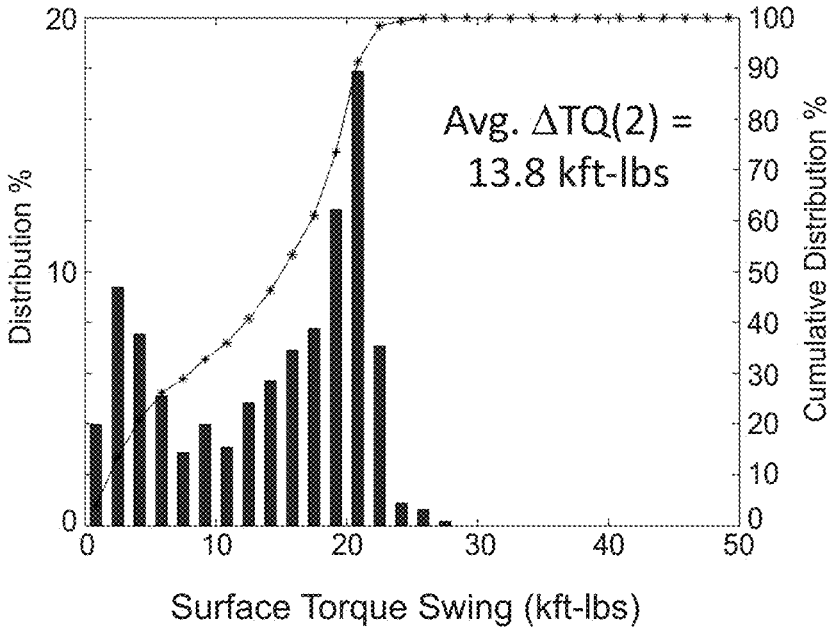
FIG. 6A illustrates the surface torque swing data for Well 2.

Where:
DP=Drill pipe
HWDP=Heavy-weight drill pipe
OD=Outer diameter
ID=Inner diameter FIGS. 4A and 6A show distributions (i.e., bar graphs) of the surface torque-swing using data for the two wells from FIGS. 2A and 2B, respectively. In the distribution charts, the cumulative distributions are also shown as curves with asterisks. For example, in FIG. 4A, it can be seen from the data that the probability (or "P-value") of torque swing in Well 1 exceeding 30 kft-lbs is about 0.3, and the P-value of exceeding 40 kft-lbs is practically zero.

Figure 4B:
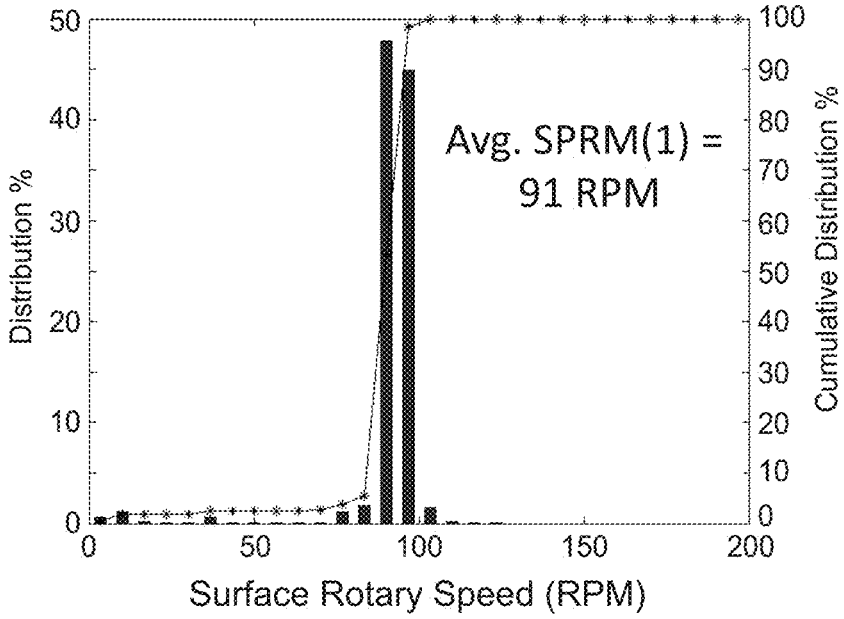
FIG. 4B shows the surface rotary speed (RPM) distribution for Well 1.
Figure 4C:
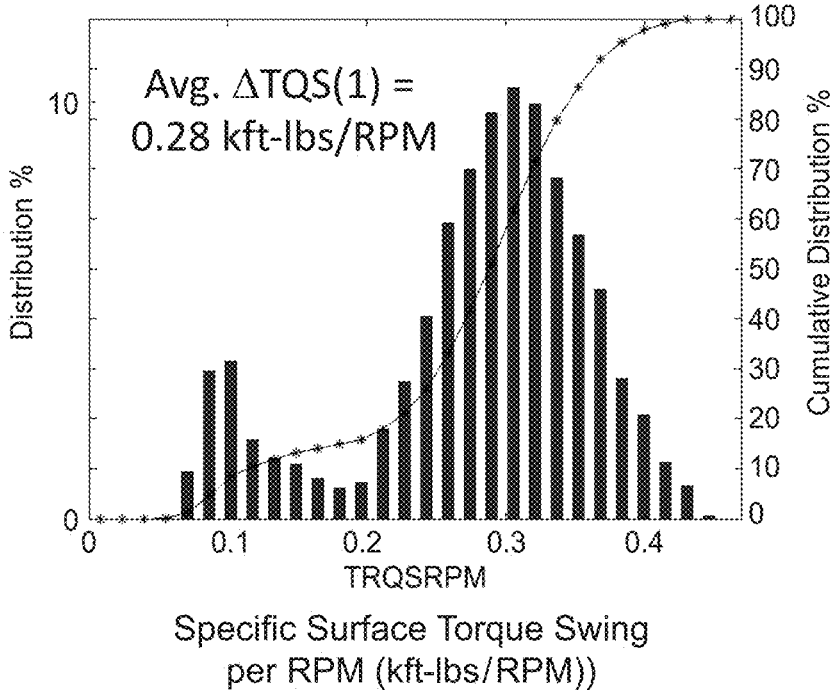
FIG. 4C shows the specific surface torque swing per RPM distribution for Well 1.
Figure 6B:
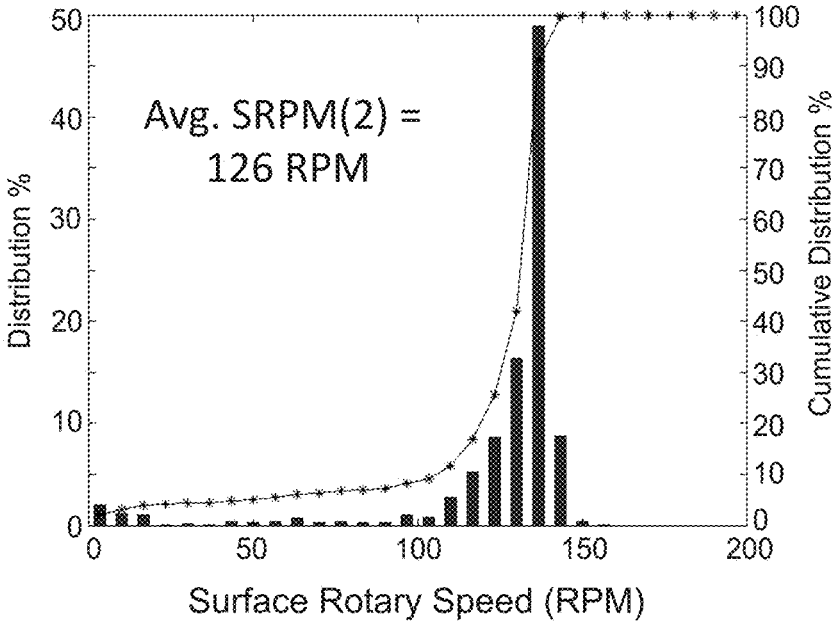
FIG. 6B shows the surface rotary speed distribution for Well 2.
Figure 6C:
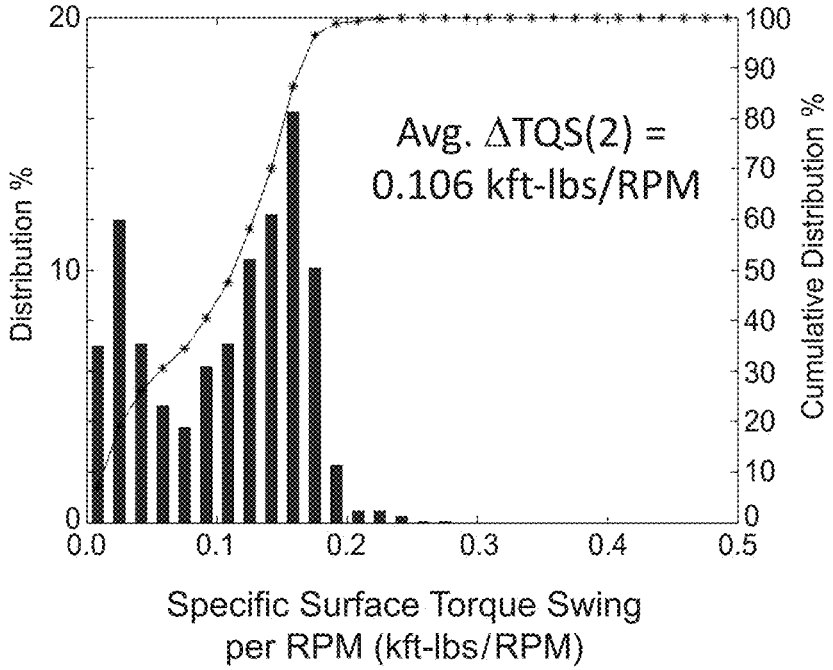
FIG. 6C shows the specific surface torque swing per RPM distribution for Well 2.

FIGS. 4B and 6B illustrate the distribution of surface rotary speed for the drilling operations in each well. The specific torque swing per RPM may be calculated on a point by point basis by dividing the recorded torque swing $\Delta TQ_i$ over a torsional vibration cycle by the average SRPM over the interval, providing the data tracks of the specific surface torque swing, ΔTQS, in FIGS. 2A and 2B. The distributions of this ΔTQS data may be the displayed as seen in FIGS. 4C and 6C.

Figure 4D:
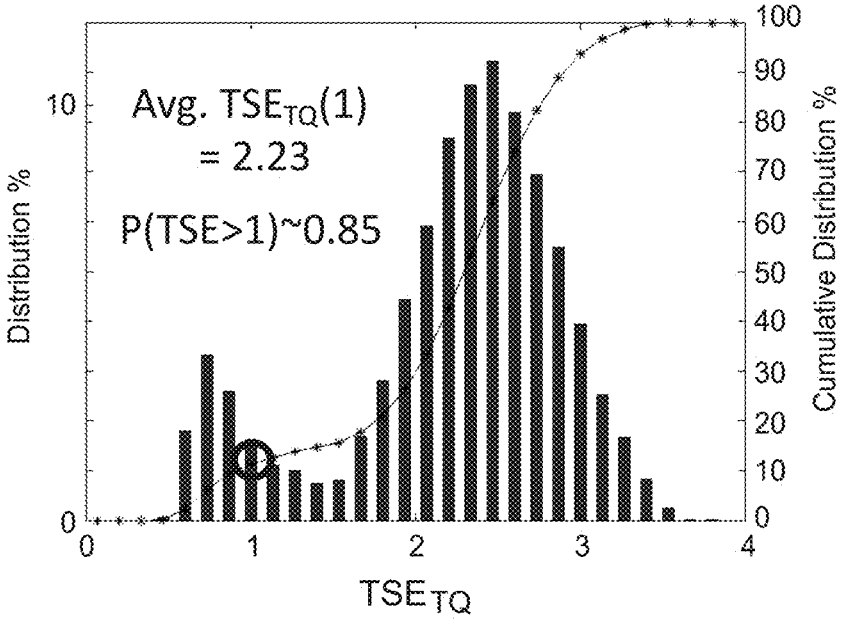
FIG. 4D provides the $TSE_{TQ}$ distribution for Well 1, using the data from FIG. 4C for specific torque swing per RPM and the $\Delta TQS_{ref,1}$ value for Well 1 from FIG. 3.
Figure 6D:
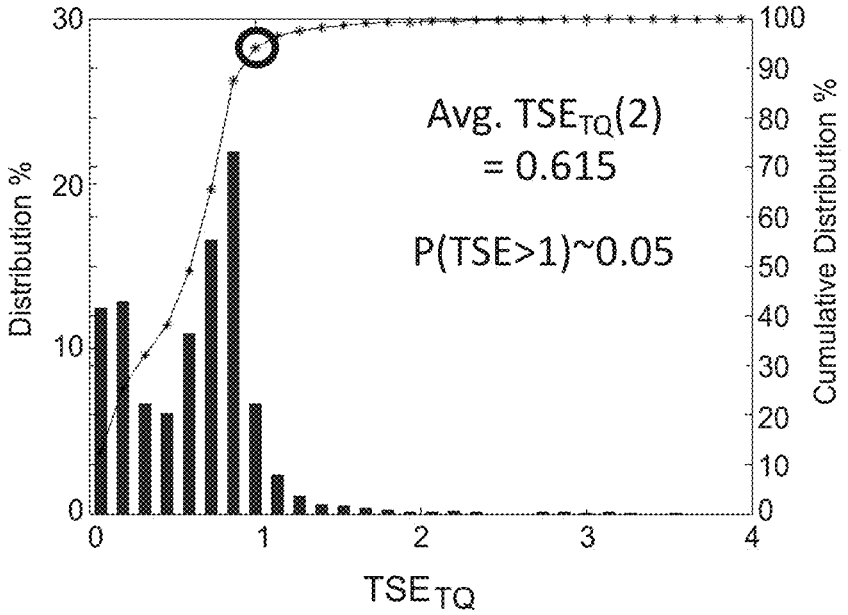
FIG. 6D provides the $TSE_{TQ}$ distribution for Well 2, using the data from FIG. 6C and the $\Delta TQS_{ref,2}$ value for Well 2 from FIG. 3.

Equation Eq. 1 is then used to calculate $TSE_{TQ}$ for each well, again for each data sample and torsional vibration cycle that is recorded. It is beneficial to have surface data recorded at no less than 1 second sampling intervals. The respective $TSE_{TQ}$ distributions for Well 1 and Well 2 are shown in FIGS. 4D and 6D, respectively. The cumulative $TSE_{TQ}$ distributions in the two wells are remarkably different. In FIG. 4D, the P-value of TSE>1 is about 0.85, whereas in FIG. 6D the P-value is 0.05. This is indicative of much greater stick-slip severity in Well 1.

Regarding Well 1 (and associated Drill String 1), during operation, the torque swing at the surface and the surface rotary speed were recorded. The torque swing at the surface distribution is shown in FIG. 4A, and the average value was 25.9 kft-lbs. The surface rotary speed distribution is shown in FIG. 4B, and the average value was 91 rpm. In FIGS. 4A-4F and 6A-6F, it is noted that the bars show the actual data distribution for the measured or calculated parameter. As noted above, the line with an asterisk (*) designation shows the cumulative distribution % of the measured or calculated parameter. From this data, the specific torque swing per rpm was calculated and the distribution is shown in FIG. 4C, with an average value of 0.28 kft-lbs/rpm for the interval.

A value for $\Delta TQS_{ref}$ for Drill String 1 (which was utilized in drilling Well 1) was calculated using the design information for Drill String 1 shown in Table 1A. The $\Delta TQS_{ref}$ value for Drill String 1 was calculated to be 0.125 kft-lbs/rpm as shown in FIG. 3. This is less than half of the average ΔTQS value calculated for the recorded data shown in FIG. 4C. It can therefore be inferred from the data that the drill string did not have sufficient "torque swing capacity" for the loads that were encountered while drilling for efficient drilling operations.

According to the methods as disclosed herein, using the $\Delta TQS_{ref}$ value for Drill String 1, the $TSE_{TQ}$ distribution for Well 1 was calculated and is shown in FIG. 4D. The average value for $TSE_{TQ}$ is 2.2 and about 85% of the distribution exceeds the full stick-slip condition of TSE=1.0. As can be seen in FIG. 4D, this Drill String 1 was experiencing "severe" stick slip conditions (i.e., TSE>1) for the majority of the operation.

Figure 4E:
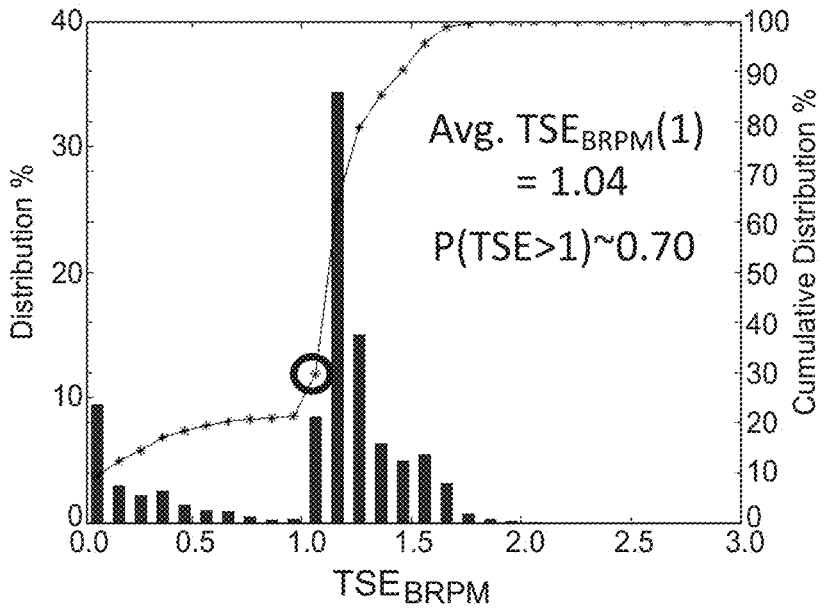
FIG. 4E illustrates the $TSE_{BRPM}$ distribution for Well 1.
Figure 4F:
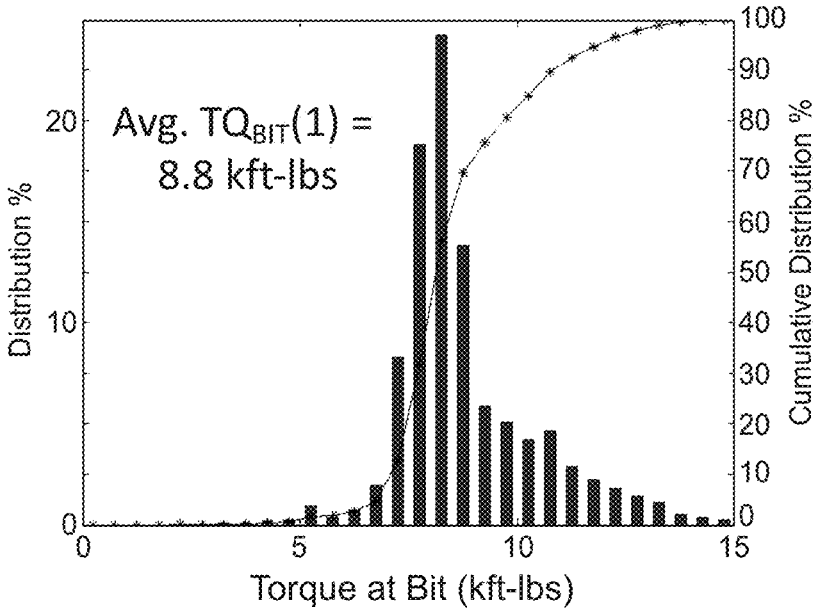
FIG. 4F shows the torque at bit distribution for Well 1.

The Well 1 data also included downhole (at bit) torque and RPM monitoring. The actual torque at bit data for Well 1 is shown in FIG. 4F, with an average value of 8.8 kft-lbs. Utilizing the methods disclosed herein for calculating the TSE based on the downhole data (e.g., the $TSE_{BRPM}$ equations), the $TSE_{BRPM}$ distribution for Well 1 was calculated and is shown in FIG. 4E, with an average value of 1.04. As can be seen in FIG. 4E, the $TSE_{BRPM}$ based on the downhole data confirms that Drill String 1 was experiencing "severe" stick slip conditions (e.g., TSE>1) for the majority of the operation.

Applying equation Eq. 13 to the initial distributions for Well 1 with modified parameters may yield insight into the amount of improvement that may be expected by appropriate redesign. In this case, the "modified" parameters for Well 2 can be applied to the Well 1 data.

In this case, the drill string was modified from the Table 1A description to Table 1B, providing for an increase in $\Delta TQS_{ref}$ from 0.125 to 0.178 kft-lbs/RPM. The surface rotary speed was increased from an average of 91 to 126 RPM. The wellbore size was reduced and the bit was redesigned with increased blade count and less aggressive cutting structure, so a reduction in DTOR of approximately 30% is expected. For consistency with the Well 2 dataset since the downhole bit torque data was available, the calculated ratio of 0.73 is utilized below which is reasonably within the same value, as shown by the following:

$$TSE_2 = TSE_1 \cdot \frac{\Delta TQS_{ref\ 1}}{\Delta TQS_{ref\ 2}} \cdot \frac{SRPM_1}{SRPM_2} \cdot \frac{DTOR_2}{DTOR_1}$$

Therefore, $$TSE_{1,mod} = TSE_{1,init} \cdot \frac{125}{178} \cdot \frac{91}{126} \cdot \frac{6.4}{8.8}$$

$$TSE_{1,mod} = TSE_{1,init} \cdot (0.70) \cdot (0.72) \cdot (0.73)$$

$$TSE_{1,mod} = (0.37) \cdot TSE_{1,init}$$

Figure 5A:
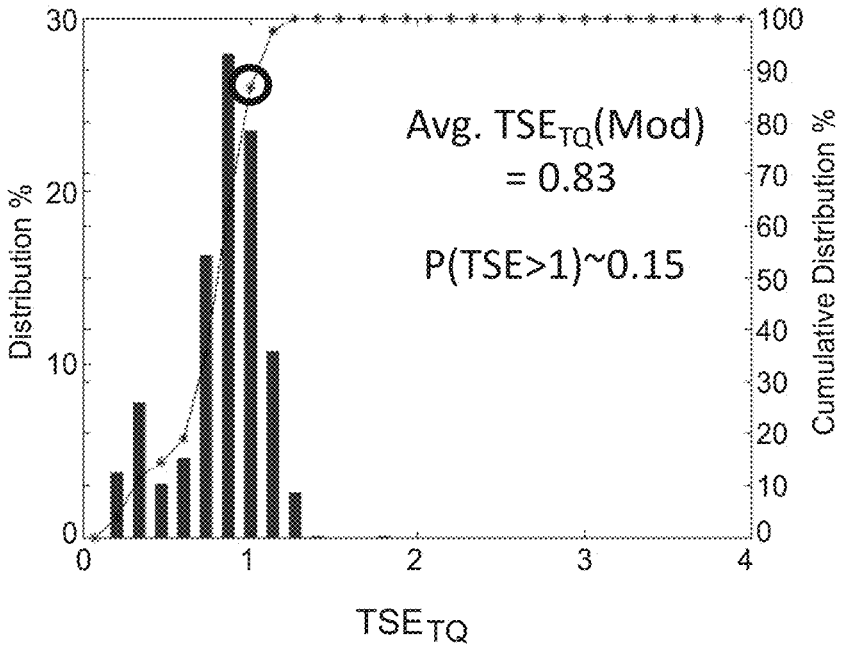
FIG. 5A illustrates the calculated $TSE_{TQ}$ distribution for the modified Well 1 operations using a ratio of 0.37, based on the data in FIG. 4D.
Figure 5B:
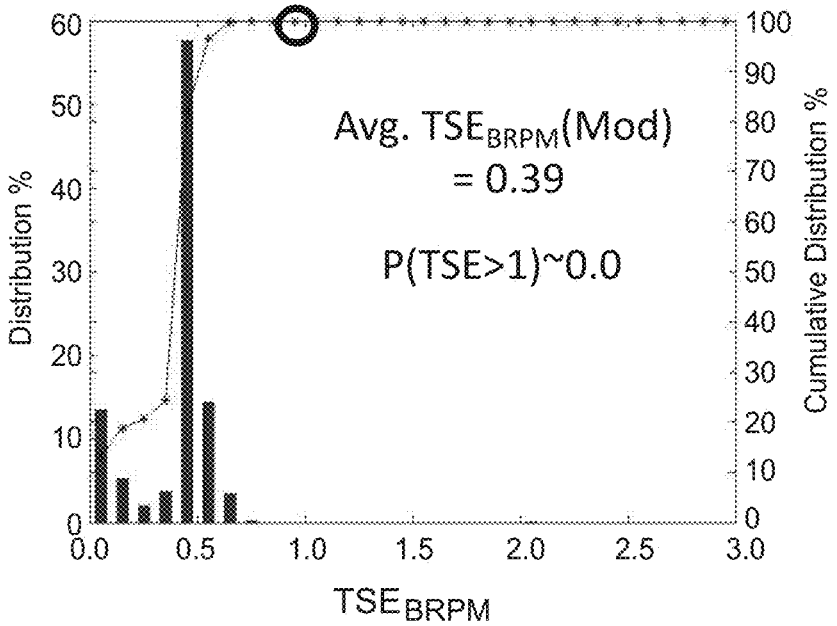
FIG. 5B illustrates the calculated $TSE_{BRPM}$ distribution for the modified Well 1 operations using a ratio of 0.37, based on the data in FIG. 4E.

Application of this scaling factor to the Well 1 $TSE_{TQ}$ data shown in FIG. 4D, and replotting as a distribution, FIG. 5A is obtained which illustrates a calculated $TSE_{TQ}$ distribution for the modified Well 1, based on the data in FIG. 4D and the modified drill string and drilling parameters. The same scale factor may then be applied to the $TSE_{BRPM}$ data shown in FIG. 4E, resulting in the modified chart seen in FIG. 5B which illustrates the calculated $TSE_{BRPM}$ distribution for the modified Well 1 operations, based on the data in FIG. 4E and the modified drill string and drilling parameters.

In Well 2, the same challenging formation was encountered over the corresponding interval in Well 1. FIGS. 6A to 6F (based on actual Well 2 and Drill String 2 data and drilling parameters) correspond in similar manner to the information in FIGS. 4A to 4F (based on actual Well 1 and Drill String 1 data and drilling parameters) as have just been described. The data acquisition, calculated drilling parameters, and resulting graphs and figures for FIGS. 6A to 6F correspond to the same methodology as described for corresponding FIGS. 4A to 4F in this example.

Table 2 provides a portion of the summarized data described above for the three cases: actual Well 1 data using the initial drill string and initial drilling parameters in an actual well drilling operation (Well 1), Well 1 data transformed using the modified drill string and modified drilling parameters (Well 1 (mod)), and actual Well 2 data using the modified drill string and modified drilling parameters in an actual well drilling operation (Well 2) for comparison.

TABLE 2

TSE Values for Well 1, Well 1 (mod), and Well 2

| TSE Type | Metric | Well 1 | Well 1 (mod) | Well 2 |
|---|---|---|---|---|
| $TSE_{TQ}$ | Average | 2.23 | 0.83 | 0.62 |
| | P(TSE > 1) | 0.85 | 0.15 | 0.05 |
| $TSE_{BRPM}$ | Average | 1.04 | 0.39 | 0.30 |
| | P(TSE > 1) | 0.70 | 0.00 | 0.01 |

Figure 7:
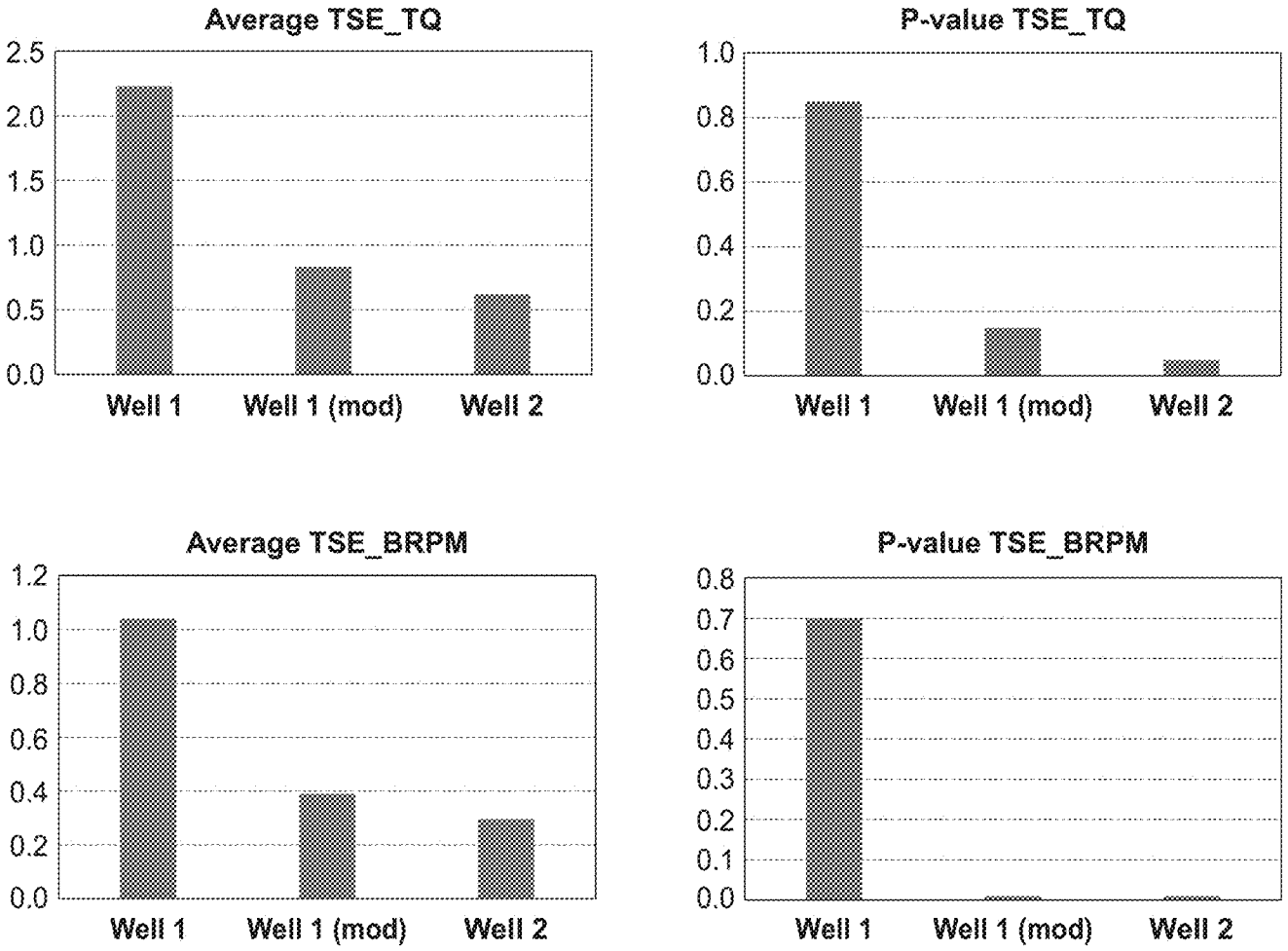
FIG. 7 provides TSE calculation results for Well 1, Well 1 (mod), and Well 2.

FIG. 7 provides a graphical representation of this data, which shows that the modeling data obtained according to embodiments of the present discovery as described herein correlates exceptionally accurately with the actual data. It may be seen that substantial reduction in stick-slip may be expected if using the modified drill string and modified parameters that were indeed used in Well 2 in the original Well 1 operation. Furthermore, transformation of the TSE distribution for Well 1 using the modified drill string and drilling parameters that were used in Well 2 provides a good approximation of the actual measured distributions observed drilling Well 2. These results provide technical evidence that this method yields results of acceptable engineering accuracy for the purpose of redesign of a stick-slip vibration limit.

Application of Method to Drilling Surveillance

In the specific instance of surveillance of an ongoing drilling operation, these relations may be extended further to provide additional utility. One application includes the determination of improved parameters for operation of the drilling assembly based on observations of data at surface. In this instance, the drill string, the hole size, and in most cases the friction coefficient in equation Eq. 18 are invariants. Also, $TSE_i$ in equation Eq. 17 may be written using the specific torque swing $\Delta TQS_i$. Noting that $\Delta TQS_{ref}$ is changing slowly during any individual drilling operation, as depth is increasing (more pipe in the hole) and the added pipe may have different properties (e.g. a "tapered string" or "tapered drill string" is a drill string that has different sections having different outer diameter and/or inner diameter values). Given that the reference value changes slowly, equation Eq. 12 may be written as equation Eq. 19 to represent the specific torque swing for a second condition 2, relative to a first condition 1, which have associated time series with indices j and i, respectively.

$$\Delta TQS_{2,j} = \Delta TQS_{1,i} \cdot \frac{RPM_{1,i}}{RPM_{2,j}} \cdot \frac{WOB_{2,j}}{WOB_{1,i}} \quad \text{(Eq. 19)}$$

In the following, this relationship may be adapted for use to determine parameters for a subsequent second drilling interval based on the data recorded during a first drilling interval. Typically the second interval would be immediately subsequent to the first interval, however the intervals do not necessarily need to be adjacent. They could be grouped by formation type, and indeed the interval could be in a different bit run or even a different well under certain circumstances (e.g., same bit design, same string design, etc.). It is intended that the designations first interval and second interval be viewed in the broadest terms in light of the above considerations.

Figure 8:
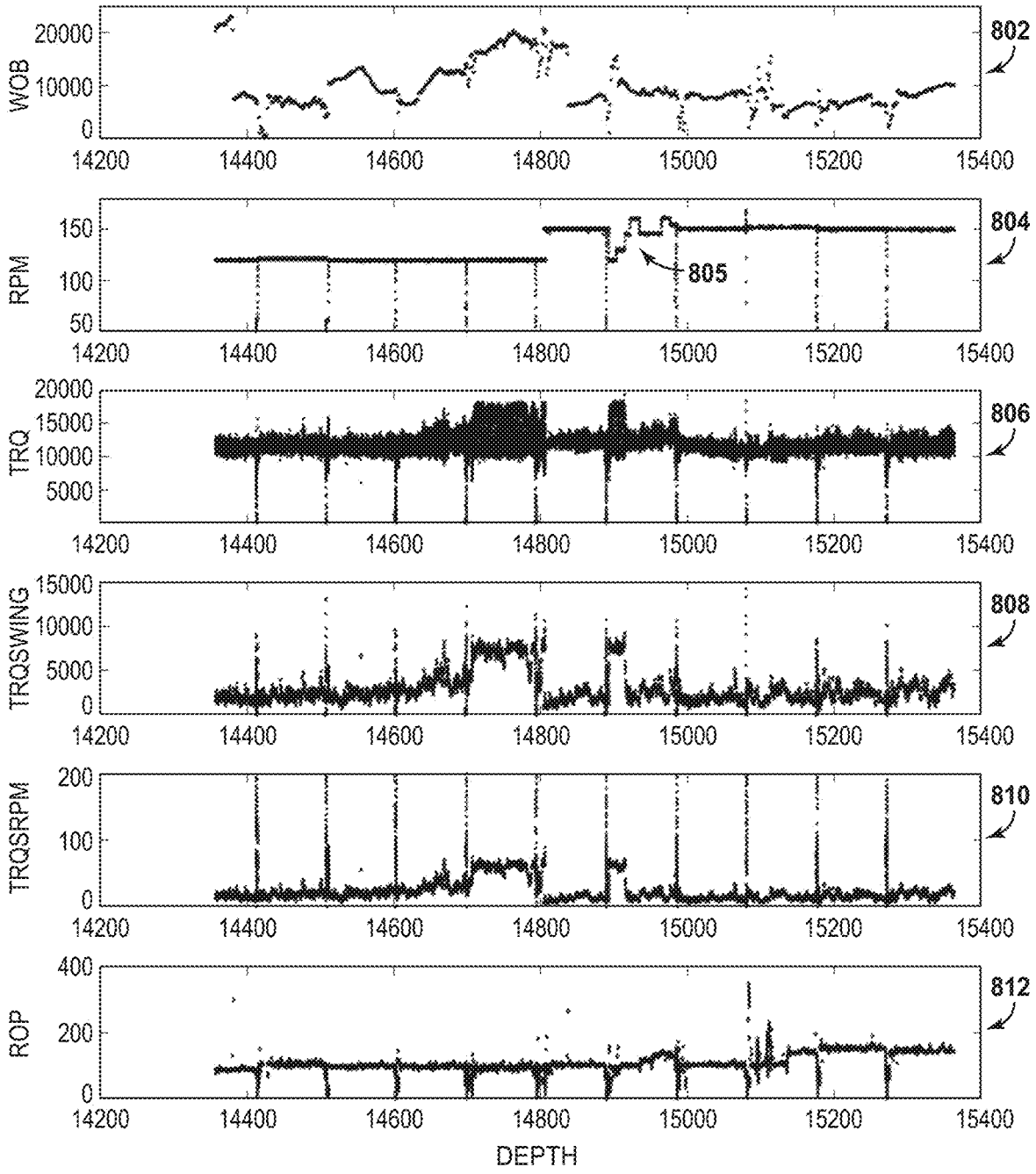
FIG. 8 illustrates charts of data from a horizontal well representing a change in operating parameters.

An exemplary application is described in FIGS. 8 to 15. In particular, FIG. 8 illustrates charts of data from a well representing a change in operating parameters. These operating parameters include torque swing and specific torque swing. The data in these charts is exemplary data from drilling operations conducted in a horizontal section of a well. In FIG. 8, the operating condition 1 is shown for the depth interval between 14,400 ft to 14,800 ft. In this operating condition 1, the rotary speed is maintained near 120 RPM (in the chart 804 labeled RPM representing rotary speed on the Y axis in revolutions per minute (RPM) and depth in feet on the x axis) and the WOB is fluctuating for this portion of the operations (in the chart 802 labeled WOB representing WOB in pounds on the y axis and depth in feet on the x axis). The increased WOB starting at about 14,700 ft creates an increase in torque "TRQ" (in the chart 806 labeled TRQ representing torque in foot-pounds on the y axis and depth in feet on the x axis) and an increase in the variation in torque, "TRQSWING" (in the chart 808 labeled TRQSWING representing torque swing in foot-pounds on the y axis and depth in feet on the x axis). The specific torque swing, "TRQSRPM" (in the chart 810 labeled TRQSRPM representing specific torque swing, per RPM, in foot-pounds per RPM on the y axis and depth in feet on the x axis). The magnitude of TRQSRPM may be obtained with point-by-point division of TRQSWING by the RPM (e.g., at the respective time interval). This creates a time series of many values associated at the first operating condition 1, where rotary speed is about 120 RPM. The chart 812 labeled ROP represents the rate of penetration (ROP) values on the y axis and depth in feet on the x axis, which are relatively constant over several stands of drilling, with some increase in the last three intervals from 15,100 ft to 15,400 ft.

The operating condition 2 is shown in the charts for the data in the depth interval between 14,800 ft and 15,370 ft. In this operating condition 2, the rotary speed is near 150 RPM, as shown in the chart labeled RPM. The WOB is mostly lower during this interval as well, as shown in the chart labeled WOB. There is a rotary speed step test (805) from the depth intervals between 14,900 ft to 15,000 ft, which is not included in this operating condition 2, with the exception of the interval about 150 RPM, as shown in the chart labeled RPM. The dataset with rotary speed values of 150 RPM comprise operating condition 2. Note that both operating conditions 1 and 2 have variations in most of the parameters, with the exception that, in this example, RPM is constant within tight tolerances determined by the rig control system associated with each of the operating condition datasets 1 and 2.

Figure 9:
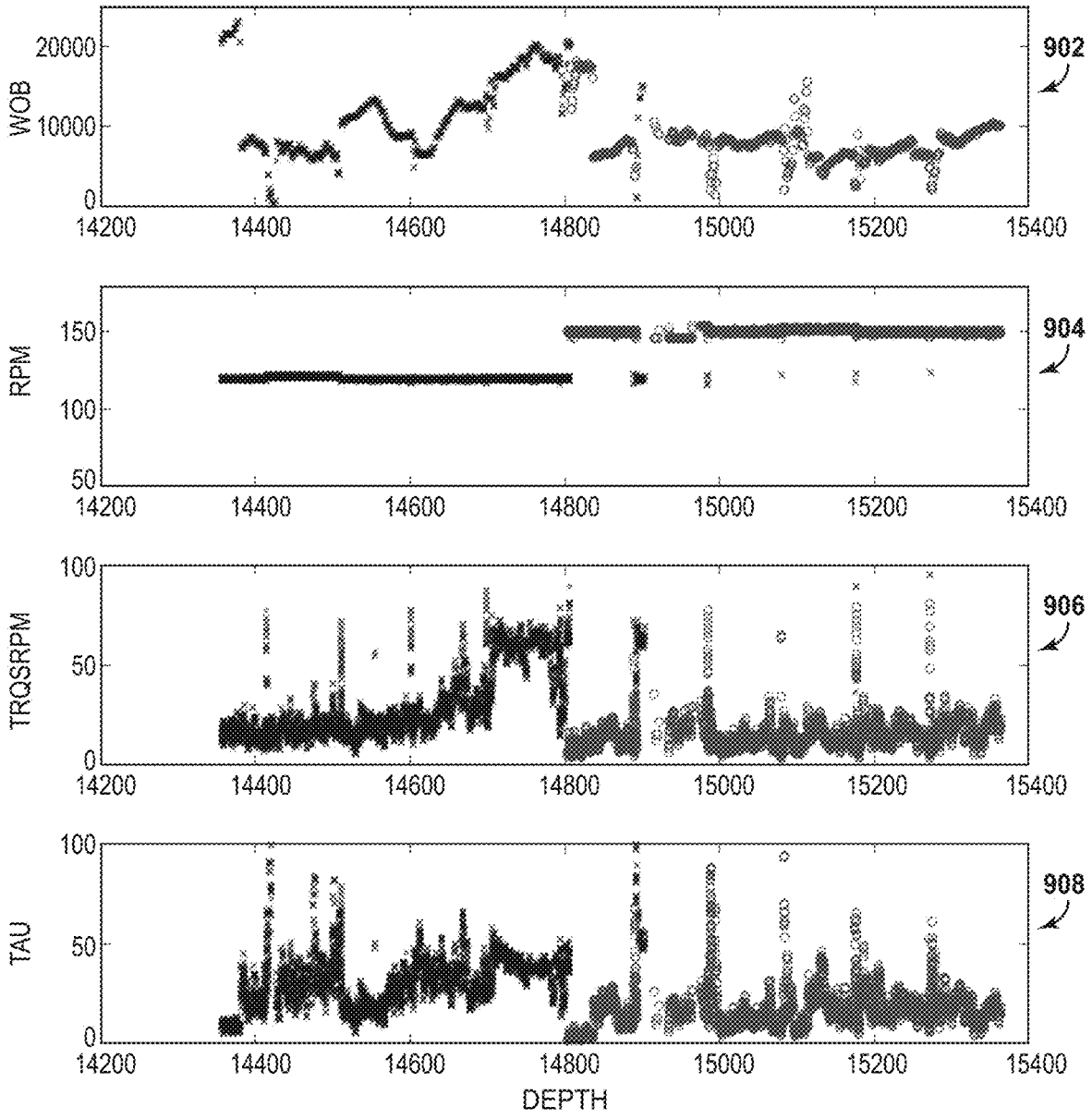
FIG. 9 illustrates other charts of data from this horizontal well representing changes in operating parameters.

FIG. 9 illustrates charts of portions of the data from FIG. 8, a horizontal well representing changes in operating parameters. In FIG. 9, data is selected only for the depth intervals corresponding to the two operating conditions, one in which the rotary speed is near 120 RPM (depth interval between 14,400 ft to 14,800 ft) and one at 150 RPM (depth interval between 14,800 ft and 15,370 ft). Rotary speed is shown in the chart 904 labeled RPM representing rotary speed on the Y axis in revolutions per minute (RPM) and depth in feet on the x axis, WOB is shown in the chart 902 labeled WOB representing WOB in pounds on the y axis and depth in feet on the x axis, and TRQSRPM is shown in the chart 906 labeled TRQSRPM representing specific torque swing on the y axis and depth in feet on the x axis. In addition to these charts, a chart 908 is shown for a parameter τ (Tau) over the respective depth intervals. Tau is shown in the chart 908 labeled TAU representing the normalized torque swing per rpm on the y axis and depth in feet on the x axis. The data in the charts is similar to the data in FIG. 8 for WOB, RPM, and TRQSRPM values for the first depth interval (depth interval between 14,400 ft to 14,800 ft), shown with black "x" marks, and second depth interval (depth interval between 14,800 ft and 15,370 ft), illustrated with small gray "o" marks. The similarity between block 906 and 908 illustrate that these two Torque Swing Ratio data series are closely linked. Here, the data not in either interval 1 or 2 is masked or muted and not shown in FIG. 9. The value of the normalized torque swing per RPM parameter τ ("Tau"), as shown in the chart labeled TAU, is calculated using mean value normalization according to the following equation Eq. 20, where the mean or median values are calculated separately for each of the two datasets for normalization purposes.

$$\tau_i = \Delta TQS_i \cdot \frac{RPM_i}{\overline{RPM}} \cdot \frac{\overline{WOB}}{WOB_i} \text{ where:} \quad \text{(Eq. 20)}$$

$$\overline{RPM} = f(RPM_i);\ \overline{WOB} = f(WOB_i)$$

$$f = \text{(mean or median)}$$

The calculation of the data series $\tau_i$ essentially normalizes the calculated torque swing per RPM data for an interval to common reference $\overline{RPM}$ and $\overline{WOB}$ values, which may be used to render enhancements to the comparative diagnostics (wherein "i" is the sampling index, which refers to a time or depth index, or alternatively a torsional vibration cycle). In equation Eq. 20, other alternatives to the mean or median values may be used to determine reference values, such as weighted averages or some alternative averaging normalization method.

It should be noted that normalization of the data is not required for drilling intervals of constant or nearly-constant drilling parameters. The normalization process helps to condition the data for those intervals in which there is an amount of variation in the RPM and WOB values that may be substantial but, at the same time, is not sufficient to warrant dividing the data into a second drilling interval. In certain instances in this disclosure, it is appropriate to generalize the process to consider either or both of these terms in the same context. The term "Torque Swing Ratio" (TSR) may be used in these instances to capture the application of either or both specific torque swing per RPM and normalized specific torque swing per RPM, depending on the context.

Figure 10:
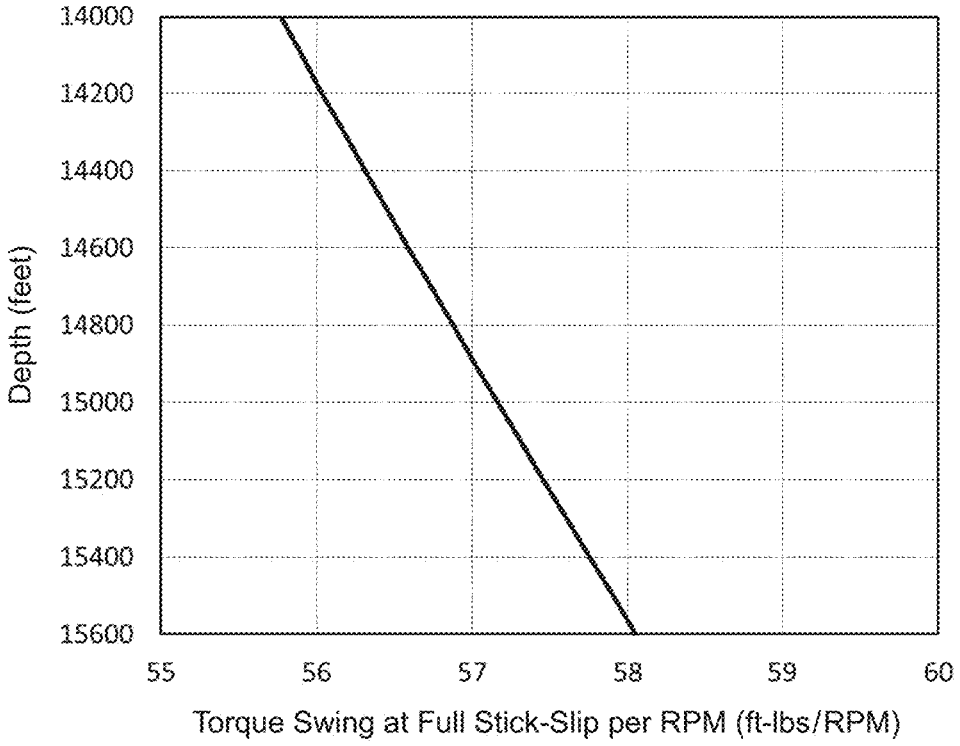
FIG. 10 illustrates a chart of torsional model results of the drill string.

As an exemplary, non-limiting methodology, consider the following operational scenario. The well has been drilled to a depth of 14,800 ft, at which time it is concluded from the high torque swing values that parameters need to be modified so as to reduce this torsional dysfunction. FIG. 10 illustrates a chart of torsional model results of the drill string. The chart represents reference torque swing per RPM values at full stick-slip and has bit depth as shown on the Y axis in feet (ft) and torque swing at full stick-slip per revolution, in foot-pounds per revolutions per minute (ft-lbs/RPM) on the x axis. The chart shows the reference value of specific torque swing for this drill string for the indicated depth interval is 57 ft-lbs/RPM. This was obtained using methods described in SPE Paper 163420 and SPE Paper 189673, Bailey, J. R., Payette, G. S., & Wang, L. (2018, Mar. 6). *Improved Methods to Understand and Mitigate Stick-Slip Torsional Vibrations. Society of Petroleum Engineers.* doi: 10.2118/189673-MS. Given that the calculated values illustrated in chart 1112 in FIG. 11 shows values of TRQSRPM in excess of the calculated amount of 57 ft-lbs/RPM from FIG. 10 (at depth of 14,900 ft) as explained further below, there is cause to adjust parameters to mitigate the stick-slip condition.

Figure 11A:
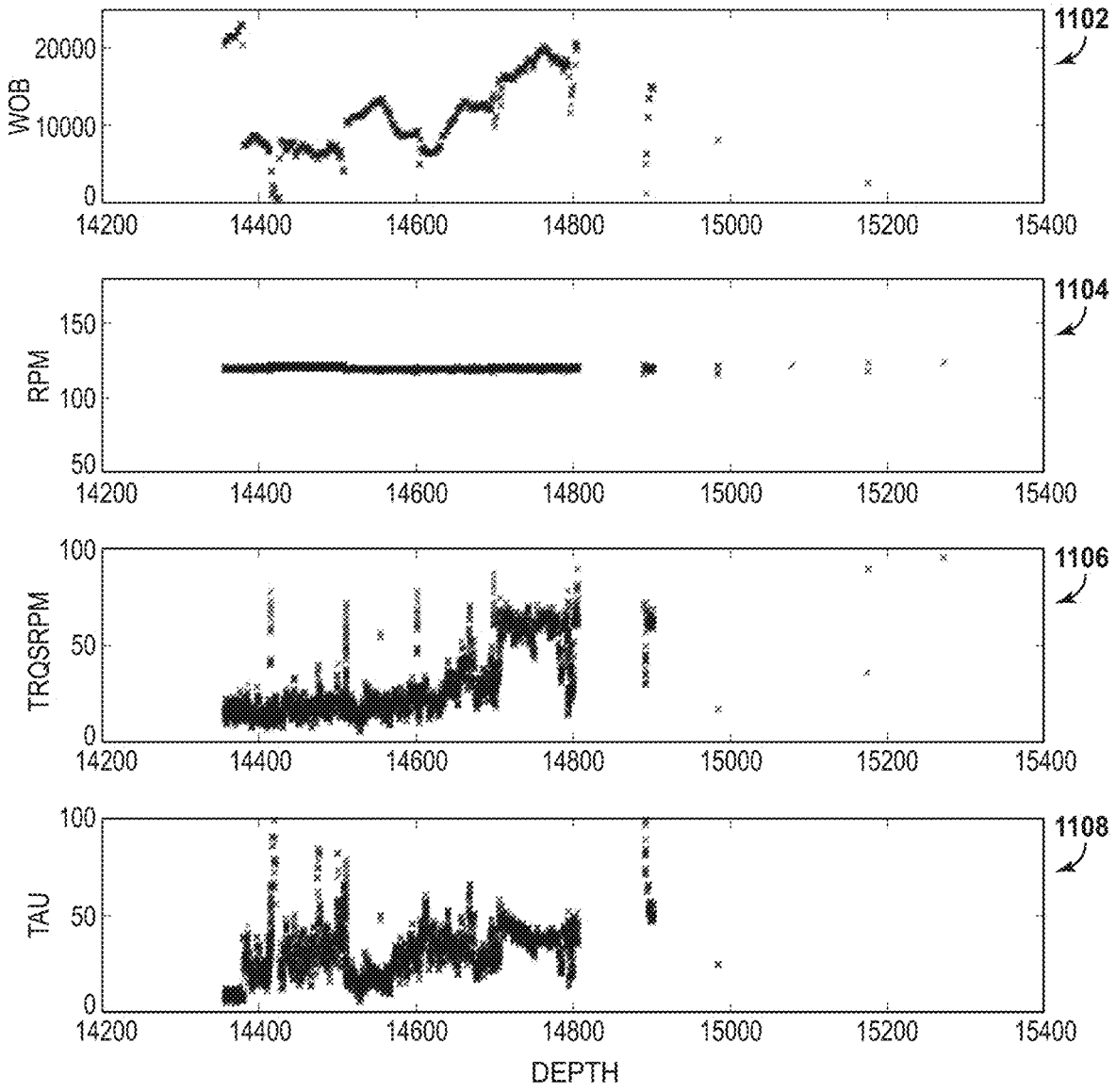
FIG. 11A illustrates charts of data in first depth interval from a well representing changes in operating parameters.
Figure 11B:
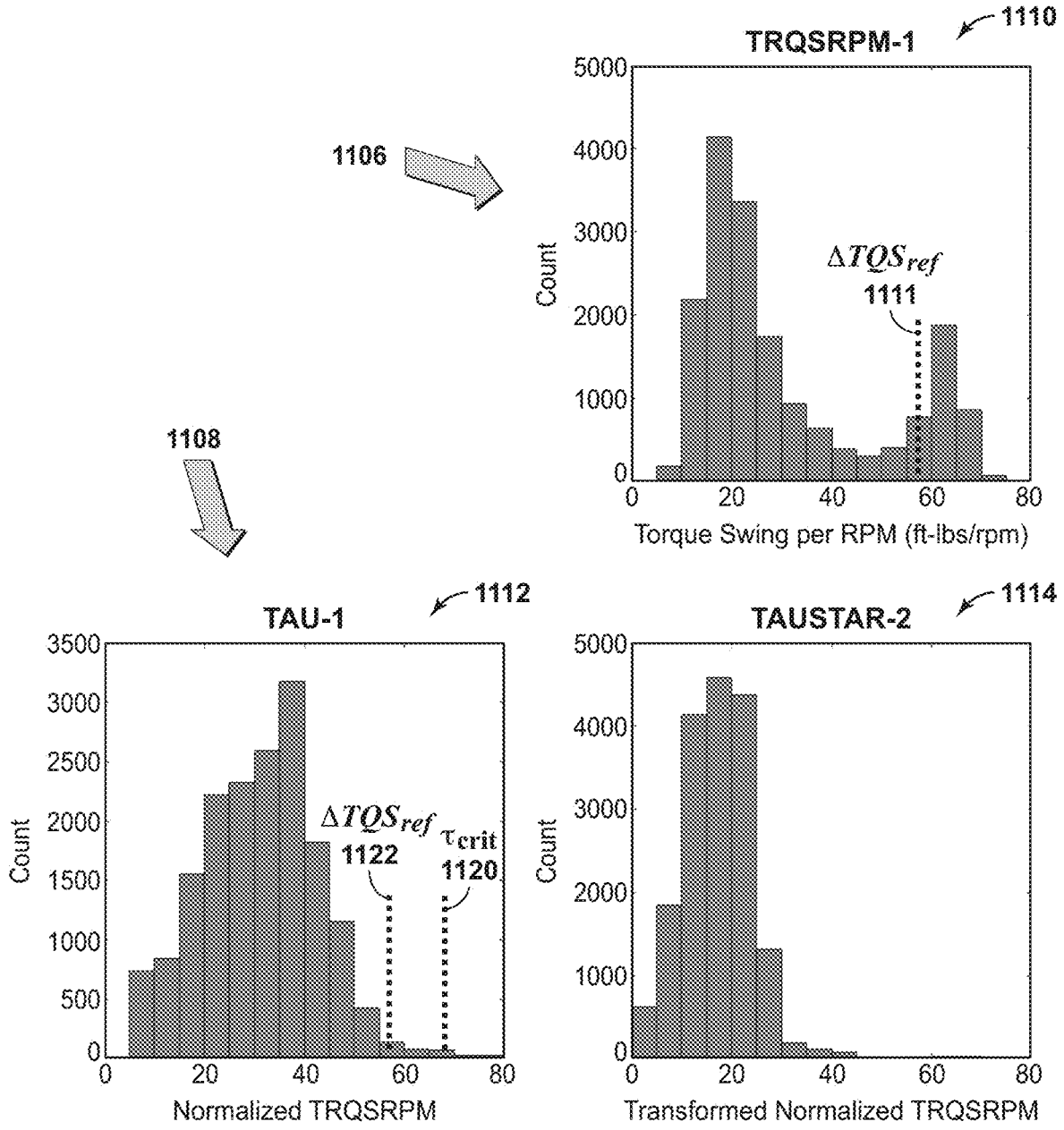
FIG. 11B illustrates distributions of Torque Swing Ratios for the first depth interval from a well representing changes in operating parameters.

FIG. 11A illustrates charts of data in the first depth interval of 14,400 to 14,800 ft from a well representing changes in operating parameters. The charts in FIG. 11B show the specific torque swing distributions 1110, in addition to the normalized τ (Tau) parameter distributions 1112. The calculated transformed τ parameter data from the first interval 1114 is also provided as further discussed below.

FIGS. 11A and 11B provide data in this example for just the first depth interval between 14,400 ft to 14,800 ft in which the system was operated at 120 RPM. WOB is shown in the chart 1102 with WOB in pounds on the y axis and depth in feet on the x axis, rotary speed is shown in the chart 1104 with rotary speed on the Y axis in revolutions per minute (RPM) and depth in feet on the x axis, TRQSRPM is shown in the chart 1106 with torque swing per RPM in ft-lbs/RPM on the y axis and depth in feet on the x axis; and TAU is shown in the chart 1108 with normalized torque swing per RPM in ft-lbs/RPM on the y axis and depth in feet on the x axis. Further, the distribution of TRQSRPM' is shown in the chart 1110 with population count on the y axis and normalized torque swing per RPM in ft-lbs/RPM on the x axis, the distribution of $TAU_1$ is shown in the chart 1112 with count on the y axis and normalized TRQSRPM on the x axis. The distribution of the transformed $TAUSTAR_2$ (e.g., $\tau_2$*) is shown in the chart 1114 with count on the y axis and TRQSRPM on the x axis, transformed to the design conditions using equation Eq. 23 described below.

FIGS. 11A and 11B provide data and their distributions only for the first depth interval. The character of the TRQSRPM distribution in chart 1110 suggests that stick-slip may be a concern as there is considerable distribution in excess of the reference $\Delta TQS_{ref}$ value 1111 of 57 ft-lbs/RPM from FIG. 10. FIG. 10 provides model output that associates torque swing per RPM values with the full stick-slip condition using methods described in SPE 163420. There are likely other indicators of stick-slip displayed or known to the driller or operator, including periodic stall, increase in torsional period, difficulty maintaining toolface control, possible downhole vibration measurements delivered to surface, and other features known to those skilled in the art. Additionally, over time as the present method is applied, an operator may learn empirically what values of specific torque swing may be tolerated and what values require mitigation through modification of operating parameters.

One may choose design values, $RPM_2$* and WOB for the next depth interval to mitigate a perceived stick-slip dysfunction. The disclosed method provides assistance in determining such values to mitigate stick-slip. Since both RPM and WOB may be varied, there is not a unique solution. In this instance, different rotary speeds were evaluated to investigate or analyze stick-slip mitigation, and then the value of 150 RPM was selected for the second depth interval. At the time that this decision was made while drilling the well, the present methods were not available, but experience suggested that the stick-slip vibrations might be addressed by changing the rotary speed. Note that the well was being control-drilled by ROP, and the WOB decreased after the rotary speed was increased. Therefore, in the present techniques, the objective of the change in drilling parameters is to continue drilling at the same ROP but without stick-slip dysfunction.

The procedure disclosed in the present techniques is to use the data samples from one or more drilled depth intervals that are indicative of the drilling tool performance and the formations being drilled. The individual, calculated specific torque swing data values $\Delta TQS_i$ (also known as TQSRPM) from this data are calculated and may be transformed to the "Tau" parameter $\tau_i$ to normalize for parameter variations about the reference values $\overline{RPM_1}$ and $\overline{WOB_1}$. The difference between charts 1110 ($TQSRPM_1$) and 1112 ($TAU_1$) illustrate the normalization effects as the lobe of data from 60 ft-lbs/RPM to 70 ft-lbs/RPM in chart 1110 is mitigated by the normalization process, suggesting that some of the apparent stick-slip was related to drilling parameters varying from their mean values $\overline{RPM_1}$ and $\overline{WOB_1}$.

A "Stick-Slip Design Factor" (SSDF) is then determined by the ratio of the drill string reference value to a critical value, determined in the following way prior to drilling the second interval. From Eq. 19, it is apparent that judicious changes to the RPM and WOB operating parameters can compress the torque swing values in the second interval. In FIG. 11B, the value $\tau_{crit}$ (1120) is selected such that the distribution of $\tau_i$ is some large portion below this critical value, such as 99.7% corresponding to "three sigma", as one embodiment. The objective of the parameter management process is to adjust RPM and WOB such that a calculated $\tau_{crit}$ value for the next interval becomes less than the $\Delta TQS_{ref}$ value for the drilling system. In this way, the Torque Swing Ratio values for the second interval should be less than the reference value, and then by Eq. 17 the values of $TSE_{TQ}$ should be less than 1 for the second interval. At the design stage, indicated by asterisks "*", the SSDF factor scales the distribution of $\tau_{1,i}$ values as seen in the relations above. Then, $$\tau_{2,i}^{*}=SSDF\tau_{1,i} \quad \text{(Eq. 21)}$$

with $SSDF=\Delta TQS_{ref}/\tau_{crit}$

To repeat, the objective of the parameter scaling is typically to compress distributions of the $\tau_{1,i}$ values such that only a small portion of the resulting cumulative distribution of the $\tau_{2,i}^{*}$ (or, more generally, TSR) values exceed the $\Delta TQS_{ref}$ reference specific torque swing for the drill string, prior to drilling the second interval. There is an underlying assumption that the distributions of $\tau_{1,i}$ and $\tau_{2,j}$ are "similar" in that they use the same drilling tools and drill string and the formations have comparable drillability factors. Note that if there is a formation change, then the method may need to be restarted to generate fresh data for the first interval using new distribution values. In one embodiment, this may be implemented as an iterative process that adapts to formation change.

In some applications, the method may generate more aggressive parameter settings since the value of SSDF may be greater than 1.0. This could be seen if stick-slip is sufficiently low that there is margin to increase the aggressiveness of the parameter settings, i.e. to increase WOB for the same RPM. In one embodiment, this method could be applied to adaptively set RPM and WOB drilling parameters to avoid stick-slip in certain formations and increase parameter aggressiveness when suitable margins exist to do so.

Using equations Eq. 20 and Eq. 21, then for the design values $RPM_2^*$ and $WOB_2^*$ corresponding to the calculated design factor SSDF, $$SSDF = \frac{\overline{RPM_1}}{RPM_2^*} \cdot \frac{WOB_2^*}{\overline{WOB_1}} \quad \text{(Eq. 22)}$$

Typically in this application, SSDF may be less than 1.0, and the new distribution of $\tau_{2,i}^{*}$ may be such that only a small portion of the data from the second interval has torque swing ratio (TSR) values in excess of $\Delta TQS_{ref}$. The critical value $\tau_{crit}$ used to calculate the SSDF may include a reasonable "safety factor" or tolerance to enhance operations and mitigate stick-slip issues even as parameters vary. Alternatively, in another embodiment, the operations personnel may determine that the desired reduction of a certain amount, such as 10%, for example, may be applied for the next depth interval, in which case the value for SSDF may be set to a value of 0.90. In another case, for TSR values in an interval that are much less than $\Delta TQS_{ref}$, operations personnel may decide to increase parameters and apply a SSDF value greater than 1.0.

Returning to the example in FIGS. 8 to 14, the numerical values for the first interval are: $\overline{RPM_1}$=119.8, $\overline{WOB_1}$=11,714 lbs. In the second depth interval, the observed values from FIGS. 8 and 9 were: $\overline{RPM_2}$=150.3, $\overline{WOB_2}$=7,983 lbs, corresponding to the design values RPM; =150 RPM and $WOB_2^*$=8 klbs. While drilling this depth interval of the well, the values of the RPM were increased to 150 RPM, which was deliberately selected to mitigate stick-slip following the RPM step test, which is shown in the depth interval 805, observed after 14,900 ft to 15,000 ft. In this example, the WOB value was determined from the ROP controller acting to maintain its setpoint value within tolerance.

For this example, using Eq. 22, the effective SSDF is equal to 0.55. The increase in RPM and reduction in WOB for the second depth interval relative to first depth interval results in a 45% reduction in the design values $\tau_{2,i}^{*}$. It is important to note that the design values for the second depth interval are not unique, as various combinations of $RPM_2^*$ and $WOB_2^*$ may provide the same SSDF value. This provides flexibility in responding to stick-slip issues while maintaining or recognizing other parameter objectives and dysfunction mitigation efforts. The linear relationship is shown further below in equation Eq. 24. For example, high RPM and low WOB may lead to BHA lateral vibrations, so mitigation of the various modes of vibration may preferentially be balanced to achieve both low stick-slip and low lateral vibrations. Significantly, different design values $RPM_2^*$ and $WOB_2^*$ will result in different ROP values, and often the objective while drilling is to maximize ROP subject to low dysfunction.

In this example, FIGS. 11A and 11B provide data from the first depth interval. The chart 1102 shows the WOB values for the first depth interval; chart 1104 shows the RPM data, nearly constant at about 120 RPM; the chart 1106 shows the calculated $\Delta TQS_1$(TRQSRPM, or specific torque swing) values for first depth interval; and chart 1108 shows the "normalized" $\Delta TQS_1$ values $\tau_1$ that are calculated using Eq. 20. Collectively and individually, elements 1106 and 1108 refer to the TSR values for the first interval.

In addition, three distribution charts 1110, 1112 and 1114 are also provided in FIG. 11B using data from the first depth interval. The distribution of $\Delta TQS_1$ is shown in chart 1110. The population spike at a value of 60 ft-lbs/rpm is indicative of stick-slip; the two-peak response in such a distribution is a common stick-slip signature; for another example, refer to FIG. 4. The distribution of the normalized parameter $\tau_1$ is shown in chart 1112. When corrected using Eq. 20, there are values in excess of the specific torque swing reference value of 57 ft-lbs/rpm. The transform achieved by calculating $\tau_1$ essentially adjusts the torque swing data that is observed for different parameters ($RPM_{1,i}$, $WOB_{1,i}$) to a common parameter set equal to the means ($\overline{RPM_1}$, $\overline{WOB_1}$). The large distribution in chart 1110 in excess of the reference value (1111) is less prominent in chart 1112, suggesting that these datapoints were associated with deviations from the average parameter values and were subject to lower RPM, higher WOB, or both. Collectively and individually, elements 1110 and 1112 refer to the distributions of TSR for the first interval.

Combining Eq. 21 and Eq. 22, the Tau function $\tau_{2,i}$* for revised parameters RPM and WOB may be expressed, or transformed, in terms of the design basis distribution $\tau_{1,i}$ as follows, $$\tau_{2,i}^{*} = \tau_{1,i} \cdot \frac{\overline{RPM_1}}{RPM_2^{*}} \cdot \frac{WOB_2^{*}}{\overline{WOB_1}} = SSDF\tau_{1,i} \quad \text{(Eq. 23)}$$

Based on the data from the first depth interval and the determined value of SSDF, the values of the parameters of $RPM_2$*, $WOB_2$* for the second depth interval are selected to satisfy the following rearrangement of equation Eq. 23. The resulting equation Eq. 24 provides a linear relationship between the two values, allowing for different drilling parameter values to be selected to satisfy other drilling objectives. The design value for the second interval for WOB is equal to the SSDF times the ratio of the average of WOB over average RPM for the first interval, times the RPM in the second interval, as shown below. This relation determines a threshold to be observed while drilling the second interval. Drilling optimization to achieve other drilling parameter objectives may be conducted in consideration of this "threshold" relationship that governs the maximum $WOB_2$ to apply for any given value of $RPM_2$ that is selected for the second interval, based on data obtained in a first drilling interval. It may be noted that the threshold value of WOB on the cusp of stick-slip vibrations is a linear function of RPM.

$$WOB_2^{*} = SSDF \cdot \frac{\overline{WOB_1}}{\overline{RPM_1}} \cdot RPM_2^{*} \quad \text{(Eq. 24)}$$

Figure 12A:
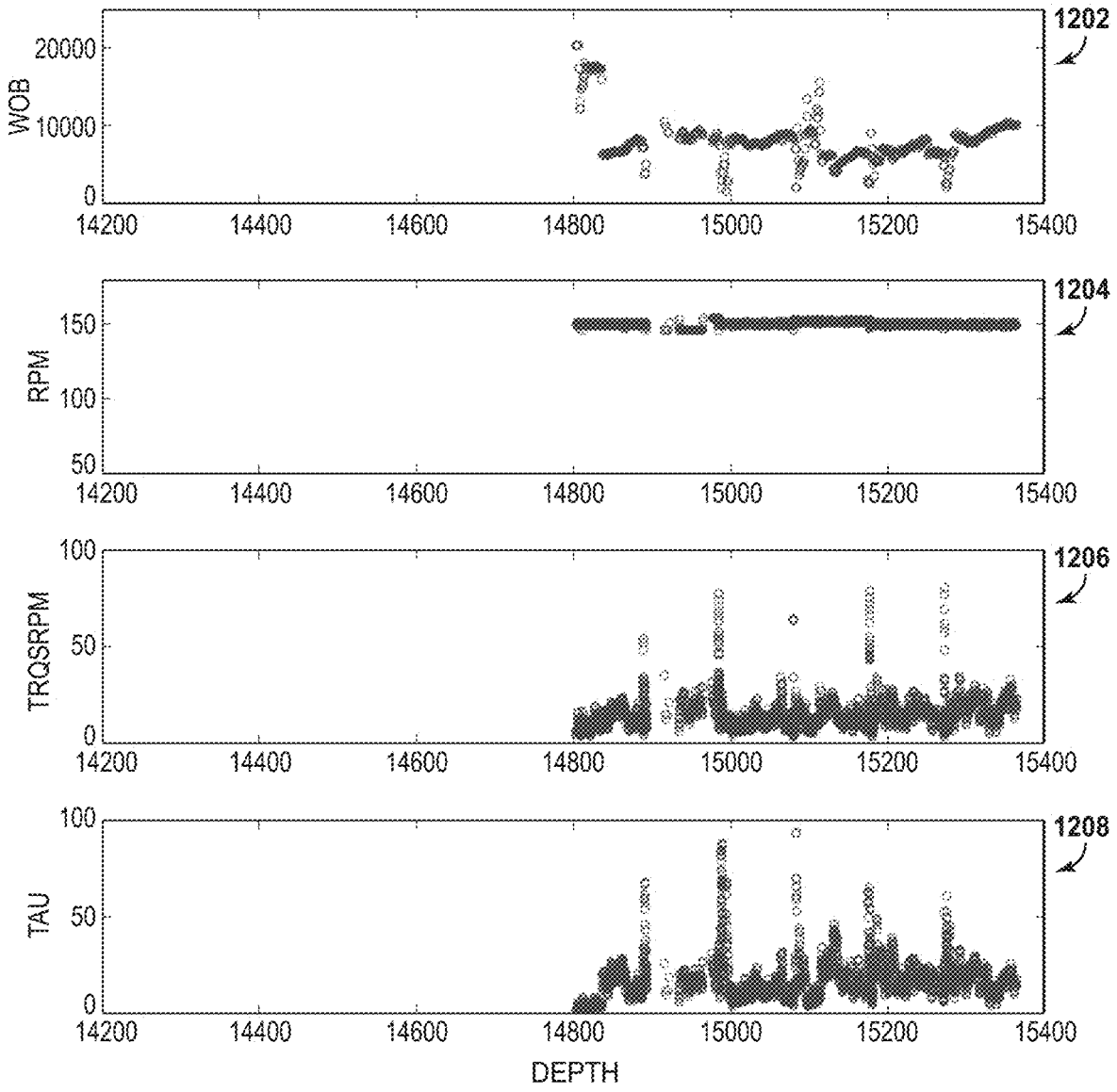
FIG. 12A illustrates charts of data in second depth interval from a well representing changes in operating parameters.
Figure 12B:
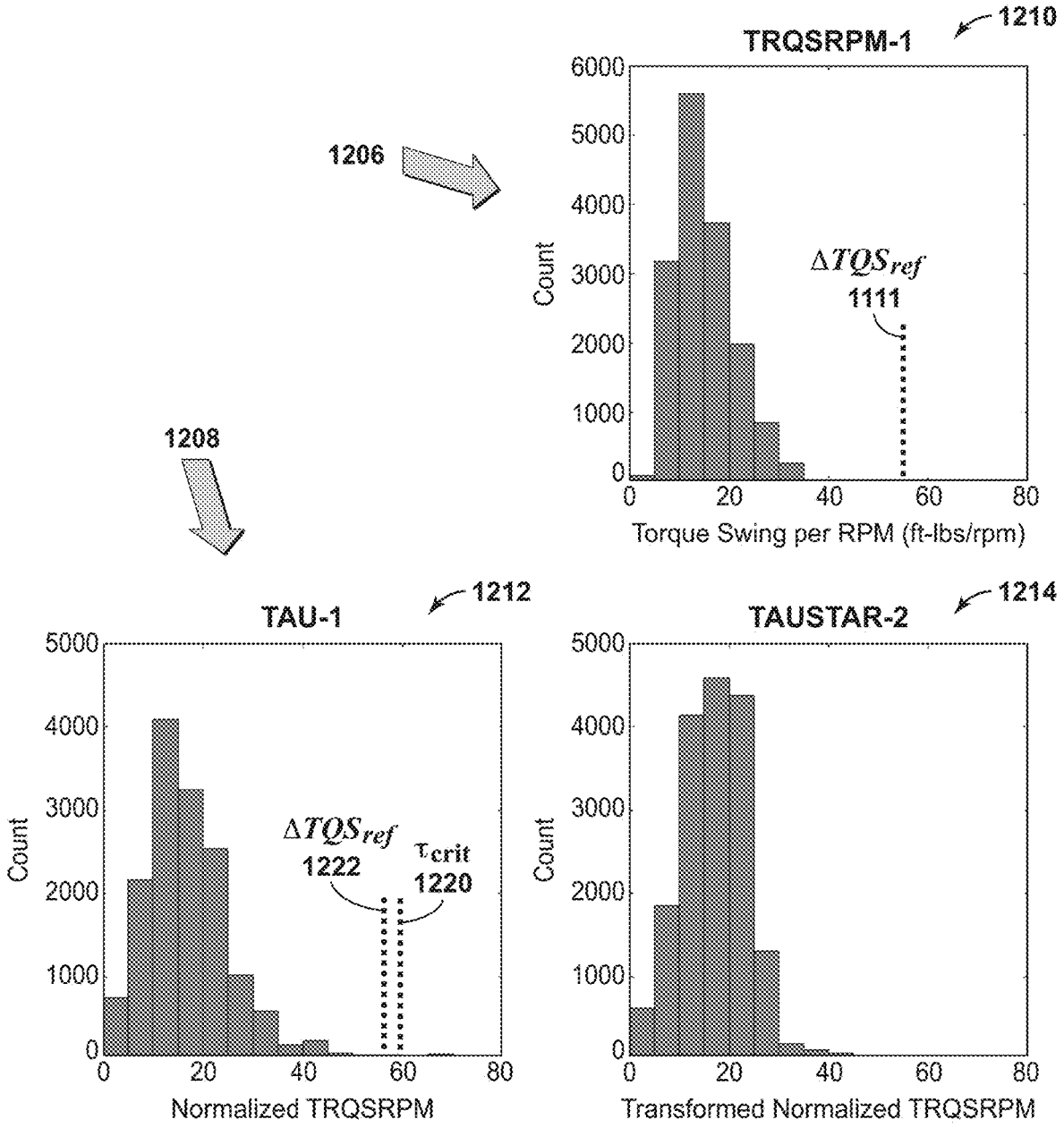
FIG. 12B illustrates distributions of Torque Swing Ratios in second depth interval from a well representing changes in operating parameters.

Returning to the example, FIGS. 12A and 12B illustrate charts of data in the second depth interval from a well representing changes in operating parameters. WOB is shown in the chart 1202 with WOB in pounds on the y axis and depth in feet on the x axis, rotary speed is shown in the chart 1204 with rotary speed on the y axis in revolutions per minute (RPM) and depth in feet on the x axis, TRQSRPM is shown in the chart 1206 with specific torque swing in ft-lbs/RPM on the y axis and depth in feet on the x axis; and TAU is shown in the chart 1208 with normalized specific torque swing per RPM in ft-lbs/RPM on the y axis and depth in feet on the x axis. Further, the distribution of $TRQSRPM_2$ is shown in the chart 1210 with count on the y axis and torque swing per RPM in ft-lbs/RPM on the x axis, $TAU_2$ is shown in the chart 1212 with count of normalized torque swing per RPM on they axis and normalized TRQSRPM on the x axis. Collectively and individually, elements 1210 and 1212 refer to the distributions of TSR for the second interval. Chart 1114 of $TAUSTAR_2$ from FIG. 11B is repeated in FIG. 12B, with count on they axis and transformed, normalized TRQSRPM based on data from the first interval on the x axis.

The design basis $\tau_{2,i}$* distribution is shown in chart 1114 for the specific design values of ($RPM_2$*, $WOB_2$*) for the second depth interval, for which $RPM_2$* is equal to 150 RPM and $WOB_2$* is equal to 8 klbs. Note that in chart 1212 the distribution is shifted to the left, away from the reference value (1222) of 57 ft-lbs/rpm for ΔTQS. The distribution of the data from the second interval based on the same 99.7% cumulative distribution criteria has a new $\tau_{2,crit}$ value (1220) of 60 ft-lbs/RPM, which is closer to the $\Delta TQS_{ref}$ value of 57. Note that in the specific torque swing chart for the second interval, $\Delta TQS_{2,j}$, shown in chart 1210, the distribution tail to the right is more truncated than the normalized values in 1212. In the second interval, the normalization process generated a different effect from the first interval. The actual data shown in 1210 shows that stick-slip was suppressed.

The chart of $TAUSTAR_2$ from FIG. 11B is included in FIG. 12B for visual comparison with $TAU_2$ to identify similarities. $TAUSTAR_2$ is calculated from the drilling data of the first interval, and $TAU_2$ is determined from the data from the second drilling interval. The degree of similarity is a measure of the value of this method, but it also reflects to some extent the similarity of formations and other factors outside the scope of this analysis. To a large effect, the similarity represents the physics described in FIG. 10 and the associated disclosure wherein the torque swing at the surface is related to the change in rotary speed at the bit, and the drill string torsional vibration model provides a relatively complete description of the relation between these two drilling parameters.

Figure 13:
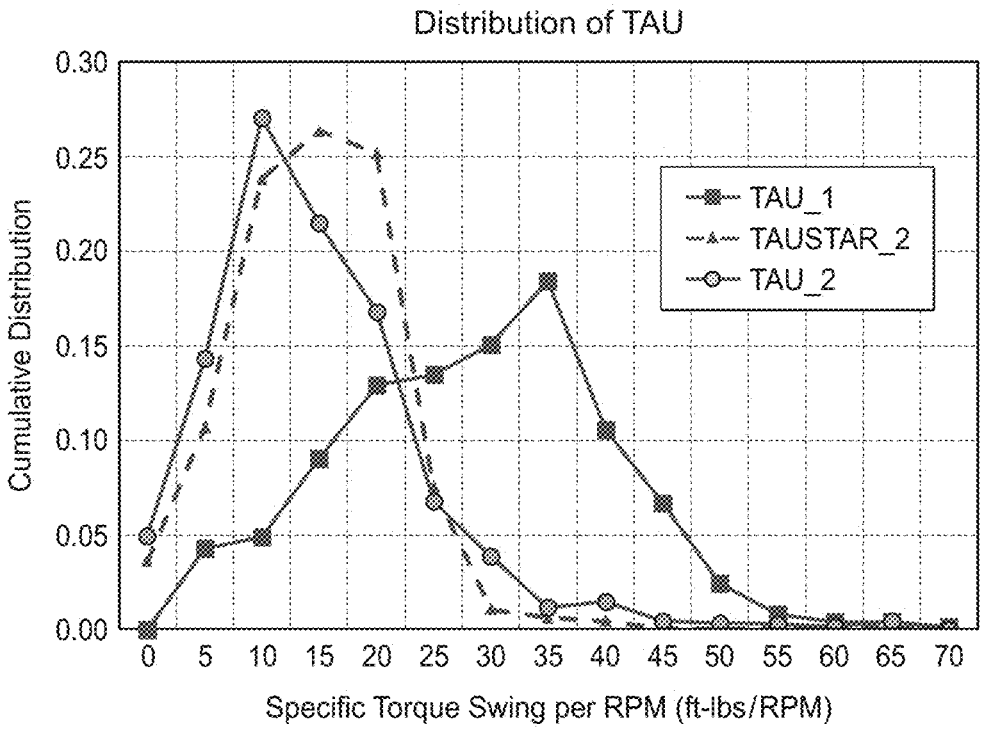
FIG. 13 illustrates a plot of the three τ (Tau) parameter distributions.

One may note that the $\tau_2$ distribution resembles the $\tau_2$* distribution to a greater extent than the original $\tau_1$ distribution. FIG. 13 illustrates a plot of the three τ (Tau) parameter distributions: the original $\tau_1$ distribution from the first interval, the transformed $\tau_2$* values used to select the parameters for the second interval based on the SSDF and the data from the first interval, and the actual data from the second interval adjusted using the TAU transform relationship. FIG. 13 shows the original $\tau_i$ distribution plotted as the dark solid line with squares. The transformed $\tau_2$* distribution is the dashed line with triangles, and the $\tau_2$ distribution is the gray solid line with circles at the data points. The outlier here appears to be the original $\tau_1$ distribution, as the other two distributions are relatively similar.

Figure 14:
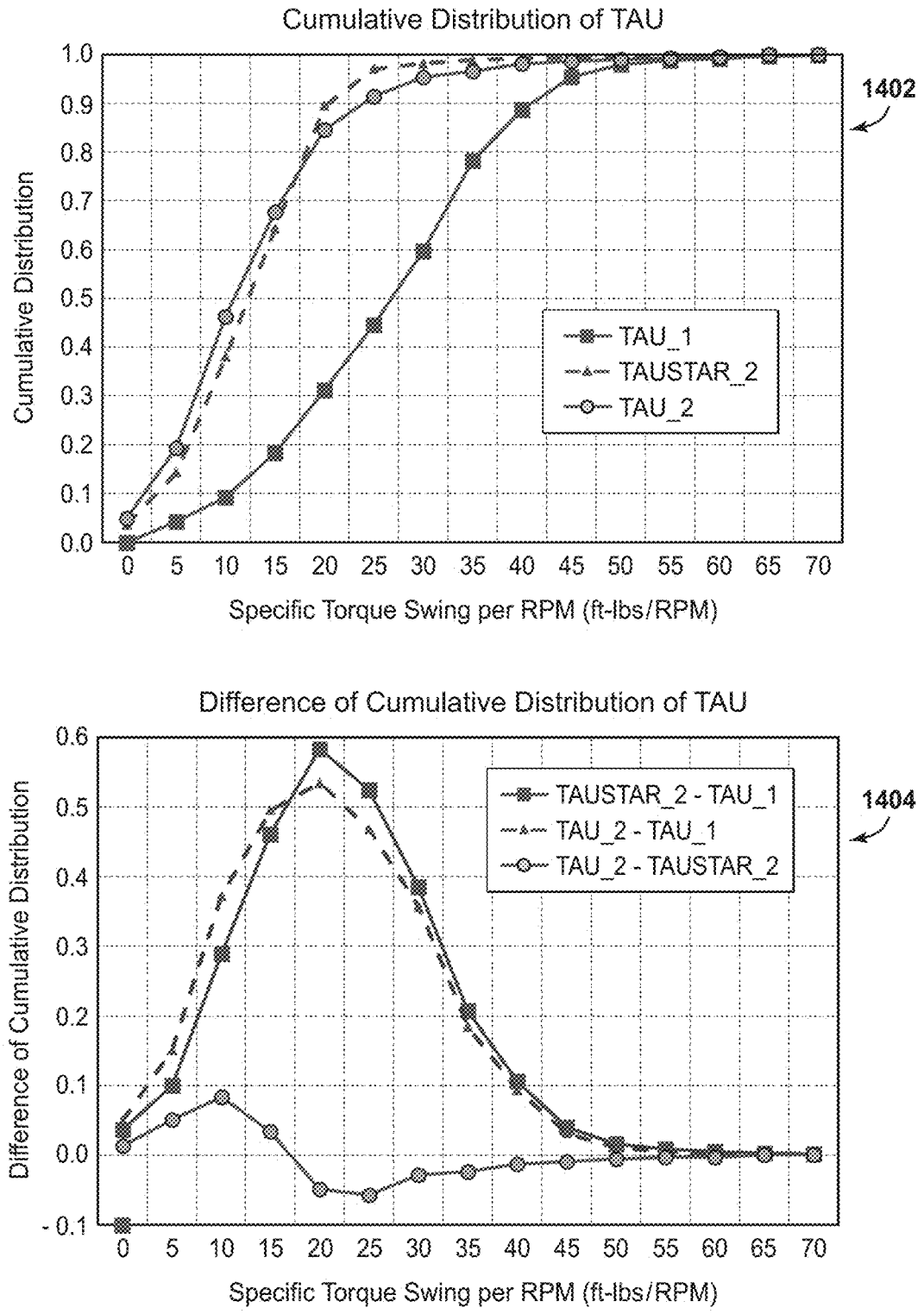
FIG. 14 illustrates charts of the three cumulative Tau parameter distributions.

FIG. 14 illustrates chart 1402 of the cumulative TAU distribution calculated in the usual way as a running summation of the counts of the TAU distributions, normalized to have a total value of 1. In FIG. 14, the three cumulative distribution plots are provided in chart 1402, and the differences are shown in chart 1404. The difference between the transformed $\tau_2$* distribution and the $\tau_2$ distribution is small relative to the differences between the $\tau_1$ distribution and the other two. Thus we may conclude that, in this example, the transformed $\tau_2$* distribution based on data from the first interval is similar to the actual data obtained in the second drilling interval.

Note that in this example, the specific values of $RPM_2$* and $WOB_2$* did not change while drilling the second depth interval. In some embodiments, various alternative values of RPM and WOB may be used for the same SSDF using equation Eq. 24 so as to achieve other drilling parameter objectives and still obtain the desired stick-slip reduction. These results may be evaluated in the same way that drilling parameters are typically evaluated, for example by calculating ROP, MSE, depth of cut (DOC), measured downhole vibrations, etc., in addition to assessing the improvement in stick-slip. There is not a unique set of operating parameters to achieve a specific reduction in the distribution of $\tau_2$* using equation Eq. 25, and multiple drilling parameter values can be evaluated by application of the threshold equation Eq. 24 that determines the maximum $WOB_2$ for any particular value of $RPM_2$ that is selected.

In one exemplary embodiment, after calculation of the $\tau_1$ distribution provided in chart 1112 of FIG. 11, it may be determined that the design goal is to transform the data such that a "critical value of τ" $\tau_{crit}$ of 70 ft-lbs/RPM (reference 1120 in FIG. 11) were to be mitigated to less than the reference specific torque swing value of 57 ft-lbs/RPM from FIG. 10. This leaves only a small portion of the distribution above the reference specific torque swing value. With some safety factor, the value may be 55. Then we may calculate a desired SSDF value of 55/70 is equal to 0.78. This value is higher than the SSDF in the well example, which would result in higher WOB values in the second interval for any particular RPM value than the value of 0.55 calculated using Eq. 22. Using values from the first interval, $\overline{RPM_1}$ is equal to 119.8, and $\overline{WOB_1}$ is equal to 11,714 lbs, and thus one may determine from the drilling parameter threshold equation Eq. 25 that:

$$WOB_2^* = (0.78) \cdot \frac{11{,}714}{119.8} \cdot RPM_2^* = 76.3 \cdot RPM_2^* \quad \text{(Eq. 25)}$$

As long as this relationship in equation Eq. 25 is maintained, various values of $RPM_2$* and $WOB_2$* may be evaluated to optimize other drilling objectives such as high drilling rate (ROP), low lateral vibrations, low MSE values, etc. For instance, at 120 RPM a value for WOB of 9150 lbs satisfies this constraint. This result indicates that the average WOB value for the first interval of 11,714 lbs was about 2600 lbs above the threshold value at which full stick-slip occurs. However, increasing rotary speed to 150 RPM at the WOB value of 11,714 lbs may be just slightly in excess of the threshold value of 11,400 lbs at 150 RPM. The latter is expected to yield higher ROP than the WOB of 8,000 lbs that was used in the well, but in this instance hole cleaning was the ROP limiter.

The above discussion illustrates embodiments of the present disclosure that uses the data from the first interval to determine values for a WOB threshold to apply in the second interval using equation Eq. 24. This threshold can be maintained directly through a rig control system or indirectly by use of advisory notices to the driller, or in some cases through a combination of these. While drilling operations proceed for the second interval, the torque swing ratio (TSR) values can be calculated and compared with the reference value to evaluate ongoing torsional vibration performance, continually comparing stick-slip observations with the drilling system reference value.

Figure 15:
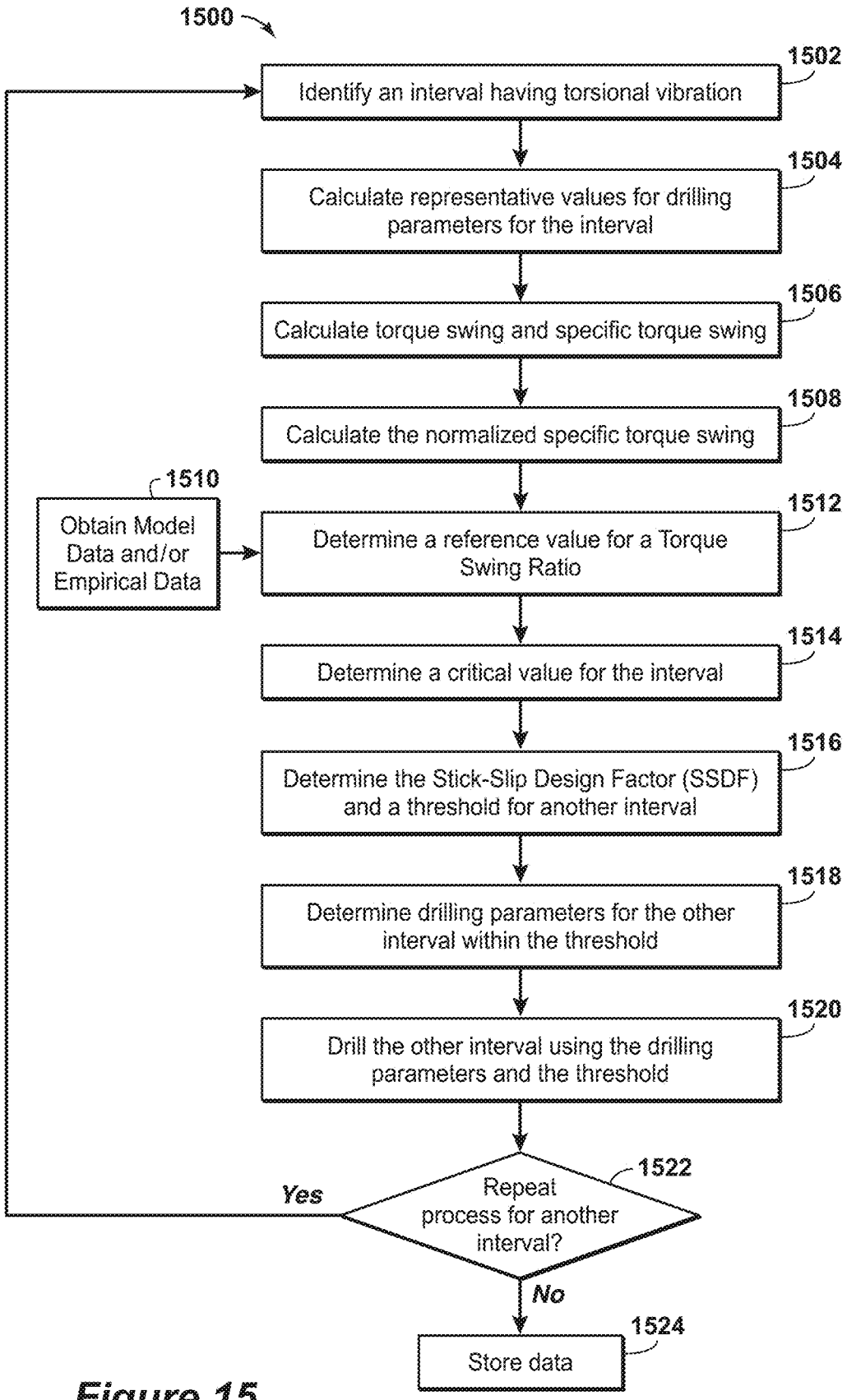
FIG. 15 illustrates a flow chart of one exemplary method in accordance with the present techniques.
Figure 16:
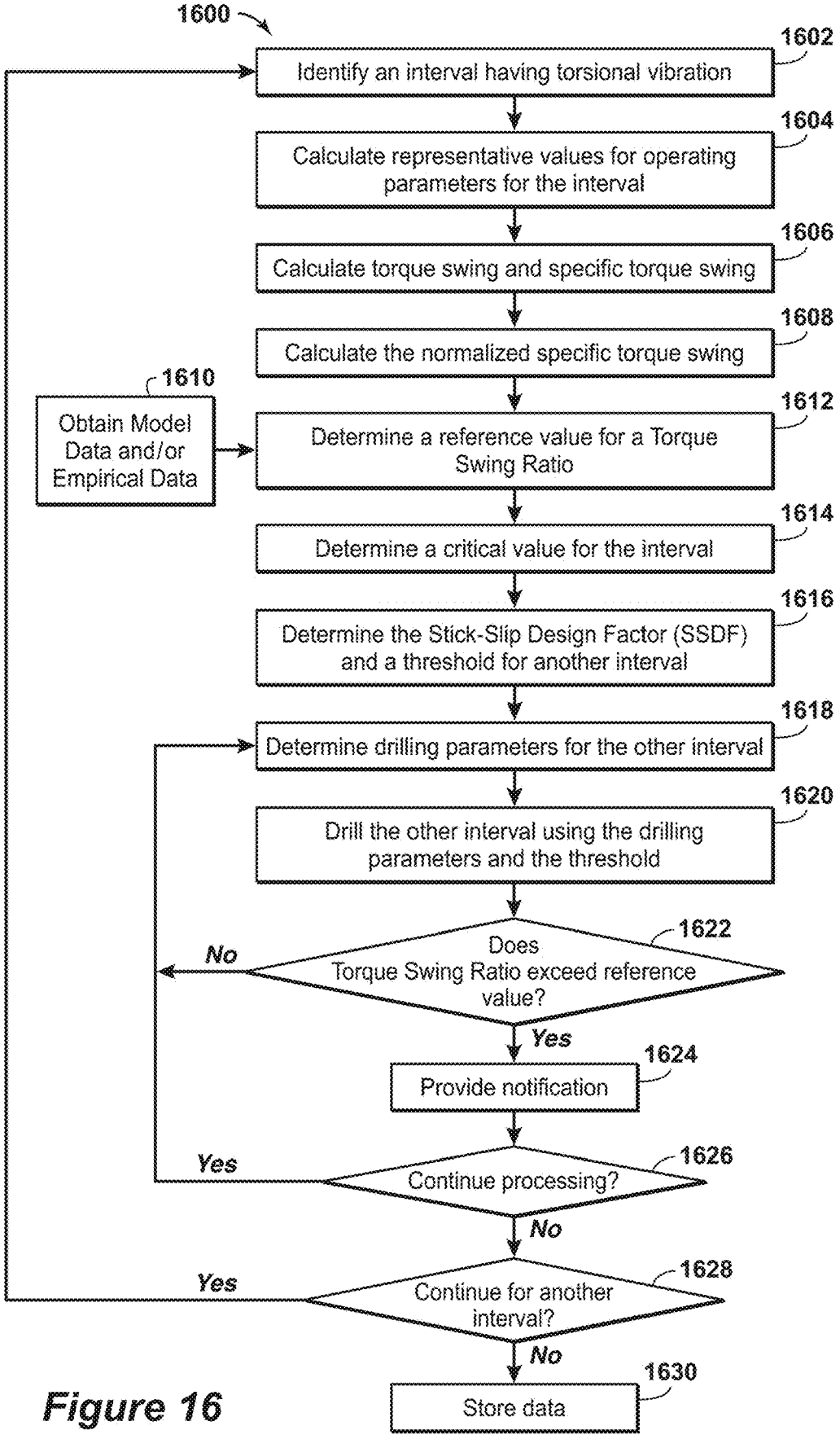
FIG. 16 illustrates a flow chart of another exemplary method in accordance with the present techniques.

In one or more embodiments, the calculations may be used for various systems associated with the drilling of the wellbore (e.g., drilling operations), as shown in FIG. 15 or advising drilling personnel, as shown in FIG. 16. As an example, a first interval may be used in the calculation of an SSDF value, and then the SSDF value may be used in the threshold relationship in equation Eq. 24 to manage the drilling operations in a second interval. Thus, the method may be used as part of a control system, for use in the drilling of a well which may be programmed to apply this algorithm or method in real-time drilling operations. In addition and alternatively, the method may provide information to drilling personnel regarding the torsional vibration performance of the drilling system. The algorithm steps of exemplary embodiments are presented in FIG. 15 and FIG. 16.

FIG. 15 illustrates a flow chart of one exemplary method in accordance with the present techniques. This method involves techniques that uses the drilling data and parameters in one interval to enhance the drilling operations for another interval. In this method, various calculations are performed to analyze the drilling parameters and data, as shown in blocks 1502 to 1508. Then, in blocks 1510 to 1518, the observed data is analyzed and new drilling parameters are calculated. Once calculated, the new drilling parameters are utilized to drill another interval, as shown in block 1520. As shown in blocks 1522 and 1524, a determination is made whether the process should be repeated for another interval or if the data should be stored and the process is complete. One factor considered in block 1522 is to determine if the torque swing ratio values generated while drilling the second interval are less than the reference value. If the TSR values are less than the reference value, then typically the mitigation is considered successful and the operation may continue with sufficiently low levels of stick-slip. If the TSR values from the second interval exceed the reference value, than it is possible that the system requires recalibration to generate a new threshold relationship in equation Eq. 24 for implementation, passing back to the top at block 1502. In some embodiments, the data observed while drilling the second interval may become input data for the first interval for a new cycle of this optimization process.

In more detail, the method begins in block 1502. In this block 1502, an interval having torsional vibration (e.g., torsional stick-slip vibration) is identified (e.g., a first interval). In this interval, drilling data is used to identify the severity of torsional stick-slip vibration, which may involve having RPM and WOB maintained relatively constant. As required, an interval may be subdivided to provide a set of intervals that have individually nearly constant, or stationary, RPM and WOB values. The interval may be identified in which stick-slip occurs, for example determined by a TSE value in excess of 1 as described in SPE 189673. Further, the interval may be defined for this method as a defined section in the wellbore, such as region having similar formation properties (e.g., thickness of the formation, rock strength, mineralogy), defined distance of the wellbore, and/or mechanically related section (e.g., distance to drill the formation before being tripped or interrupted). Then, data is gathered for an interval of suitable duration to provide representative values, and, in block 1504, representative values for drilling parameters are calculated. These representative values for the drilling parameters (e.g., torque, RPM and WOB) may include representative mean or median values for RPM and WOB for the interval (initial or first interval), $\overline{RPM_1}$ and $\overline{WOB_1}$. The calculation of mean or median values $\overline{RPM_1}$ and $\overline{WOB_1}$ may be calculated by methods as known by those skilled in the art, such as general functions "mean" and "median" for example. Then, at block 1506, the torque swing and specific torque swing values are calculated. This calculation is based on the drilling parameters associated with the interval (e.g., from block 1504). The torque swing calculation may be determined by the previously presented in equations Eq.2 and Eq. 2a.

Once these specific torque swing values (e.g., $\Delta TQS_i$) are calculated, the normalized specific torque swing values (e.g., Tau) may be calculated in block 1508. This optional step may not be required if the drilling parameter values do not vary substantially, but in general this calculation reduces the statistical variability in the results. The normalized specific torque swing values of Tau for the data associated with the interval (first interval) may be used to correct for drilling parameter variation, as shown by the previously presented equation Eq. 20:

As discussed above, but worth mentioning again here, the defined term Torque Swing Ratio (TSR) is used to indicate both specific torque swing per RPM and the normalized specific torque swing per RPM. In certain circumstances, it may be perfectly acceptable to use the raw values from equation Eq. 2a without normalization, yet in other cases the normalization in equation Eq. 20 may be significant. Capturing these related concepts within the same term provides a certain amount of convenience in this presentation.

Once these results are determined, the observed data is analyzed and new drilling parameters are calculated, as shown in blocks 1510 to 1518. At block 1510, model data and/or empirical data may be obtained. The model data may include results from a torsional vibration model of the drill string from the drill bit to the surface of the wellbore, for example as described in SPE 163420. This model calculates directly the surface torque swing value corresponding to full stick-slip at the bit. The empirical data may include measured drilling parameter data from one or more prior intervals where the distribution of specific torque swing data can be interpreted with respect to other indications of stick-slip vibrations, for example distributions of measurements from downhole tools. An example of this is described in FIG. 17 below. As may be appreciated, the present techniques may be applied with a selected value and the results assessed, with iterations until sufficient vibration mitigation has been achieved.

At block 1512, a reference value for a Torque Swing Ratio (e.g., specific torque swing (e.g., $\Delta TQS_{ref}$), normalized torque swing and/or combination thereof) is determined and selected as described above. This reference value, which is associated with the drilling system (e.g., drill string and drilling bit), may be based on the model data, empirical data or a combination of both. Indeed, the reference value may be determined that each type of drill string, determined by drill string outer diameter (OD) and inner diameter (ID), and weight and length of the BHA, has a specific reference value for specific torque swing at full stick-slip. The reference value may be determined based on the equipment utilized in the drilling system, the drill bit and/or the formation. The effects of variation in friction resulting from different drilling fluid systems may also be a factor. The reference value for the Torque Swing Ratio may be determined in a variety of methods as known to one of ordinary skill in the art, which may be influenced by the considerations provided in the discussion above.

At block 1514, a critical value $T_{crit}$ is determined for the interval. The critical value may be for the Torque Swing Ratio (e.g., specific torque swing, normalized torque swing and/or combination thereof). As an example, the critical value for the normalized specific torque swing is determined (e.g., from the distribution of values for Tau) for the interval (e.g., based on the data observed in the first drilling interval). Typically, the critical value is determined from the distribution of values of $\tau_{1,i}$ for the interval (e.g., first interval) that is to be mitigated, $\tau_{crit}$ (along with a cutoff value, which may be more than 1% to the right of the critical value, 3% to the right of the critical value, or 10% to the right of the critical value). For example, element 1120 in FIG. 11 refers to a $\tau_{crit}$ value of 70 ft-lbs/RPM "at the three-sigma cutoff". Statistical criteria may be applied such that only a small amount of the distribution (the statistical cutoff value) lies above the critical value. There may be different approaches taken in different operational environments regarding how conservative a value is selected, to some extent based on the consequences of residual stick-slip that may not be mitigated. As an example, the critical values may be determined based on the normalized torque swing per RPM as described above in FIGS. 11 and 12. In block 1516, the Stick-Slip Design Factor (SSDF) and a threshold are determined for another interval. The other interval may be an adjacent interval or may be another interval having similar formation properties. The threshold may be determined through use of equation Eq. 24 described above. There are many instances in production drilling operations in which the same or similar formations are encountered repeatedly. Thus, learnings from one interval may be seen in multiple wells, and lessons learned in one well or interval can be used in other wells or intervals. For this reason, the notion of "first" and "second" interval is fluid and notional, and may be interpreted to include a variety of sequences of drilling operations in any subject wells.

The determination of the Stick-Slip Design Factor (SSDF) for another interval may involve calculating the SSDF from the previously presented equation Eq. 21. Often the SSDF may be determined as a ratio of a reference specific torque swing value for the drill string based on a model (e.g., model data discussed in block 1512), divided by the critical value (as determined in block 1514). Note that the reference value may be obtained from analysis of drilling data directly, even without a model. Also, as another alternative, the SSDF value may be arbitrarily determined based on the judgement of operations personnel. In yet another alternative, the SSDF may be selected as a step in an automated algorithm that seeks an optimal drilling condition without appreciable stick-slip.

Once the SSDF is determined, the drilling parameters are determined for the other interval within the threshold, as shown in block 1518. The threshold may be determined through use of equation Eq. 24 described above.

For example, a drilling control system may be configured and programmed to use drilling parameters not to exceed certain values in the other interval, as specified in equation Eq. 24. Note another interpretation of the threshold in equation Eq. 24 is that there is a minimum RPM* value for each WOB* value. This control algorithm method may be combined with existing methods to optimize ROP, minimize equivalent circulating density (ECD), or another drilling objective. As may be appreciated, the drilling control system may be developed, modified, or otherwise prepared in various ways to implement equation Eq. 24, such that the applied weight on bit (WOB) value does not exceed a value equal to a multiple of the rotary speed (RPM).

The new drilling parameter relation specified in equation Eq. 24 may be utilized to drill another interval using the calculated values from the first interval, as shown in block 1520. Note that equation Eq. 24 may be interpreted as providing a threshold value for WOB for any given RPM value. This relation implies that, along this threshold, WOB may be increased as long as there is a commensurate increase in RPM to increase ROP without stick-slip dysfunction. At block 1520, another interval is drilled using drilling parameters determined by the threshold specified in equation Eq. 24. As an example, the drilling control parameters may include RPM and WOB, or alternatively RPM and ROP, while observing the threshold specified by equation Eq. 24. When RPM and ROP are the control variables (e.g., drilling parameters used to control the drilling operations), as in the example discussed herein, the ROP is adjusted such that the resulting WOB value in equation Eq. 24 is not exceeded. The use of ROP control mode is known by those skilled in the art. With both methods, the other interval may be drilled using a control system programmed to maximize drilling rate, minimize dysfunction, and use WOB not to exceed the constraint threshold of equation Eq. 24.

For certain embodiments, an interval may be drilled with a drilling control system that applies a specific relationship of the drilling parameters. For example, the relationship may be to set WOB to be less than some multiple of RPM, while additional optimization methods may be applied to the drilling parameters, such as maximizing the drilling rate, minimizing the Mechanical Specific Energy (MSE), and minimizing other vibrational dysfunction indicators. In some implementations, this may be a manual drilling operation with alerts provided to the drilling personnel, but an automated algorithm may be preferred. The use of an automated control system may be used to optimize the drilling process, and this algorithm may be implemented within the context of these other optimization processes.

At block 1522, a determination is made whether the process may be repeated for another interval. This determination may involve monitoring the drilling parameters for an indication of torsional stick-slip vibration and then performing the steps 1502 to 1520 for another interval if it is detected. As an example, the process may start with block 1502 with the most recent interval becoming the interval (e.g., initial or first interval) for the calculations in blocks 1504 to 1508, for example. If the process is not repeated, the data may be stored, as shown in block 1524. The stored data may be used for future drilling operations.

In other embodiments, the method may be implemented as an incremental optimization process, adapting to mitigate stick-slip when the SSDF is less than 1.0, and adapting to provide a mechanism for more aggressive drilling parameters for values of SSDF greater than 1.0. The duration of each interval is variable, but in most instances a sufficient amount of data should be obtained on each step to satisfy statistical significance criteria. For example, in an advanced system, it may be feasible to relate different drilling intervals that are non-sequential but are similar in drilling characteristics, such as formation properties. There are indeed many possible implementations of this stick-slip vibration optimization framework.

FIG. 16 illustrates a flow chart of another exemplary method in accordance with the present techniques. For this method, like numbered items are as described with respect to FIG. 15. However, in this method, notifications are provided that the parameter values are exceeding the calculated limits. In this method, various calculations are performed to analyze the drilling parameters and data, as shown in blocks 1602 to 1608. Then, in blocks 1610 to 1618, the observed data is analyzed and new drilling parameters are calculated. Once calculated, the new drilling parameters are used to provide notifications to drilling personnel for another interval, as shown in blocks 1620 to 1626. As shown in blocks 1628 and 1630, a determination is made whether the process should be continued for another interval or if the data should be stored and the process is complete.

The method begins by performing various calculations, as shown in blocks 1602 to 1608. In block 1602, an interval (initial or first interval) having torsional vibration (e.g., torsional stick-slip vibration) is identified, which may be performed as described in block 1502 of FIG. 15. Then, representative values for drilling parameters are calculated for the interval, as shown in block 1604. These calculations may be performed as described in block 1504 of FIG. 15. At block 1606, the torque swing and specific torque swing is calculated, which may be performed as described in block 1506 of FIG. 15. Then, the normalized specific torque swing values (e.g., Tau) are calculated in block 1608, which may be performed as described in block 1508 of FIG. 15.

Once these calculations are determined, the observed data is analyzed and new drilling parameters are calculated, as shown in blocks 1610 to 1618. At block 1610, model data and/or empirical data may be obtained, which may be performed as described in block 1510 of FIG. 15. At block 1612, a reference value for Torque Swing Ratio is determined, which may be performed as described in block 1512 of FIG. 15. The Torque Swing Ratio may be a specific torque swing, a normalized torque swing and/or a combination thereof. Then, a critical value is determined for the interval, as shown in block 1614. This determination may be performed as described in block 1514 of FIG. 15. As shown in block 1616, the Stick-Slip Design Factor (SSDF) and a threshold are determined for another interval, which may be performed as described in block 1516 of FIG. 15. This value and the drilling parameters from the first interval provide the required information to implement the threshold specified in equation Eq. 24 in block 1618. Once these parameters are determined, the other interval may be drilled with the drilling parameters and the threshold, as shown in block 1620. Then, the drilling parameters for the other interval may be evaluated as the other interval is drilled in block 1622. In block 1622, a determination is made whether the Torque Swing Ratio is less than the reference value. The determination may include calculating new values of Torque Swing Ratio as the other interval is drilled (e.g., for the respective time intervals, such as every second, every five seconds, every ten seconds, every 30 seconds, every minute), and these values may be compared to the reference value determined in block 1612. Alternatively, downhole data from MWD tools may be used to determine, while the drilling operation proceeds, if stick-slip is mitigated. The drilling parameters used in the other interval may be compared with the threshold values applied through equation Eq. 24. If these comparisons indicate that the torque swing ratio substantially exceeds the reference value, notification to operations personnel may be provided in block 1624.

To enhance operations in the other interval, the drilling parameters are monitored to provide a notification when the drilling parameter values are outside of the threshold determined by equation Eq. 24 using drilling parameters from the first interval, as shown in blocks 1620 to 1624. This monitoring may include comparing the current drilling parameters relative to the drilling parameter threshold, which may also include calculation of torque swing ratio and comparison relative to the reference value determined in 1612, which may be the Torque Swing Ratio reference value. The drilling parameter threshold is used as a guide, while the comparison of the Torque Swing Ratio calculated from the drilling parameters is compared with the reference value to verify drilling without dysfunction. These criteria may provide similar results to the extent that the intervals are statistically similar. Either criteria could trigger notification. The notification may be an audible indication that the current drilling parameters are exceeding the threshold values (e.g., may be the same sound for all of the drilling parameters or unique sound for each of the respective different drilling parameters) and/or a visual display that the current drilling parameters are exceeding the threshold values (e.g., display on a computer screen, which may identify the drilling parameters being exceeded). Then, a determination is made whether to continue processing the drilling parameter data, as shown in block 1626. If the continuation of the processing is indicated, the process continues through blocks 1618 to 1626, as described above. The drilling parameters may be determined or the same drilling parameters may be used. If an indication is that the process should not continue is determined, then the process may determine whether to perform the processing at block 1602 for another interval.

At block 1628, a determination is made whether the process is to continue for another interval. This determination may involve monitoring the drilling parameters for torsional vibration and then performing the steps 1602 to 1626 for another interval if it is indicated. As an example, the process may start with block 1602 with the most recent interval becoming the interval or another interval having similar characteristics (initial or first interval) for the calculations in blocks 1604 to 1608, for example. If the process is not repeated, the data may be stored, as shown in block 1628. The stored data may be used for other drilling operations.

Figure 6E:
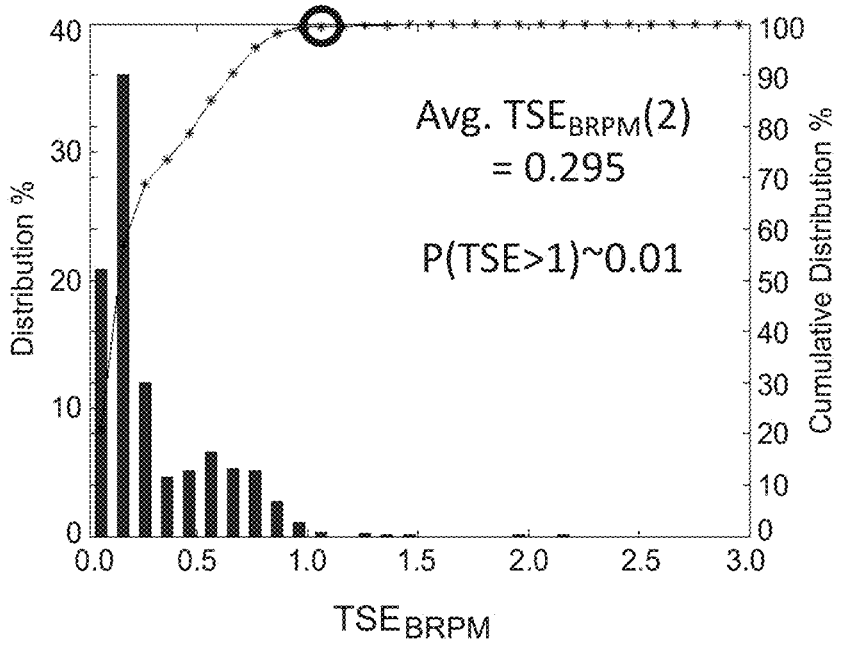
FIG. 6E illustrates the $TSE_{BRPM}$ distribution for Well 2.
Figure 6F:
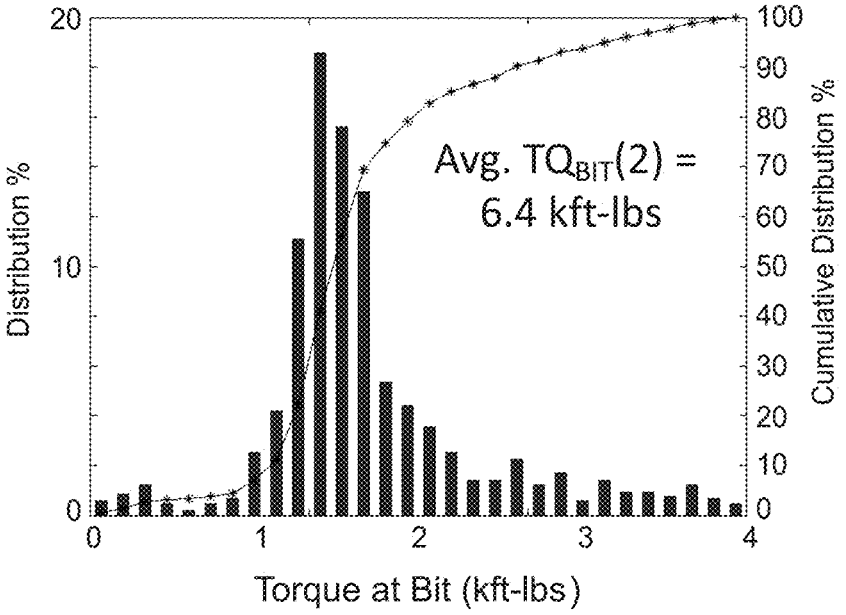
FIG. 6F shows the torque at bit distribution for Well 2.
Figure 17:
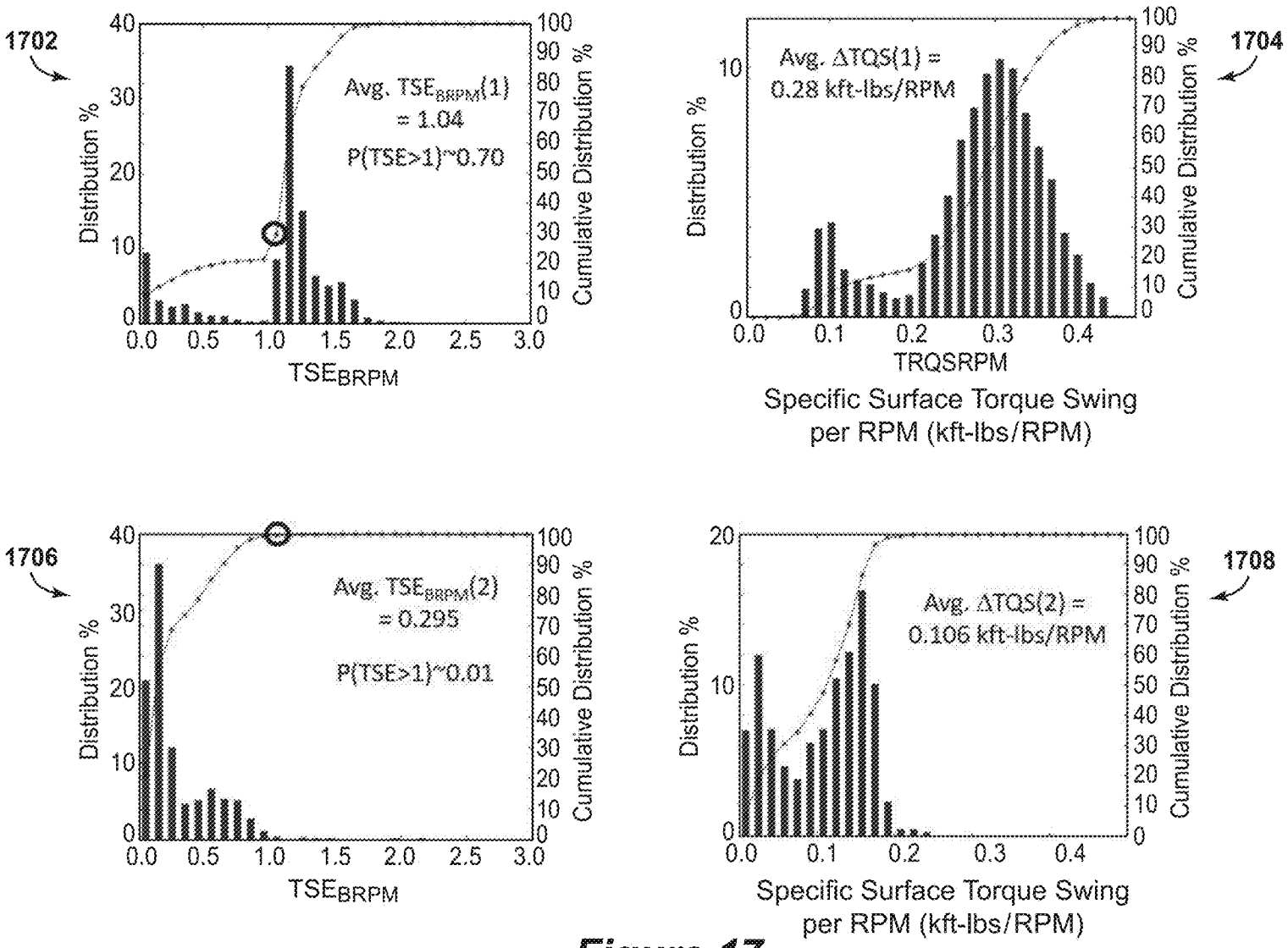
FIG. 17 illustrates charts exemplifies how a critical value for the Torque Swing Ratio may be inferred from drilling data in accordance with the present techniques.

FIG. 17 illustrates charts 1702, 1704, 1706 and 1708 that exemplifies how a reference value for Torque Swing Ratio may be inferred from drilling data in accordance with the present techniques. The chart 1702 represents the $TSE_{BRPM}$ distribution for Well 1, which is also shown in FIG. 4E. Chart 1704 represents the distribution for the specific torque swing per RPM for Well 1, which is shown in FIG. 4C. The chart 1706 represents the $TSE_{BRPM}$ distribution of downhole measurements for Well 2, which is shown in FIG. 6E, while chart 1708 represents the distribution for the specific torque swing per RPM for Well 2, which is shown in FIG. 6C.

In particular, charts 1702 and 1706 describe the distribution of downhole RPM measurements provided by the MWD vendor where a value of 1.0 corresponds to full stick-slip. Clearly, chart 1702 shows that 80% of the values exceeded full stick-slip. Inspection of the data in chart 1704 shows that the 20% cumulative distribution cutoff is seen about 0.20 kft-lbs/RPM. One may also observe a similarity of distribution shapes and then note that the value of the cumulative distribution at full stick-slip from downhole data could provide an appropriate cutoff distribution value for the Torque Swing Ratio. The data from the second well, as provided in charts 1706 and 1708, suggests that somewhere about 0.20 ft-lbs/RPM may be a threshold value. From the previous discussion noted above, the model results provided critical values of 0.125 kft-lbs/RPM for Well 1 and 0.178 kft-lbs/RPM for Well 2. The methods described herein may be applied with a selected value and the results assessed, with iterations until sufficient vibration mitigation has been achieved. This discussion suggests that iteration may be required for the Well 1 case using the empirical data approach. However, it should be noted that adjusting the distribution in chart 1704 such that values are lower than 0.2 kft-lbs/RPM would provide significant reduction in the observed stick-slip vibrations. In this way, the process could be viewed as piecewise linearization of a nonlinear problem. It should further be noted that, for Well 1, the Torque Swing Ratio model reference value of 0.125 kft-lbs/RPM, which is low relative to the actual distribution of Torque Swing Ratio values from drilling, and therefore achieving full mitigation may be challenging with the drilling system used for this interval. The disclosed methods may be valuable in planning wells to avoid stick slip dysfunction and to provide quantitative guidance regarding implications of different alternative systems and drilling parameter values.

Figure 18:
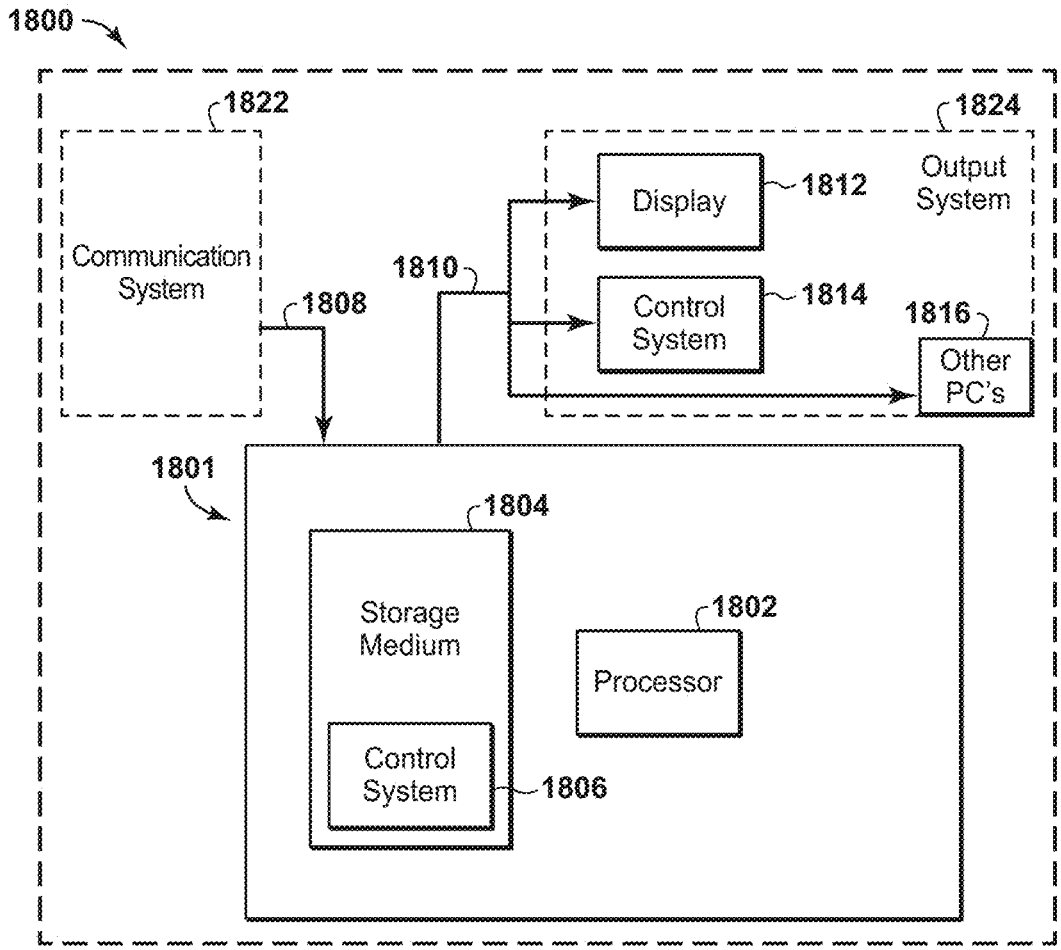
FIG. 18 illustrates a diagram of an exemplary configuration of rig equipment in accordance with the present techniques.

FIG. 18 illustrates a diagram of an exemplary configuration of rig equipment in accordance with the present techniques. This diagram includes an exemplary computer-based system 1801 for use in a drilling operation as part of a drilling rig system 1800. The computer-based system 1801 comprises a processor 1802, a storage medium 1804, and at least one instruction set 1806. The processor 1802 is adapted to execute instructions and may include one or more processors now known or future developed that is used in computing systems. The storage medium 1804 is adapted to communicate with the processor 1802 and to store data and other information, including the at least one instruction set 1806. The storage medium 1804 may include various forms of electronic storage mediums, including one or more storage mediums in communication in any suitable manner.

The selection of appropriate processor(s) and storage medium(s) and their relationship to each other may be dependent on the particular implementation. For example, some implementations may utilize multiple processors and an instruction set adapted to utilize the multiple processors so as to increase the speed of the computing steps. Alternatively or in addition, some implementations may be based on a sufficient quantity or diversity of data that multiple storage mediums are desired or storage mediums of particular configurations are desired. Alternatively still, one or more of the components of the computer-based system 1800 may be located remotely from the other components and be connected via any suitable electronic communications system. For example, some implementations of the present systems and methods may refer to historical data from other wells, which may be obtained in some implementations from a centralized server connected via networking technology.

The at least one instruction set 1806 for the computer-based system 1801 is adapted to perform the calculations, as noted above, or the steps of the methods, as set forth in FIGS. 15 and 16. As illustrated, the computer-based system 1801 receives data at data input 1808 and exports data at data export 1810. The data input and output ports can be serial port (e.g., DB-9 RS232), LAN or wireless network, etc. The at least one instruction set 1806 is adapted to export the generated operational recommendations for consideration in controlling drilling operations. In some implementations, the generated operational recommendations may be exported to a display 1812 for consideration by a user, such as a driller. In other implementations, the generated operational recommendations may be provided as an audible signal, such as up or down chimes of different characteristics to signal a recommended increase or decrease of WOB, RPM, or some other drilling parameter. Preferably, a communication connection (e.g., an ethernet connection) is provided, enabling the delivery of drilling recommendations generated by the optimization functions to a remote engineer in real time.

In one aspect, the generated operational recommendations may be exported to a control system 1814 adapted to determine at least one operational update. The control system 1814 may be integrated into the computer-based system or may be a separate component. Additionally or alternatively, the control system 1814 may be adapted to implement at least one of the determined updates during the drilling operation, automatically, substantially automatically, or upon user activation.

The computer-based system 1801 operates as part of the drilling rig system 1800. The illustrative drilling rig system 1800 includes a communication system 1822 and an output system 1824. The communication system 1822 may be adapted to receive data regarding at least two drilling parameters relevant to ongoing drilling operations. The output system 1824 is adapted to communicate the generated operational recommendations and/or the determined operational updates for consideration in controlling drilling operations.

The communication system 1822 preferably receives data from other parts of an oil field, from the rig and/or wellbore, and/or from another networked data source, such as the Internet. The output system 1824 may be adapted to include displays 1812, printers, control systems 1814, other computing devices (e.g., personal computers (PC's), laptops or servers) 1816, network at the rig site, or other means of exporting the generated operational recommendations and/or the determined operational updates.

Conventional systems at most drilling rigs process large quantities of data, including drilling parameters, which may also include automated control system algorithms and processes to monitor, display, and control the efficiency of drilling operations. In the present techniques, the system 1801 may be adapted to implement the additive technology disclosed herein whereby the calculations are performed on processor 1802, the data is stored in storage medium 1804, and the instructions to implement the methods are programmed into the control system 1806. The drilling rigs should have hardware, software and firmware to implement the disclosed methods and algorithms in either or both automated or advisory/notification modes.

As a further enhancement, the system may include one or more sensors to monitor the drilling operations, which are used to manage the drilling operations. For example, when drilling the second interval, the system may use the drilling parameter threshold and downhole stick-slip values at a drill bit, which are provided from the one or more sensors. The sensors may include gyros, accelerometers, magnetometers, strain gauges, and any combination thereof. These may be used to detect and monitor the vibration of the drill string or other downhole equipment.

In one or more embodiments, the present techniques may be susceptible to various modifications and alternative forms, such as the following embodiments as noted in paragraphs 1 to 11:

1. A method for drilling a wellbore in a subterranean formation, comprising: a) obtaining drilling parameters characterizing a drilling operation using a drill string to drill a portion of a wellbore; b) identifying a first drilling interval; c) selecting an averaging function to represent RPM and WOB, and calculating the $\overline{RPM_1}$ values and $\overline{WOB_1}$ values for the first drilling interval; d) calculating the torque swing $\Delta TQ_i$ for each torsional vibration cycle (i) and an average RPM over the torsional vibration cycle, and further determining the specific torque swing $\Delta TQS_i$ values for each torsional vibration cycle for the first drilling interval, using the equations: i) for torque swing $\Delta TQ_i$ for each torsional vibration cycle (i): $\Delta TQ_i = \max(TQ_i, TQ_{i-1}, \ldots, TQ_{i-P}) - \min(TQ_i, TQ_{i-1}, \ldots, TQ_{i-P})$; ii) For specific torque swing $\Delta TQS_i$ for each torsional vibration cycle (i): Specific Torque Swing $\Delta TQS_i$=Torque Swing $\Delta TQ_i/RPM_i$; and iii) the $RPM_i$ is an average for the i; e) calculating the normalized specific torque swing values of Tau for each torsional vibration cycle of the first drilling interval using the equation:

$$\tau_i = \Delta TQS_{,i} \cdot \frac{RPM_i}{\overline{RPM_1}} \frac{\overline{WOB_1}}{WOB_i}; f\Big)$$

determining a reference value for a specific surface torque swing at full stick-slip per RPM for the drill string ($\Delta TQS_{ref}$) for the first drilling interval; g) determining a critical value $\tau_{crit}$ from the distribution of $\tau_i$ such that 10% of the distribution has higher normalized torque swing values for the data in the first drilling interval; h) calculating a Stick-Slip Design Factor (SSDF) for the second interval, calculated by $SSDF = \Delta TQS_{ref}/\tau_{crit}$ T; i) managing a drilling operation for the second interval based on the SSDF.

2. The method of paragraph 1, wherein the managing the drilling operation for the second interval based on the SSDF, further comprises: i) preparing a drilling control system to use WOB in the second interval not to exceed a value equal to $$WOB = SSDF \cdot \frac{\overline{WOB_1}}{\overline{RPM_1}} \cdot RPM;$$

and ii) drilling a subsequent interval of a wellbore applying an algorithm that includes a method to limit WOB to a value no greater than $$WOB = SSDF \cdot \frac{\overline{WOB_1}}{\overline{RPM_1}} \cdot RPM.$$

3. The method of paragraph 1, wherein the managing the drilling operation for the second interval based on the SSDF, further comprises providing a visual notification of the parameter values exceeding the calculated limits.

4. The method of paragraph 1, wherein in which the average in step (c) is one or a mean value and a median value.

5. The method of paragraph 1 in which the reference value of specific torque swing in step (f) is calculated by a drill string model.

6. The method of paragraph 1 in which the reference value of specific torque swing in step (f) is determined by statistical analysis of drilling data.

7. The method of paragraph 1 in which the critical value $\tau_{crit}$ is determined such that 3% of the distribution has higher normalized torque swing values for the data in the first drilling interval, or such that 1% of the distribution has higher normalized torque swing values for the data in the first drilling interval.

8. The method of paragraph 1 in which the WOB value is a parameter measured at the surface by surface rig equipment, or measured downhole by drilling tools.

9. The method of paragraph 1 in which the RPM value is a parameter measured at the surface by surface rig equipment or measured downhole by drilling tools.

10. The method of paragraph 1 in which the drilling interval in step (b) is selected with relatively constant RPM and WOB; is calculated automatically by selecting intervals of relatively stationary parameters or is selected for a depth interval determined by geological formation properties; is selected for a convenient depth interval, such as for a fixed length interval or the most recent historical data in depth; or is selected for a convenient time interval, such as the most recent historical data in time.

11. A surveillance system for a drilling rig adapted for drilling a wellbore in a subterranean formation, comprising: a) equipment to record and prepare for computation and display drilling parameters, including at least rotary speed (RPM), weight on bit (WOB), and torque (TRQ); b) algorithms to provide drilling parameter values to a drilling rig, such algorithms configured to: c) select an averaging function to represent RPM and WOB, and calculate average $\overline{RPM_1}$ and $\overline{WOB_1}$ values for a first drilling interval; d) calculate the torque swing for each torsional vibration cycle and an average RPM over the torsional vibration cycle, and further determine the specific torque swing per RPM $\Delta TQS_{1,i}$ values for the first drilling interval, using the relations:

$$\text{Torque Swing } \Delta TQ_i = \max(TQ_i, TQ_{i-1}, \ldots, TQ_{i-P}) - \min(TQ_i, TQ_{i-1}, TQ_{i-P});$$

$$\text{Specific Torque Swing } \Delta TQS_i = \text{Torque Swing } \Delta TQ_i / RPM_i$$

and the rotary speed is averaged for the corresponding intervals in time; e) calculate the normalized specific torque swing values of Tau for the first drilling interval using the expression, $$\tau_{1,i} = \Delta TQS_{1,i} \cdot \frac{RPM_i}{\overline{RPM_1}} \frac{\overline{WOB_1}}{WOB_i}; f)$$

determine a reference value for a specific surface torque swing at full stick-slip per RPM for the drill string ($\Delta TQS_{ref}$) for the first drilling interval; g) determine a critical value $T_{crit}$ from the distribution of $\tau_{1,i}$ such that 1% of the distribution has higher normalized torque swing values for the data in the first drilling interval; h) calculate a Stick-Slip Design Factor (SSDF) for the second interval, calculated by $SSDF = \Delta TQS_{ref}/\tau_{crit}$; i) prepare a drilling control system to use WOB in the second interval not to exceed a value equal to $$WOB = SSDF \cdot \frac{\overline{WOB_1}}{\overline{RPM_1}} \cdot RPM; j)$$

and, drilling a subsequent interval of a wellbore applying an algorithm that includes a method to limit WOB to a value no greater than $$WOB = SSDF \cdot \frac{\overline{WOB_1}}{\overline{RPM_1}} \cdot RPM.$$

While the present techniques of the invention may be susceptible to various modifications and alternative forms, the exemplary embodiments discussed above have been illustrated by way of example. However, it should again be understood that the invention is not intended to be limited to the particular embodiments disclosed herein. Illustrative, non-exclusive, examples of descriptions of some systems and methods within the scope of the present disclosure are presented in the above following paragraphs. The preceding paragraphs are not intended to be an exhaustive set of descriptions, and are not intended to define minimum or maximum scopes or required elements of the present disclosure. Instead, they are provided as illustrative examples, with other descriptions of broader or narrower scopes still being within the scope of the present disclosure. Indeed, the present techniques of the invention are to cover all modifications, equivalents, and alternatives falling within the spirit and scope of the description provided herein.

What is claimed is:

1. A method for drilling a wellbore in a subterranean formation, comprising:

identifying a first interval having torsional vibration within a wellbore;

calculating representative values for drilling parameters for the first interval;

determining Torque Swing Ratio values for the drilling parameters for the first interval, wherein the Torque Swing Ratio is one of specific torque swing, normalized specific torque swing, and a combination thereof;

determining a reference value for the Torque Swing Ratio at full stick-slip for a drill string;

determining a Stick-Slip Design Factor (SSDF) and a drilling parameter threshold for a second interval, wherein the SSDF is based on the Torque Swing Ratio values and the reference value;

monitoring drilling parameters for the second interval;

determining Torque Swing Ratio values from the drilling parameters for the second interval; and managing a drilling operation for the second interval based on the drilling parameter threshold and a comparison of the determined Torque Swing Ratio values for the second interval with the Torque Swing Ratio reference value.

2. The method of claim 1, wherein the drilling parameters comprise rotary speed (RPM), weight on bit (WOB), and drill string torque (TQ).

3. The method of claim 2, wherein the calculating representative values for drilling parameters for the first interval, further comprises:

i) selecting an averaging function to represent RPM and WOB, and ii) calculating averaged rotary speed for the first interval values ($\overline{RPM_1}$) and averaged weight on bit ($\overline{WOB_1}$) values for the first drilling interval.

4. The method of claim 3, further comprising calculating torque swing and specific torque swing for the first interval based on the following:

calculating the torque swing $\Delta TQ_i$ for each torsional vibration cycle (i) based on the following:

for torque swing $\Delta TQ_i$ for each i:

$$\Delta TQ_i = \max(TQ_i, TQ_{i-1}, \ldots, TQ_{i-P}) - \min(TQ_i, TQ_{i-1}, \ldots, TQ_{i-P})$$

where i is index for torsional vibration cycle;

P is a time window length at least as long as the torsional vibration period;

$\max(TQ_i, TQ_{i-1}, \ldots, TQ_{i-P})$ is the maximum torque value over the torsional vibration cycle; and $\min(TQ_i, TQ_{i-1}, \ldots, TQ_{i-P})$ is the minimum torque value over the torsional vibration cycle;

calculating an average RPM for each i (RPM); and determining specific torque swing ΔTQSi values for each i based on the following:

$$\Delta TQS_i = \Delta TQ_i / RPM_i.$$

5. The method of claim 4, wherein the determining the Torque Swing Ratio reference value, further comprises identifying the Torque Swing Ratio based on the specific torque swing.

6. The method of claim 4, further comprising calculating a normalized specific torque swing $\tau_i$ for each i of the first interval based on the equation:

$$\tau_i = \Delta TQS_{,i} \cdot \frac{RPM_i}{\overline{RPM_1}} \frac{\overline{WOB_1}}{WOB_i}$$

where $\tau_i$ is the normalized specific torque swing per RPM; and $WOB_i$ is a representative WOB for each i.

7. The method of claim 6, wherein the determining the Torque Swing Ratio reference value, further comprises identifying the Torque Swing Ratio based on the normalized specific torque swing.

8. The method of claim 6, further comprising:

determining a critical value $\tau_{crit}$ from a distribution of $\tau_i$ for the first interval such that 10% of the distribution has higher normalized specific torque swing values for data in the first interval;

wherein the Torque Swing Ratio reference value for the first interval is $\Delta TQS_{ref}$; and wherein the determining the SSDF for the second interval further comprises calculating the SSDF for the second interval based on the following:

$$SSDF=\Delta TQS_{ref}/\tau_{crit}.$$

9. The method of claim 8, wherein the managing the drilling operation for the second interval based on the drilling parameter threshold and the comparison of the Torque Swing Ratio reference value with the determined specific torque swing, further comprises:

i) configuring a drilling control system to calculate WOB in the second interval;

ii) configuring the drilling control system to operate by not exceeding a WOB limit, wherein the WOB limit is determined based on the following:

$$WOB = SSDF \cdot \frac{\overline{WOB_1}}{\overline{RPM_1}} \cdot RPM;$$

and ii) drilling the second interval of the wellbore by applying the WOB limit and adjusting drilling parameters to maintain the WOB to be less than or equal to the WOB limit.

10. The method of claim 1, wherein the managing the drilling operation for the second interval based on the drilling parameter threshold and the comparison of the Torque Swing Ratio reference value with the determined specific torque swing, further comprises providing a visual notification of the monitored drilling parameters that exceed the drilling parameter threshold and specific torque swing values that exceed the Torque Swing Ratio reference value.

11. The method of claim 1, wherein the managing the drilling operation for the second interval based on the drilling parameter threshold and the comparison of the Torque Swing Ratio reference value with the determined torque swing further comprises providing an audio notification of the monitored drilling parameters that exceed the drilling parameter threshold and specific torque swing values that exceed the Torque Swing Ratio reference value.

12. The method of claim 1, wherein the determining the Torque Swing Ratio reference value further comprises:

modeling a drill string representing drilling equipment drilling the wellbore in the subterranean formation to create a drill string model; and calculating a reference value of specific torque swing at full stick-slip with results from the drill string model; and setting the Torque Swing Ratio reference value to the calculated reference value.

13. The method of claim 1, wherein the determining the Torque Swing Ratio reference value further comprises:

receiving downhole torsional vibration data from drilling tools comprising stick-slip values $TSE_{BRPM}$ at a drill bit for the first interval;

calculating a first distribution of the stick-slip values $TSE_{BRPM}$ from the downhole torsional vibration data;

calculating a second distribution of Torque Swing Ratio values from the drilling parameters for the first interval;

comparing the second distribution of Torque Swing Ratio values with the first distribution of stick-slip values $TSE_{BRPM}$ to determine distribution cutoff values; and determining the Torque Swing Ratio reference value based on the determined distribution cutoff values.

14. The method of claim 13, wherein the stick-slip values at the drill bit for the first interval are calculated using the relation for $TSE_{BRPM}$;

$$TSE_{BRPMi} = \frac{\max(BRPM_i, BRPM_{i-1}, \ldots, BRPM_{i-p}) - \text{Average}(BRPM_i, BRPM_{i-1}, \ldots, BRPM_{i-p})}{\text{Average}(BRPM_i, BRPM_{i-1}, \ldots, BRPM_{i-p})}$$

where i is index for torsional vibration cycle;

P is a time window length at least as long as the torsional vibration period;

max ($BRPM_i$, $BRPM_{i-1}$, . . . , $BRPM_{i-p}$) is the maximum bit RPM observed in the time window;

Average ($BRPM_i$, $BRPM_{i-1}$, . . . , $BRPM_{i-p}$) is the average bit RPM observed in the time window; and $TSE_{BRPMi}$ is the calculated stick-slip TSE ratio for each torsional vibration cycle (i).

15. The method of claim 1 wherein the managing the drilling operation for the second interval is based on the drilling parameter threshold; and further comprises:

monitoring downhole stick-slip values at a drill bit for the second interval;

determining whether the torsional vibration is being managed based on the monitored downhole stick-slip values;

if the torsional vibration is being managed, continuing to operate with the drilling parameter threshold; and if the torsional vibration is not being managed, recalculating the drilling parameter threshold based on the second interval.

16. The method of claim 1 wherein the determining a Torque Swing Ratio reference value further comprises:

obtaining drilling data;

obtaining torsional vibration data from downhole drilling measurements;

calculating the Torque Swing Ratio for each torsional vibration cycle; and identifying the Torque Swing Ratio reference value based on statistical analysis of the Torque Swing Ratio values and the torsional vibration data from downhole measurements.

17. The method of claim 2, wherein the WOB is a parameter measured downhole by drilling tools.

18. The method of claim 1, further comprising dividing the subsurface formation into at least the first interval and the second interval based on one or more of a depth interval determined by geological formation properties and a depth-based calculation for intervals in which the drilling parameters are relatively stationary.

19. A drilling rig system for drilling a wellbore in a subterranean formation, comprising:

a drilling rig;

a drill string attached to the drilling rig and partially disposed within a wellbore;

a drill bit attached to the drill string and configured to penetrate a subsurface formation to form a wellbore; and a drilling control system for managing drilling operations and configured to:

monitor drilling parameters associated with the drill string and the drill bit, wherein the drilling parameters comprise rotary speed (RPM), weight on bit (WOB), and torque (TQ);

identify a first interval having torsional vibration within the wellbore;

calculate representative values for the drilling parameters for the first interval;

determine Torque Swing Ratio values for the drilling parameters for the first interval, wherein the Torque Swing Ratio is one of specific torque swing, normalized specific torque swing, and a combination thereof;

determine a reference value for the Torque Swing Ratio at full stick-slip for the drill string;

determine a Stick-Slip Design Factor (SSDF) and a drilling parameter threshold for a second interval, wherein the SSDF is based on the Torque Swing Ratio values and the reference value;

monitor drilling parameters for the second interval;

determine Torque Swing Ratio from the drilling parameters for the second interval; and provide notifications for the second interval based on one of the drilling parameter threshold, the comparison of the Torque Swing Ratio reference value with the determined Torque Swing Ratio values, and any combination thereof.

20. The drilling rig system of claim 19, wherein the drilling control system is further configured to:

calculate representative values for drilling parameters for the first interval by:

i) selecting an averaging function to represent rotary speed (RPM), and weight on bit (WOB), and ii) calculating averaged rotary speed for the first interval values ($\overline{RPM_1}$) and averaged weight on bit ($\overline{WOB_1}$) values for the first drilling interval;

calculate torque swing and specific torque swing for the first interval based on the following:

calculating the torque swing $\Delta TQ_i$ for each torsional vibration cycle (i) based on the following:

for torque swing $\Delta TQ_i$ for each i:

$$\Delta TQ_i=\max(TQ_i, TQ_{i-1}, \ldots, TQ_{i-P})-\min(TQ_i, TQ_{i-1}, \ldots, TQ_{i-P})$$

where i is index for torsional vibration cycle;

P is a time window length at least as long as the torsional vibration period;

$\max(TQ_i, TQ_{i-1}, \ldots, TQ_{i-P})$ is the maximum torque value over the torsional vibration cycle; and $\min(TQ_i, TQ_{i-1}, \ldots, TQ_{i-P})$ is the minimum torque value over the torsional vibration cycle;

calculating an average RPM for each i ($RPM_i$); and determining specific torque swing ΔTQSi values for each i based on the following:

$$\Delta TQS_i=\Delta TQ_i/RPM_i;$$

calculate a normalized specific torque swing $\tau_i$ for each i of the first interval based on the equation:

$$\tau_i = \Delta TQS_{,i} \cdot \frac{RPM_i}{\overline{RPM_1}} \frac{\overline{WOB_1}}{WOB_i}$$

where $\tau_i$ is the normalized specific torque swing per RPM; and $WOB_i$ is average WOB for each i, determine a reference value for a specific surface torque swing at full stick-slip per RPM for the drill string ($\Delta TQS_{ref}$);

determine a critical value $\tau_{crit}$ from a distribution of $\tau_i$ for the first interval such that 10% of the distribution has higher normalized specific torque swing values for data in the first interval;

wherein the Torque Swing Ratio reference value for the first interval is $\Delta TQS_{ref}$; and determine the SSDF for the second interval further comprises calculating the SSDF for the second interval based on the following:

$$SSDF=\Delta TQS_{ref}/\tau_{crit}$$

.

21. The drilling rig system of claim 19, wherein the drilling control system for managing drilling operations and is further configured to provide visual notifications on a monitor based on the one of the drilling parameter threshold, the comparison of the Torque Swing Ratio reference value with the determined Torque Swing Ratio values, and any combination thereof.

* * * * *